US007878125B2

(12) United States Patent
Forbes et al.

(10) Patent No.: US 7,878,125 B2
(45) Date of Patent: Feb. 1, 2011

(54) RAILROAD FREIGHT CAR

(75) Inventors: James W. Forbes, Campbellville (CA); Tomasz Bis, Ancaster (CA); Mohammed Al-Kaabi, Hamilton (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 12/838,788

(22) Filed: Jul. 19, 2010

(65) Prior Publication Data

US 2010/0275812 A1 Nov. 4, 2010

Related U.S. Application Data

(60) Continuation of application No. 12/502,535, filed on Jul. 14, 2009, now Pat. No. 7,757,611, which is a division of application No. 12/248,305, filed on Oct. 9, 2008, now Pat. No. 7,559,284, which is a division of application No. 11/270,657, filed on Nov. 10, 2005, now Pat. No. 7,434,519.

(51) Int. Cl.
*B61D 17/00* (2006.01)

(52) U.S. Cl. ..... 105/406.1; 105/411; 105/419; 105/422

(58) Field of Classification Search ..... 105/406.1, 105/407, 409, 411, 418, 419, 422
See application file for complete search history.

(56) References Cited

U.S. PATENT DOCUMENTS

| | | | |
|---|---|---|---|
| 725,213 | A | 4/1903 | Buhoup |
| 831,654 | A | 9/1906 | Dodds |
| 1,703,756 | A | 2/1929 | Wine |
| 1,768,728 | A | 7/1930 | Zimmer |
| 1,803,449 | A | 5/1931 | Wine |
| 1,804,769 | A | 5/1931 | Hart et al. |
| 1,834,264 | A | 12/1931 | Wine |
| 1,962,717 | A | 6/1934 | Kiesel, Jr. |
| 1,981,714 | A | 11/1934 | Yost |
| 2,072,996 | A | 3/1937 | Wine |
| 2,146,221 | A | 2/1939 | Meyer et al. |
| 2,167,362 | A | 7/1939 | Hindahl |
| 3,240,168 | A | 3/1966 | Charles et al. |
| 3,421,453 | A | 1/1969 | Allen et al. |
| 3,964,399 | A | 6/1976 | Miller et al. |
| RE30,388 | E | 9/1980 | Mundinger et al. |

(Continued)

OTHER PUBLICATIONS

Blodgett, Omer W., "Rigid-Frame Knees (Elastic Design)" in Design of Welded Structures, James F. Lincoln Arc Welding Foundation, Jun. 1966., pp. 5.11-1 to 5.11-20.

(Continued)

*Primary Examiner*—Lars A Olson
(74) *Attorney, Agent, or Firm*—Hahn Loeser & Parks LLP; Michael H. Minns

(57) ABSTRACT

A railroad freight car may have a body for carrying lading. The body may be a gondola car body. The car body may include a decking or floor structure, and may include longitudinally extending side beams bordering the floor structure. The connection of the side beams to the floor structure may be may without the use of a dedicated side sill. The car body structure may include cross-bearers and side beam stiffeners that are joined together by structural knees. The car body may also include clean out ports to facilitate cleaning of the lading receptacle.

20 Claims, 42 Drawing Sheets

U.S. PATENT DOCUMENTS

| | | | |
|---|---|---|---|
| 4,252,067 | A | 2/1981 | Stark |
| 4,262,601 | A | 4/1981 | Miller |
| 4,280,778 | A | 7/1981 | Knippel |
| 4,301,742 | A | 11/1981 | Patil et al. |
| 4,331,083 | A | 5/1982 | Landregan et al. |
| 4,417,526 | A | 11/1983 | Marulic et al. |
| 4,633,787 | A | 1/1987 | Przybylinski et al. |
| 4,637,320 | A | 1/1987 | Patton et al. |
| 4,690,072 | A | 9/1987 | Wille et al. |
| 4,771,705 | A | 9/1988 | Przybylinski et al. |
| 4,840,127 | A | 6/1989 | Tomaka |
| 4,930,427 | A | 6/1990 | Ritter |
| 5,335,603 | A | 8/1994 | Wirick |
| 6,978,720 | B2 | 12/2005 | Johnson |
| 7,434,519 | B2 | 10/2008 | Forbes et al. |
| 7,461,600 | B2 | 12/2008 | Forbes et al. |
| 7,559,284 | B2 | 7/2009 | Forbes et al. |
| 7,757,611 | B2 | 7/2010 | Forbes et al. |

OTHER PUBLICATIONS

"The Car and Locomotive Cyclopedia of American Practices", 6th ed., ("The 1997 Cyclopedia") 1997, Simmons-Boardmann, Omaha, Section 1, "Open Top Hoppers" pp. 46-69.

"The Car and Locomotive Cyclopedia of American Practices", 6th ed., ("The 1997 Cyclopedia") 1997, Simmons-Boardmann, Omaha, Section 1, "Gondolas" pp. 74-93.

RAILROAD FREIGHT CAR

This application is a continuation of U.S. patent application Ser. No. 12/502,535 filed Jul. 14, 2009, now U.S. Pat. No. 7,757,611, which is a divisional of U.S. patent application Ser. No. 12/248,305 filed Oct. 9, 2008, now U.S. Pat. No. 7,559,284, which is a divisional of U.S. patent application Ser. No. 11/270,657 filed Nov. 10, 2005, now U.S. Pat. No. 7,434,519, and are hereby incorporated by reference.

FIELD OF THE INVENTION

This invention relates to the field of railroad freight cars.

BACKGROUND

In North American railroad history one of the more common types of freight car rolling stock has been the gondola car. Gondola cars have been used to transport many different kinds of freight, from bulk commodities to scrap steel. Traditionally, gondola cars have tended to have two relatively deep side beams. Typically, the side beams, the floor, and the end walls of the body of a gondola car define an open topped container, or receptacle, into which lading may be placed. Gondola cars may sometimes have a center sill of relatively modest size. The side beams may often be the dominant vertical load bearing members, and may tend, at their ends, to be mated to a laterally extending main bolster and shear plate. The side beams themselves have tended to be deep beams having a top chord, a side sill, and a vertical web extending between the top chord and side sill.

The top chord is, typically, a continuous chord member running substantially the full length of the car. The top chord defines the upper edge or upper margin of the side beam of the car. It performs the function of the upper flange of the side beam. Most typically the top chord may be a hollow section. While top chords in the form of I-beams and C-channels can, and have, been used, top chords are frequently formed of closed hollow sections, such as rectangular (or square) steel tubes. Most often, vertical lading in the gondola car may tend to cause the top chord to be placed in compression.

Similarly, a side sill may be, or may include, a bottom chord of the deep side beam. That is, the side sill may include a lengthwise running member that defines the lower bounding member of the side beam of the car. The lengthwise running member may run substantially the entire length of the side beam, and may function to define the lower flange of the side beam. That lengthwise member is sometimes called a side sill, and sometimes called a bottom chord, but in either case may tend to function as the lower flange of the side beam. The side sill terminology may be more commonly used where the longitudinally extending member links the ends of cross-bearers and cross-ties at the edge of a deck or floor. In use, under vertical load the bottom chord or side sill, as it may be called, is most typically in tension. A side sill or bottom chord member may typically tend to be of quite substantial cross-sectional area. It may have a cross-sectional area of a comparable order of magnitude to that of the top chord. It may not necessarily be of closed hollow section, but may, for example, have the form of a large angle iron. Under vertical loading, the top chord and bottom chord may tend to work in opposition to carry bending moments from the center of the car to the end sections, with the vertical side sheets of the car carrying shear between the top chord and the bottom chord.

There has long been a desire in the railroad freight carrying industry generally to reduce the weight of freight cars, and to increase the ratio of allowable lading weight to car weight. All other factors being equal, a lighter freight car may tend to permit a greater amount of lading to be carried without exceeding a maximum gross weight on rail, and may tend to reduce the amount of fuel consumed while backhauling empty cars. In as much as bottom chords and side sills may tend to be quite heavy, a very substantial reduction in the size and weight of a side sill, or the substantially total elimination of a side sill may therefore hold out the prospect of a significant reduction in weight. There may also be significant gains in simplicity of manufacture.

It may also be desirable, from time to time, to be able to clean out a gondola car, as when it may be desired to carry a different type of lading.

SUMMARY OF THE INVENTION

In an aspect of the invention there is a railroad gondola car. It has a gondola car body carried by railroad car trucks for rolling motion along railroad tracks. The gondola car body has a longitudinal centerline. The gondola car body has a floor and a wall structure standing upwardly of the floor, the floor and the wall structure defining a lading receptacle. The gondola car body includes a pair of lengthwise running side beams, the side beams defining portions of the wall structure. The side beams each have an upper margin, and a longitudinally running shear web member extending predominantly downwardly of the upper margin. The floor includes at least one floor panel. The floor panel and the shear web member are directly mated together.

In another feature of that aspect of the invention, the shear web member extends at least one quarter of the way from the floor panel to the upper margin. In another feature the web member includes an upper portion and a lower portion, the upper portion having a lower margin, the lower portion being attached along the lower margin to the upper portion, and the lower portion is mated directly to the floor panel. In still another feature, the lower portion lies outboard of the upper portion. In an additional feature, the lower portion lies inboard of the upper portion. In still another feature, the shear web member is a monolithic member extending from the floor panel to the upper margin. In yet still another feature, the side beam includes a top chord member distant from the floor panel, and the shear web member is a monolithic member extending from the floor panel to the top chord. In again another feature, the shear web member is predominantly planar. In a still further feature, the shear web member stands normal to the floor panel. In yet another feature the floor panel extends laterally away from the longitudinal centerline past the shear web. In a still further feature, the floor panel is the only floor panel of the railroad car. In another feature, a majority of the floor is made from the floor panel. In a further feature the car is free of side sills. In still yet another feature the side beam includes an upwardly standing post that extends upwardly from the floor panel, outboard of the shear web; and the floor panel extends past the shear web and underlies at least a portion of the post. In still yet another feature, the gondola car includes a center sill, the center sill has a pair of spaced apart webs extending downwardly from the floor panel, and the webs each have an upper margin mated to the floor panel. In again another feature, the gondola car includes cross-bearers, and the cross-bearers have webs, the webs having upper margins mated directly to the floor panel.

In another feature, the gondola car includes a center sill. The center sill has a pair of spaced apart webs extending downwardly from the floor panel, the webs each have an upper margin mated to the floor panel. The gondola car includes at least one cross-bearer, the cross-bearer has at least one web, and the web of the cross-bearer has an upper margin mated directly to the floor panel. The floor panel defines an upper flange of the centersill and the cross-bearers, and a bottom flange of the side beam. In a further feature, the railroad car is free of any other member defining a center sill top flange. In again another feature the railroad car is free of any other member defining cross-bearer top flanges. In still another feature the railroad car is free of any other member defining a bottom flange of the side beam. In yet another feature, the car has a cross-bearer, the cross-bearer having at least one web extending downwardly of the floor panel. The car has a side beam post standing upwardly of the floor panel, the side beam post having at least a first portion standing laterally distant from the shear web of the side beam, and a second portion providing a shear transfer web between the first portion and the web of the side beam. The cross-bearer has a bottom flange distant from the floor panel. The cross-bearer and the post meeting at a structural knee. The knee has web continuity of the shear web of the side beam above and below the floor sheet between. The knee has flange continuity of the bottom flange inboard and outboard of the shear web of the side beam. The knee has flange continuity of the first portion of the side beam post above and below the floor panel. In yet another feature, the railroad car includes at least one clean out port mounted in one of the side beams, the clean out port including a movable access member.

In another aspect of the invention there is a railroad gondola car having a gondola car body carried by railroad car trucks for rolling motion along railroad tracks. The gondola car body has a longitudinal centerline. The gondola car body has a floor and a wall structure standing upwardly of the floor. The floor and the wall structure define a lading receptacle. The gondola car body including a pair of lengthwise running side beams, the side beams defining portions of the wall structure. The side beams each have an upper margin, and a shear web member. One of the side beams having at least one upstanding side post. The floor includes at least one floor panel. The gondola car body includes at least one cross-wise extending floor supporting cross member. The cross member and the side post is linked by a structural knee. The gondola car body includes members defining a top flange, a bottom flange and a web of the cross member. The gondola car body having structure defining a first flange of the side post, a second flange of the side post, and a shear web linking the flanges of the side post, one of the first and second flanges being spaced outboard of the other. The knee having a shear member connected to receive a moment couple from the side post, and the shear member also being connected to transmit that moment couple to the flanges of the cross member.

In still another aspect of the invention there is a railroad gondola car having a gondola car body carried on railroad car trucks for rolling motion along railroad tracks. The gondola car body includes a floor and sidewalls standing upwardly from the floor. A cross member extends sideways beneath the floor. The cross member has a laterally outboard end. One of the sidewalls includes a predominantly upwardly extending stiffener. The upwardly extending stiffener has a base end. The base end of the upwardly extending stiffener being connected to the laterally outboard end of the cross-member at a structural knee. The structural knee includes a first pair of first spaced apart members connected to carry a bending moment from the stiffener; a second pair of spaced apart members connected to carry that bending moment to the cross-bearer; and at least one shear member connected to both the first and second pairs of spaced apart members.

In another feature, the shear member has a substantially quadrilateral shape in profile view, the quadrilateral shape having four vertices, the first pair of spaced apart members extending along two non-adjacent sides of the quadrilateral shape, and the first pair of members extending along the other two sides of the quadrilateral shape. In still another feature the quadrilateral is a trapezoid. In a further feature the quadrilateral is a parallelogram. In a still further feature, the parallelogram is a rectangle. In a yet further feature, one of the sidewalls includes a shear web, the upwardly extending stiffener is mounted to the shear web, the upwardly extending stiffener has a flange spaced laterally outwardly from the web of the sidewall, the web of the sidewall includes a region opposed to the flange of the stiffener, and the flange and the region are co-operable to carry a bending moment to the knee. In another feature the floor includes a floor sheet, the cross member includes a web extending away from the floor sheet and a flange mounted to the web, the flange being spaced from the floor sheet, and the floor sheet having a region opposed to the flange of the cross member, the region and the flange being co-operable to transmit a bending moment, and the flange and the region being connected to the knee.

In still another aspect of the invention, there is a railroad gondola car having a gondola car body mounted on railroad car trucks for rolling motion along railroad tracks. The gondola car body includes flooring and a peripheral sidewall standing upwardly of the flooring. The sidewall has at least one opening defined therein adjacent the flooring, and a member mounted to co-operate with the opening. The member is movable between a first position obstructing the opening and a second position in which the member obstructs the opening less than in the first position.

In another feature of that aspect of the invention, the member is a gate, the first position is a closed position of the gate, and the second position is an open position. In a further feature the opening has a sill flush with the flooring. In another feature, the gondola car has one the opening at each corner thereof. In a still further feature, the member is a gate, and the gate is operable from trackside.

In a further aspect of the invention, there is a gondola car body mounted on railroad car trucks for rolling motion along railroad car tracks. The car body includes a floor structure and sidewalls standing upwardly of the floor structure. The sidewalls have predominantly upstanding stiffeners spaced therealong. The floor structure has cross members extending predominantly cross-wise thereunder. At least one of the cross members has an outboard end terminating at a longitudinal location along the car body that is free of any corresponding one of the upstanding sidewall stiffeners.

In a feature of that aspect of the invention, at least one of the predominantly upstanding stiffeners is mounted at a longitudinal location of the car body that is free of any corresponding cross member. In another feature, at least one of the cross-members is a cross-tie and the cross-tie terminates at a location along one of the sidewalls that is free of corresponding predominantly upstanding stiffeners. In a further feature, the cross-members include cross-bearers and cross-ties, and at least one of the predominantly upstanding stiffeners is located at a location that is free of any corresponding one of the cross-bearers and free of any corresponding one of the cross-ties. In still another feature, the cross members include cross-bearers and cross-ties, and in at least one location there are two cross-ties mounted in a single cross-bearer pitch.

In a still further feature, the cross members include cross-bearers and cross-ties, two of the cross-bearers having a spacing therebetween that is free of any other cross-bearer. At least one of the cross-ties is mounted in the spacing between the two cross-bearers. A first of the predominantly upwardly extending stiffeners is mounted at a location abreast of one of the two cross-bearers. A second of the predominantly upwardly extending stiffeners is mounted abreast of the other of the two cross-bearers. At least a third of the predominantly upwardly extending stiffeners is mounted at a location between the first and second predominantly upwardly extending stiffeners. There is a different number of cross-ties mounted between the two cross-bearers than there is of predominantly upwardly extending stiffeners mounted between the first and second predominantly upwardly extending stiffeners. In a further feature the car body has an overall length, and over that length there is a different number of the stiffeners than of the cross members.

In still another aspect of the invention, there is a railroad gondola car having a gondola car body mounted on railroad car trucks for rolling motion along railroad tracks. The gondola car body includes flooring and a peripheral sidewall standing upwardly of the flooring. The sidewall has a web and a predominantly upright stiffener mounted to, and outboard of, the web. The stiffener having a lower end and an upper end distant from the lower end. The web meets the floor panel at a juncture. The floor panel extends outboard of the web past the juncture under a portion of, but less than all of, the base end of the stiffener. A gusset lies under another portion of the base end of the stiffener. The gusset is joined to the floor panel under the base end of the stiffener at a second junction. The second junction lies outboard of the first junction.

In a feature of that aspect of the invention, the stiffener has a depth measured outwardly from the web of the sidewall, and the second juncture is located at least one third of the depth outboard of the first juncture. In another feature, the floor panel has a laterally outboard protruding portion, the protruding portion being underlying the base end of the stiffener, and the protruding portion has shoulder radii, the second juncture lies outboard of the shoulder radii. In still another feature, the stiffener stands upwardly of a structural knee, and the floor panel and the gusset are parts of one of a pair of moment couple transmitting members of the structural knee.

In still yet another aspect of the invention there is a railroad gondola car having a gondola car body carried by railroad car trucks for rolling motion along railroad car tracks. The gondola body includes a pair of side walls. One of the side walls has at least one predominantly upright stiffener mounted thereto, the stiffener being mounted inboard of that sidewall. In a further feature, a plurality of the predominantly upright stiffeners is mounted to the side walls and is located inboard thereof. In another feature the car body includes a floor structure and at least one cross-member supporting the floor structure, the stiffener and the cross member being connected at a structural knee. In a still further feature, the side wall includes a web mounted directly to the floor. In another further feature, the web includes a side sheet, the side sheet has a lower margin, a flat bar is mounted along the lower margin of the side sheet, the bar being of greater thickness than the sheet; and a juncture is formed between the flat bar and the floor.

In a still further aspect of the invention there is a railroad gondola car having a gondola car body carried by railroad car trucks for rolling motion along railroad car tracks. The gondola body includes a pair of side walls. The side walls have a plurality of predominantly upright stiffeners mounted thereto. The body has end portions and a mid-span portion between the end portions. There is a plurality of cross-members to which the stiffeners are connected at structural knees. The cross-members and the stiffeners having structural knee connections thereto are more densely spaced near the mid-span portion than near the end portions.

In a feature of that aspect, the mid span portion has at least two side-by-side cross-members having structural knee connections to respective ones of the side wall stiffeners. In another feature, the mid-span portion includes more than two side-by-side cross-members having structural knee connections to respective ones of the side wall stiffeners. In another feature, the car body has a mid-span width between the walls, W, a midspan gondola inside depth H, and a ratio of H:W greater than 1.0. In another feature, the car body has a mid-span inside gondola depth H, a gondola inside length L, and a ratio of H:L is in the range of greater than 1:12. In yet another further feature, the car body has a gondola inside length L, and a width between side walls W, and a ratio of L:W is in the range of greater than 10:1.

In yet another aspect of the invention, there is a railroad gondola car top chord arrangement. That arrangement has a side sheet having an upper margin, and a top chord mounted along, and inboard of, the upper margin. The arrangement including a lead-in member chosen from the set of members consisting of (a) a portion of the top chord; and (b) a part separate from the top chord. The lead-in member is positioned inboard of the side sheet and facing downwardly. The lead-in member is operable to fend objects moving upwardly adjacent the side sheet inboard, and to encourage those objects to pass by the top chord.

In a feature of that aspect, the lead-in member is a portion of the top chord, the portion is a wall of the top chord, and the wall of the top chord is angled downwardly and outboard toward the side sheet. In another feature, the lead-in member is a part separate from the top chord, the part being a fender, the fender being mounted below the top chord and extending upwardly and inwardly.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1:
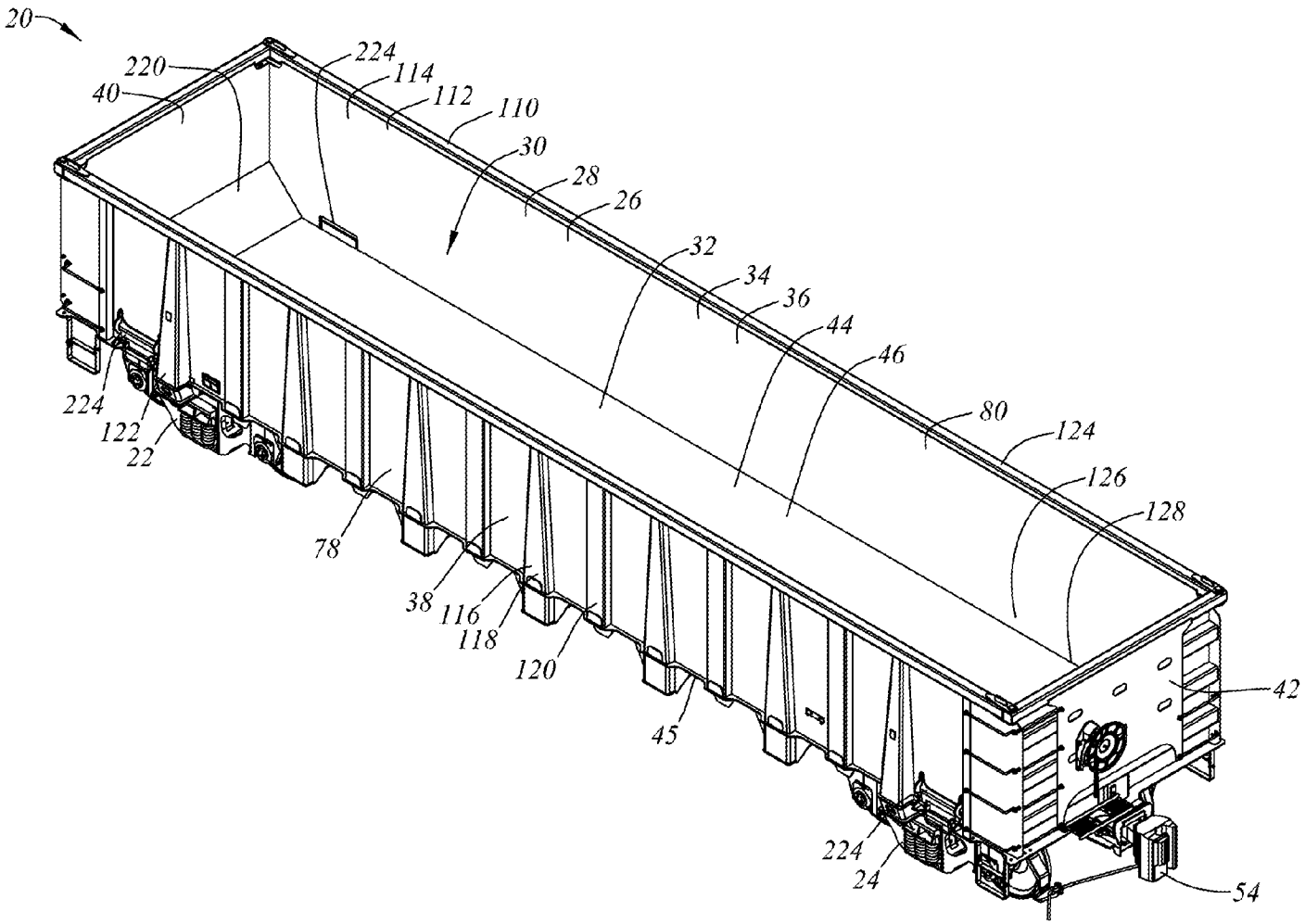
FIG. 1 is an isometric, general arrangement view of a railroad freight car, in the nature of a gondola car.
Figure 2A:
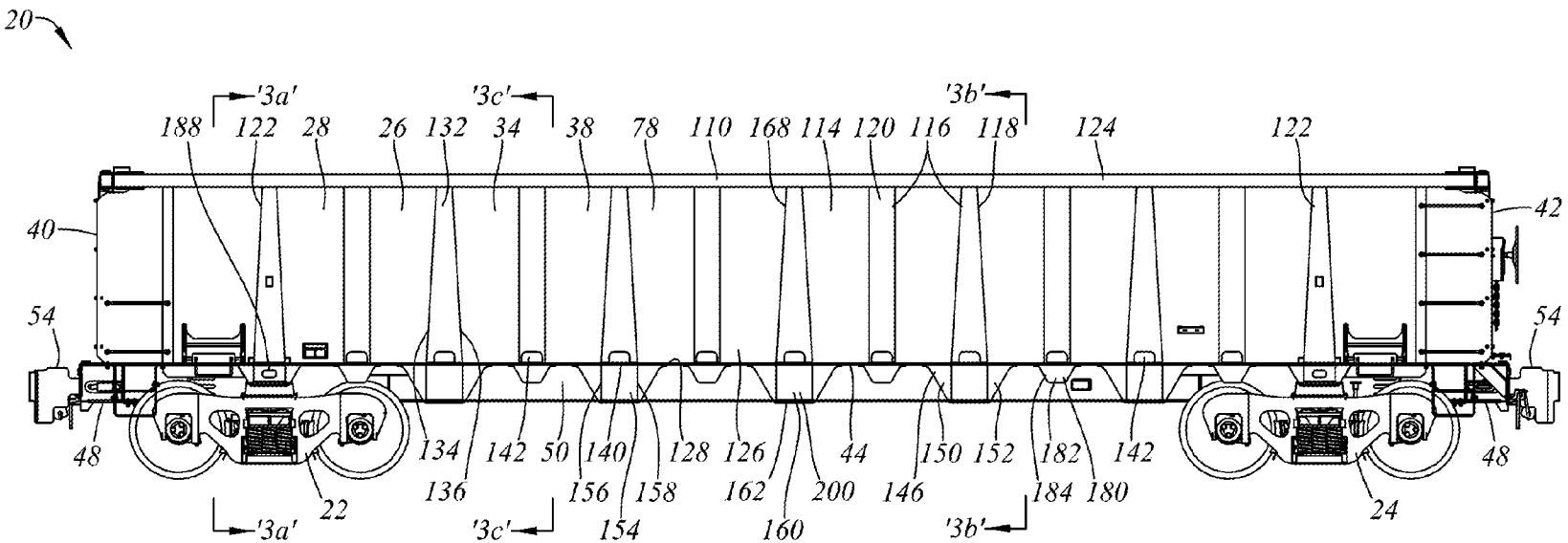
FIG. 2*a* shows a side, or elevation, view of the gondola car of FIG. 1.
Figure 2B:
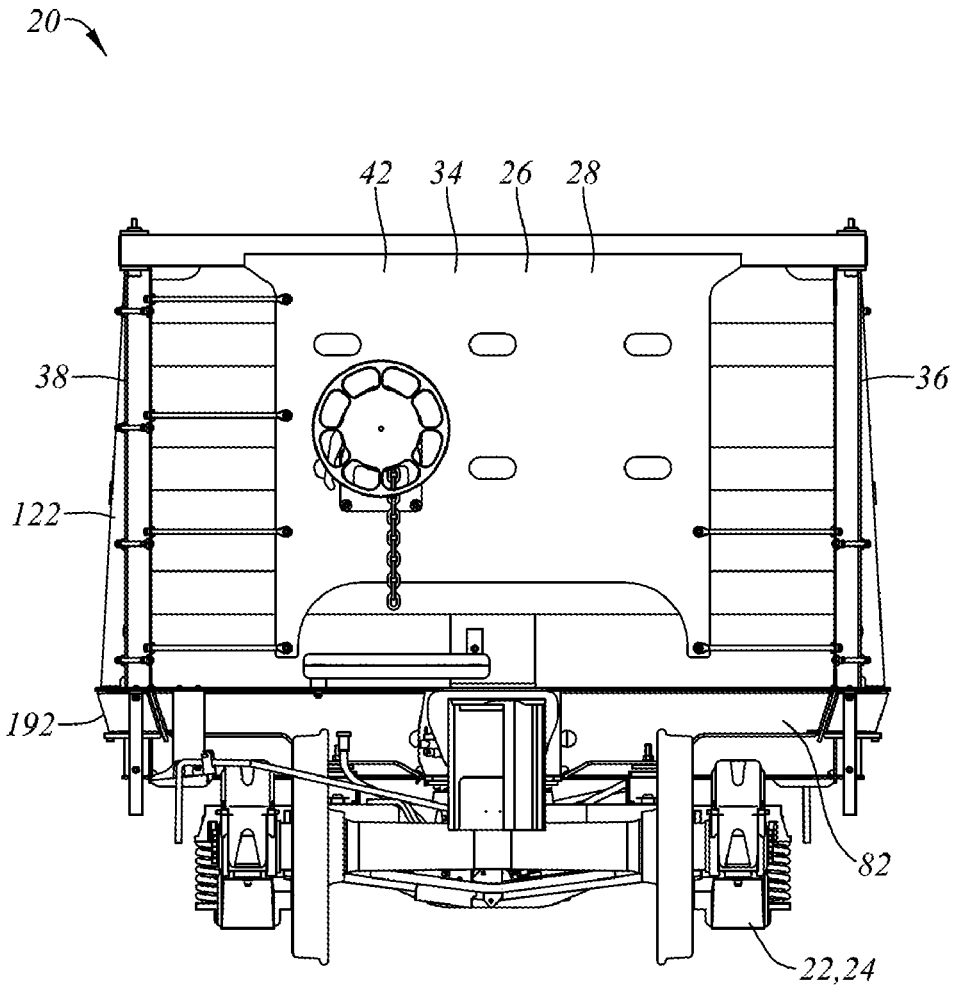
FIG. 2*b* shows an end view of the gondola car of FIG. 1.

The description that follows, and the embodiments described therein, are provided by way of illustration of an example, or examples, of particular embodiments of the principles of aspects of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for the railroad car described herein, the longitudinal direction is defined as being coincident with the rolling direction of the railroad car, or railroad car unit, when located on tangent (that is, straight) track. In the case of a railroad car having a center sill, the longitudinal direction is parallel to the center sill, and parallel to the top chords. Unless otherwise noted, vertical, or upward and downward, are terms that use top of rail, TOR, as a datum. In the context of the car as a whole, the terms lateral, or laterally outboard, or transverse, or transversely outboard refer to a distance or orientation relative to the longitudinal centerline of the railroad car, or car unit, or of the centerline of the centerplate. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts.

FIG. 1 shows an isometric view from above and to one corner of an example of a railroad car 20 that is intended to be generically representative of a wide range of railroad cars, and in particular railroad freight cars in which the present invention may be incorporated. While car 20 may be suitable for many different uses, it may in one embodiment be a gondola car, which may be used for the carriage of bulk commodities. With the exception of brake fittings, safety appliances and other secondary fittings, car 20 is substantially symmetrical about both its longitudinal and transverse, or lateral, centerline axes. Consequently, where reference is made to a first or left hand side beam, or first or left hand bolster, it will be understood that the car has first and second, left and right hand side beams, bolsters and so on.

Railroad-car 20 has a pair of first and second trucks 22, 24, and a rail car body 26 that is carried upon, and supported by, trucks 22, 24 for rolling motion along railroad tracks in the manner of railroad cars generally. Rail car body 26 may include a wall structure 28 defining a lading containment receptacle 30. Wall structure 28 may include a base wall, which may be in the nature of a floor or flooring 32, and a generally upstanding peripheral wall 34 which may include a pair of first and second side walls 36, 38, and first and second end walls 40, 42. Flooring 32, sidewalls 36, 38 and first and second end walls 40, 42 may tend to define an open topped box, namely receptacle 30, into which lading may be introduced. Generally speaking, car 20 may be of all steel, or predominantly steel construction, although in some embodiments other materials such as aluminum or engineered polymers or composites may be used for some or a predominant portion of the containment receptacle structure.

Flooring 32 may include a floor panel 44, which may be made of a plurality of floor sheets joined together, in an abutting fashion such as may yield a continuous lading containing surface, or, in one embodiment, may be made from a single, monolithic steel sheet 46. Steel sheet 46 may be a single sheet having its profile cut from a monolithic sheet of stock by a plasma arc cutting device, or cut at the steel mill. Use of a single sheet may simplify manufacture. Alternatively, floor panel 44 may not be entirely of one sheet, but may be predominantly of one sheet, such that, by area, more than half of floor panel 44 is cut from a single monolithic piece of stock. In another embodiment more than ¼ of floor panel 44 is cut from a single piece of monolithic stock. In another embodiment more than ¾ of floor panel 44 may be cut from a single monolithic piece of stock, such as rolled sheet or plate. Floor panel 44 may be between ¼ and ¾ inch thick steel plate, and may, in one embodiment be between 5/16 and ½ inches thick, and, one embodiment may be about 7/16" thick, and may provide a uniform common flange thickness above the center sill, cross-bearings, cross-ties and underneath the side beam web.

Body 26 of car 20 may include an underframe member such as a longitudinally running center sill 50. Center sill 50 may have draft sills, or draft sill portions 48 at either end, into which draft gear fittings 52 and releasable couplers 54 may be mounted. Center sill 50 may be fabricated by welding a pair of spaced apart webs 56, 58 to the underside of floor panel 44. Center sill 50 may have a bottom flange member 60, such as may be in the nature of a bottom or lower cover plate 62, welded across the bottom edges of webs 56, 58. Center sill 50 may also include internal web separators, as discussed below.

Generally speaking, a center sill may tend to have a distinct top flange, a bottom flange, and two (or more) webs extending between, and carrying vertical shear between, the top and bottom flanges. Gondola cars have tended to have had underframes that included a center sill, side sills, and cross-bearers and cross-ties extending between the center sill and side sills. Not infrequently, the cars have also had longitudinally running stringers at spaced intervals between the side sills and the center sill, carried by the cross-bearers and cross-ties. Some gondola cars had floors of wooden timbers, or planks, laid side by side over the stringers and over the center sill. In such a car, analysis of the resistance to vertical bending of the car might well have tended not to have attributed any strength to the wooden floor members.

In railroad freight car 20, center sill 50 has a distinct bottom flange 60, and vertical webs 56, 58. Center sill 50 also has a top flange, that top flange being a central region 64 of floor panel 44 that is influenced by the presence of webs 56, 58. That region of influence may extend between webs 56, 58 and a distance laterally outboard from each of them to yield an "effective width". That effective width may be equivalent to roughly 40 to 60 times the thickness of panel 44 plus the distance between the webs. The effective width distance may sometimes be estimated as being about 44-48 times the thickness. In one embodiment, panel 44 may be abnormally thick for a floor sheet. That is, floor panel 44 may be more than 5/16 inches thick, and may be more than ⅜ inches thick. In one embodiment floor panel 44 may be about 7/16 inches thick, such that the effective width of top flange region 64 may extend roughly 8-12 inches (e.g., about 10½ inches) outboard of webs 56, 58. Inasmuch as webs 56, 58 are welded directly to the underside of floor panel 44, there is a direct path for shear flow to pass between them, in contrast to arrangements in which the center sill has a top flange, and the floor sheets are then mounted above, and in addition to, that top flange such that shear flow from the webs cannot pass directly into the floor sheet but most flow via the intermediate medium of the center sill top flange. By contrast, in one embodiment of car 20, in vertical bending a predominant portion of the shear flow from webs 56, 58, (indeed, all of it), flows directly to and from floor panel 44 across the weld interface between the upper marginal edges of webs 56, 58 and the underside of floor panel 44. In this embodiment there is no other flange or cap plate, or doubler plate exchanging shear flow with webs 56, 58.

Railroad car 20 may also include an array 70 of cross-bearers 72 and may include an array 74 of cross-ties 76. Car 20 may include longitudinally extending first and second side beams 78, 80. Those side beams may define part or all of side walls 36, 38, and may be the dominant structural assemblies of car 20 in terms of resistance to vertical bending and may be aided in that resistance by the co-operative adjoining effective flange width region of the floor panel. Each cross-bearer 72 extends between center sill 50 and a respective one of side beams 78 or 80. Each cross-bearer has a moment connection at both ends (i.e., at center sill 50, and at the side beam, be it 78 or 80. Cross-ties 76 alternate with cross-bearers 72. Each cross-tie 76 extends between center sill 50 and one or other of side beams 78, 80. The junctions of the cross-ties with the center sill and the side beams may, conservatively, be analyzed as pin-jointed connections. That is, analytical reliance on the junction approximating the performance of a built in connection may not be assumed. Expressed somewhat differently, the ability of the connection at the junction cross-tie and the sidewall stiffener to carry a moment may be smaller than, if not much smaller than, the ability of the junction between a cross-bearer and the corresponding sidewall stiffener to carry a moment. The difference may be greater than an order of magnitude, such that, for the purposes of this description the cross-tie junction may be considered not to pass, and not to be relied upon to pass, a moment from the side beam stiffener to the cross-tie. Car 20 may also have main bolsters 82 that extend laterally from center sill 50 to side beams 78, 80, at the locations of the truck centers (CL Truck).

Figure 4A:
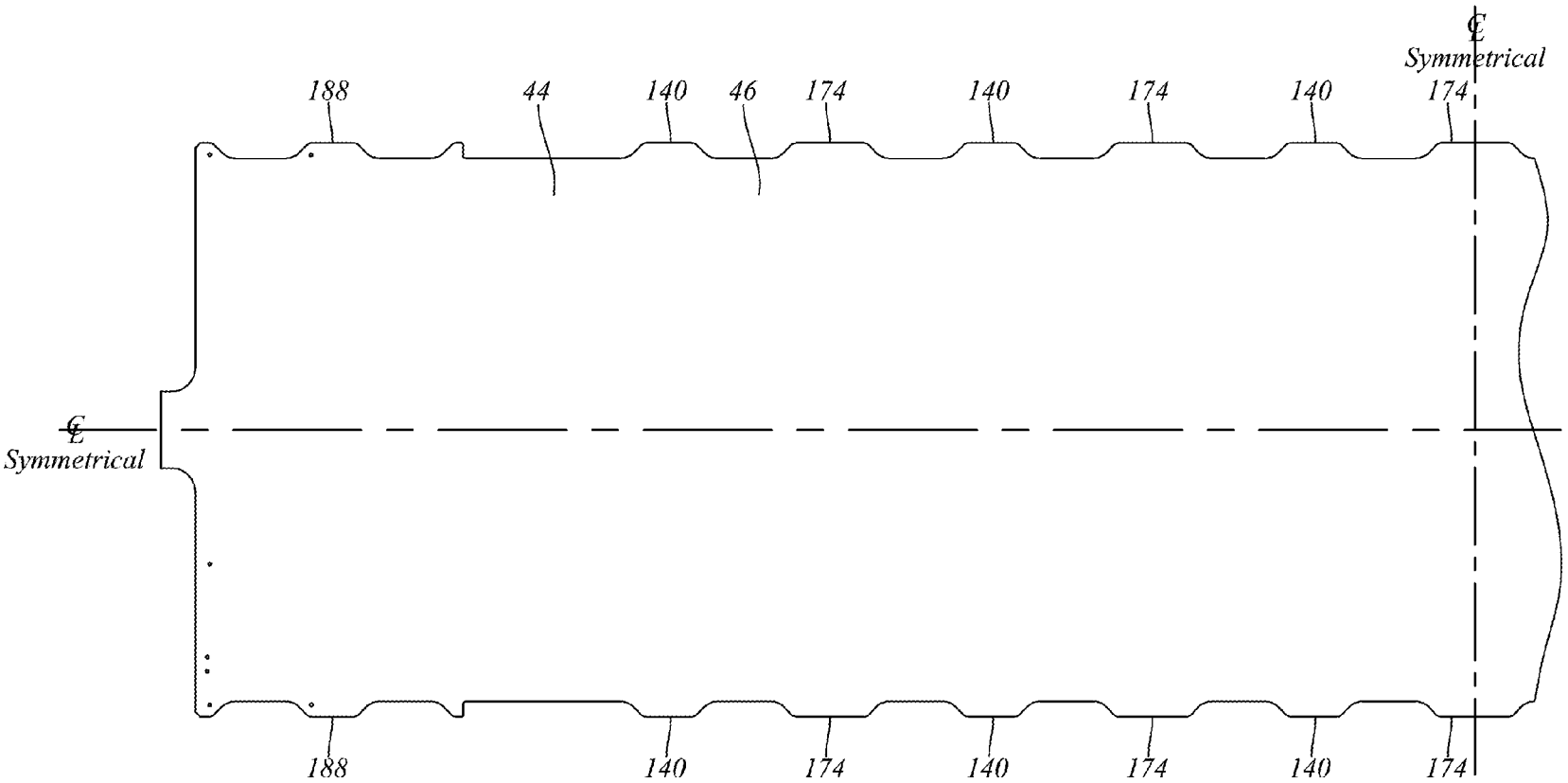
FIG. 4*a* is a plan view of a floor sheet of the gondola car of FIG. 1.
Figure 4B:
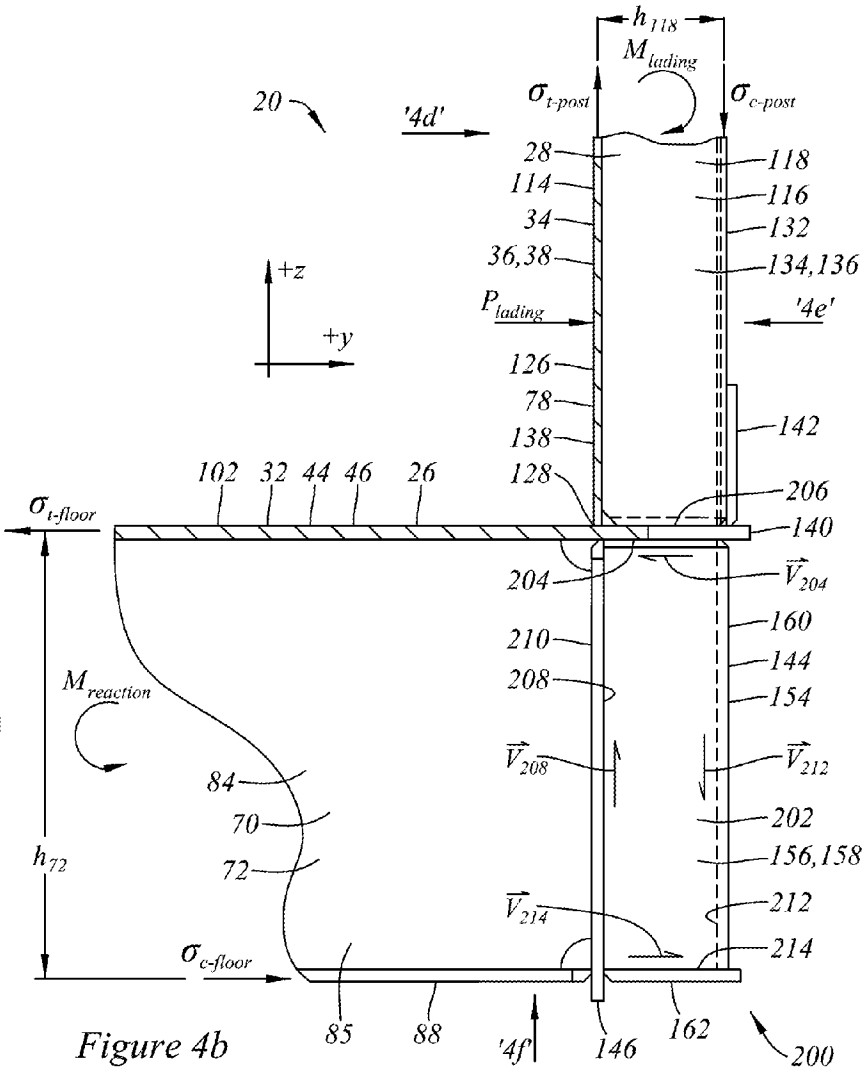
FIG. 4*b* is an enlarged detail of a cross-section of a cross-bearer to side post knee of the gondola car of FIG. 3*b;*
Figure 4C:
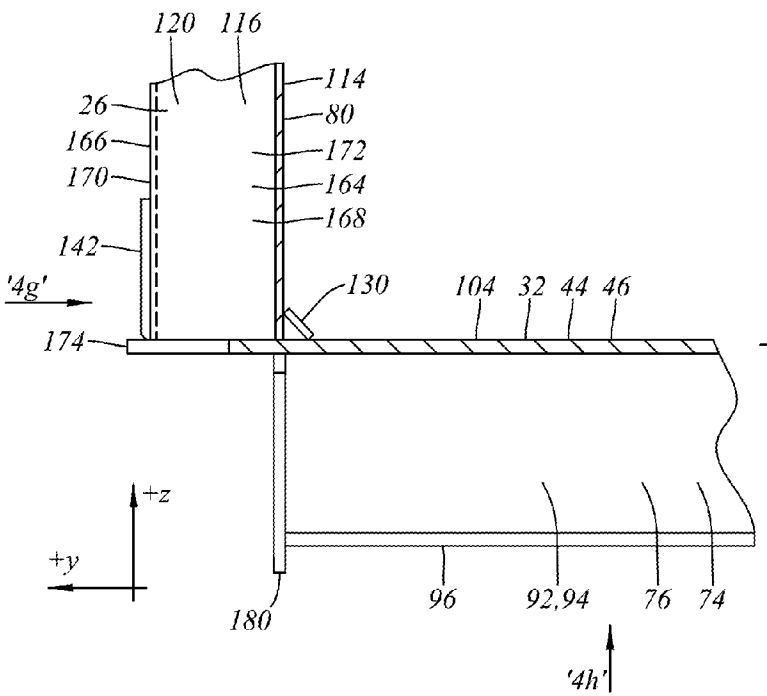
FIG. 4*c* is an enlarged detail facing toward a cross-tie to side post junction of the gondola car of FIG. 3*c;*
Figure 4D:
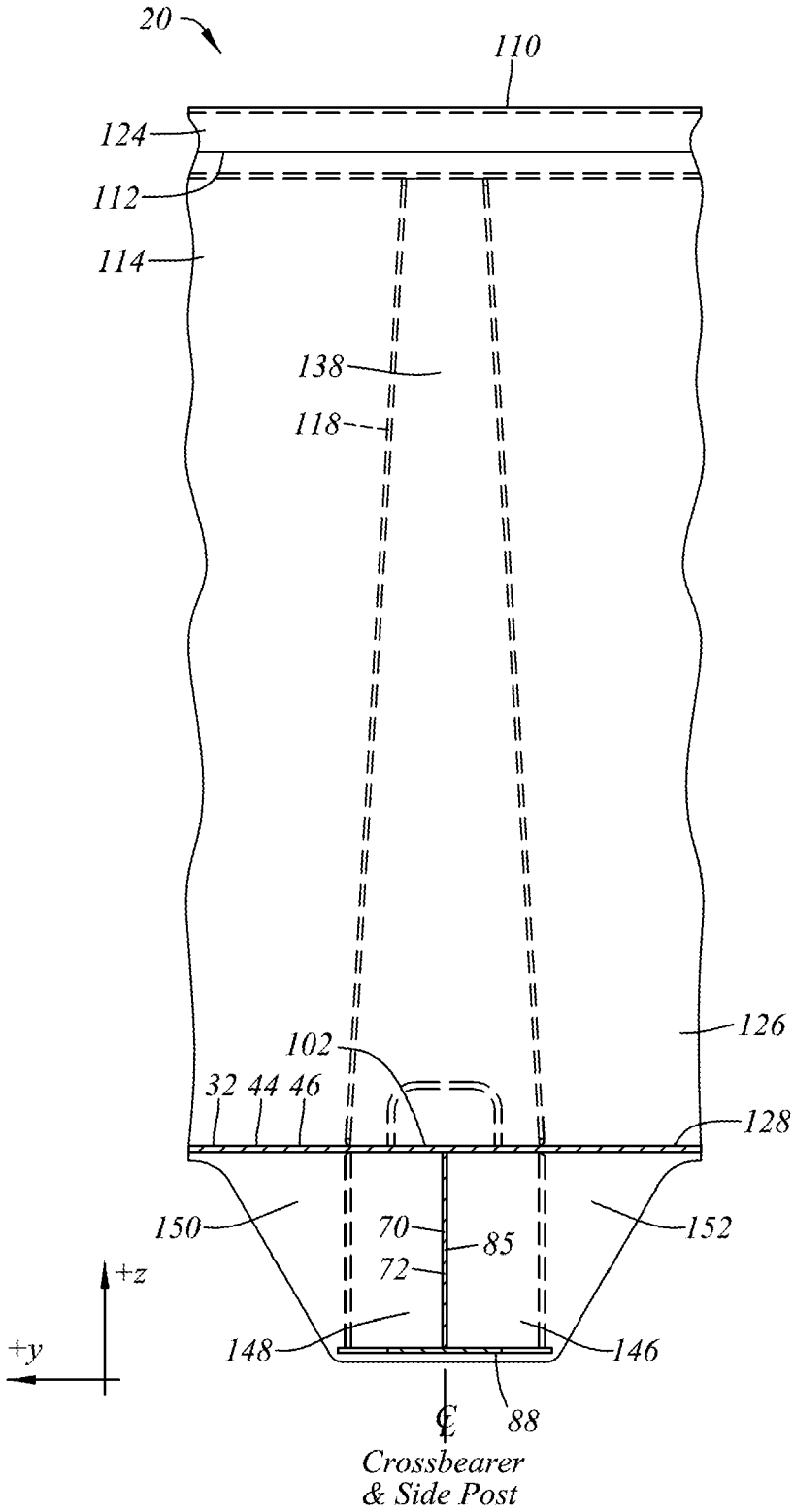
FIG. 4*d* is a view looking outboard on arrow 4*d* of FIG. 4*b* from inside the gondola.
Figure 4E:
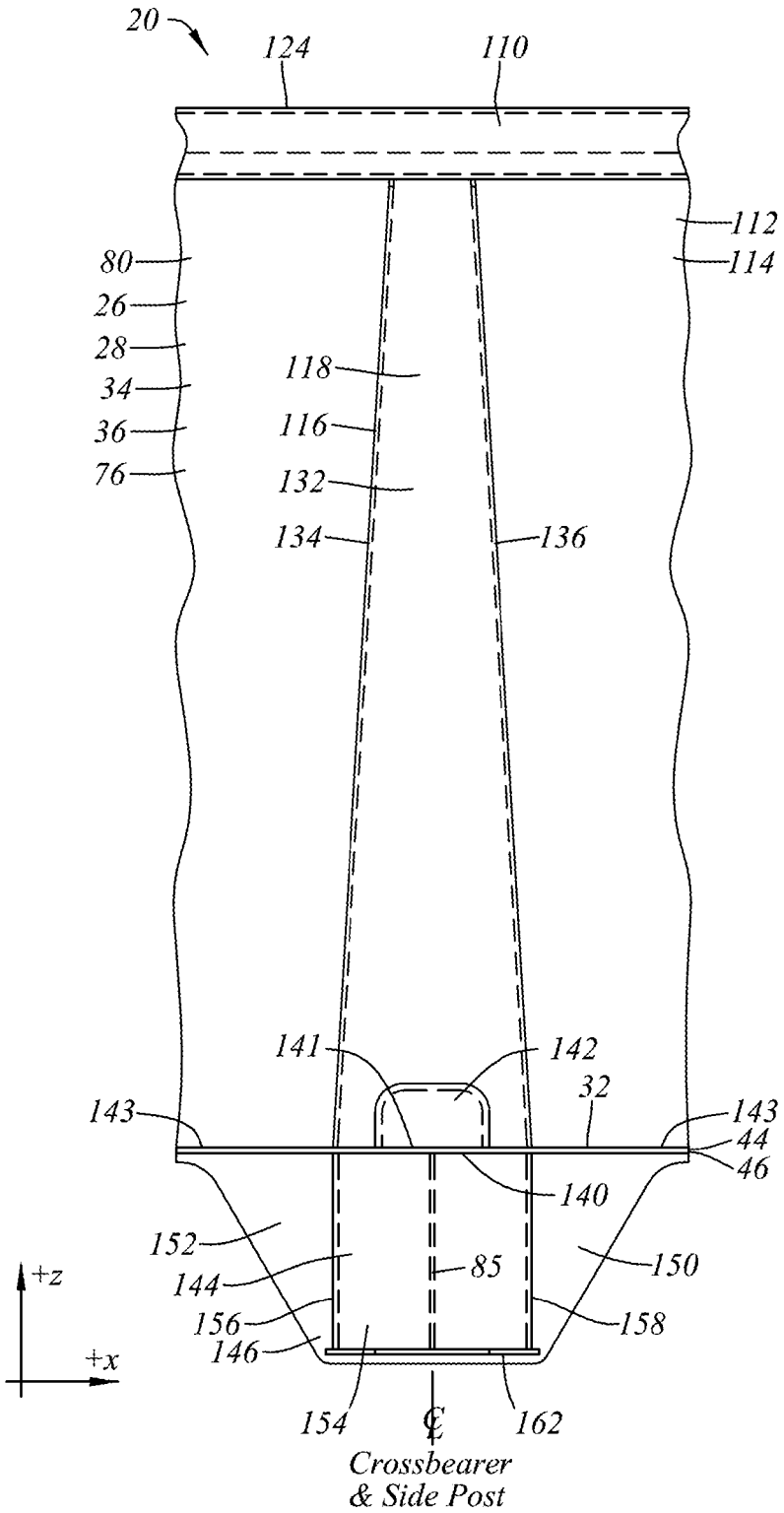
FIG. 4*e* is a view looking inboard on arrow 4*e* of FIG. 4*b* from outside the gondola.
Figure 4F:
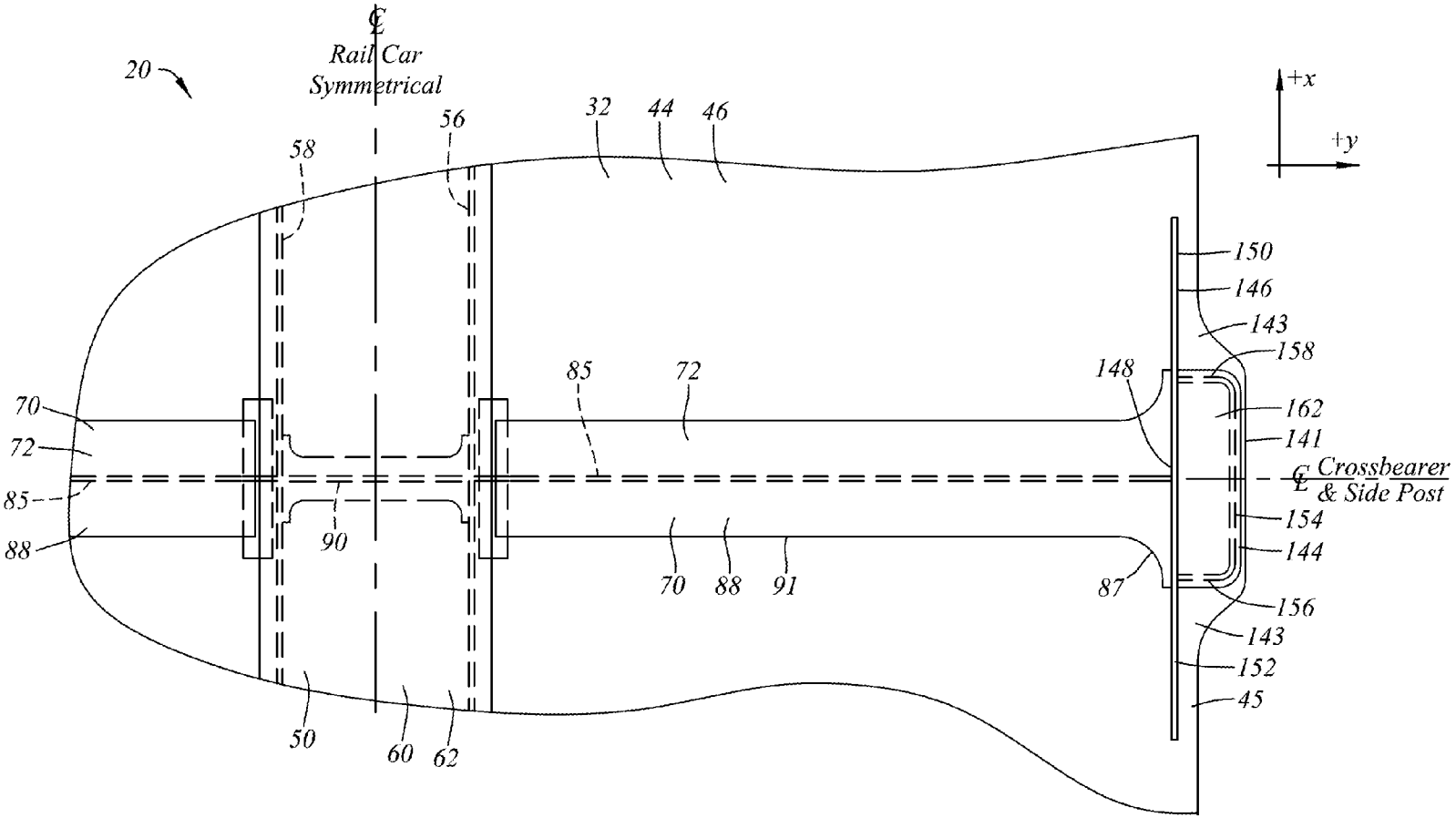
FIG. 4*f* is a scab view looking upward on arrow 4*f* of FIG. 4*b;*
Figure 4G:
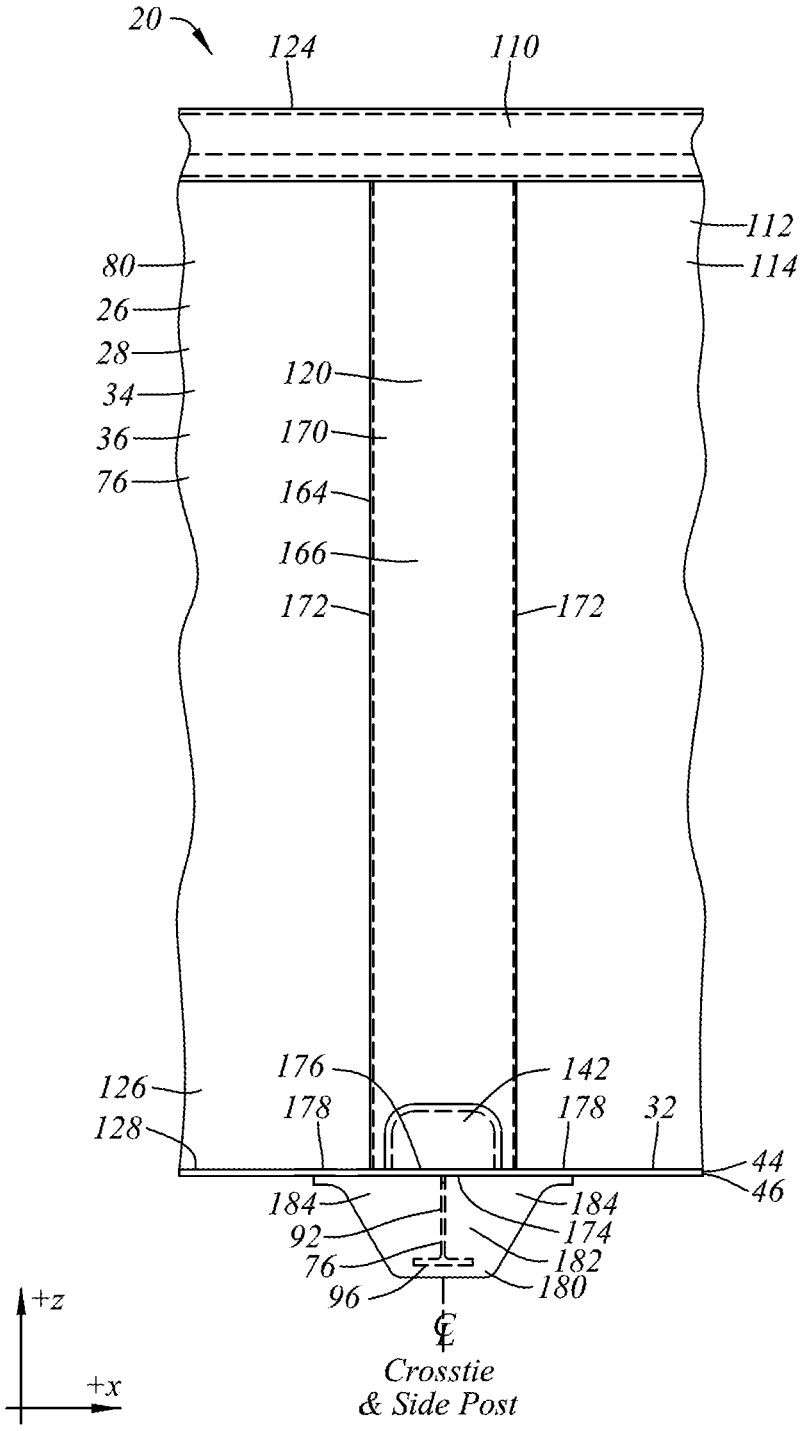
FIG. 4*g* is a view looking inboard on arrow 4*g* of FIG. 4*c;*
Figure 4H:
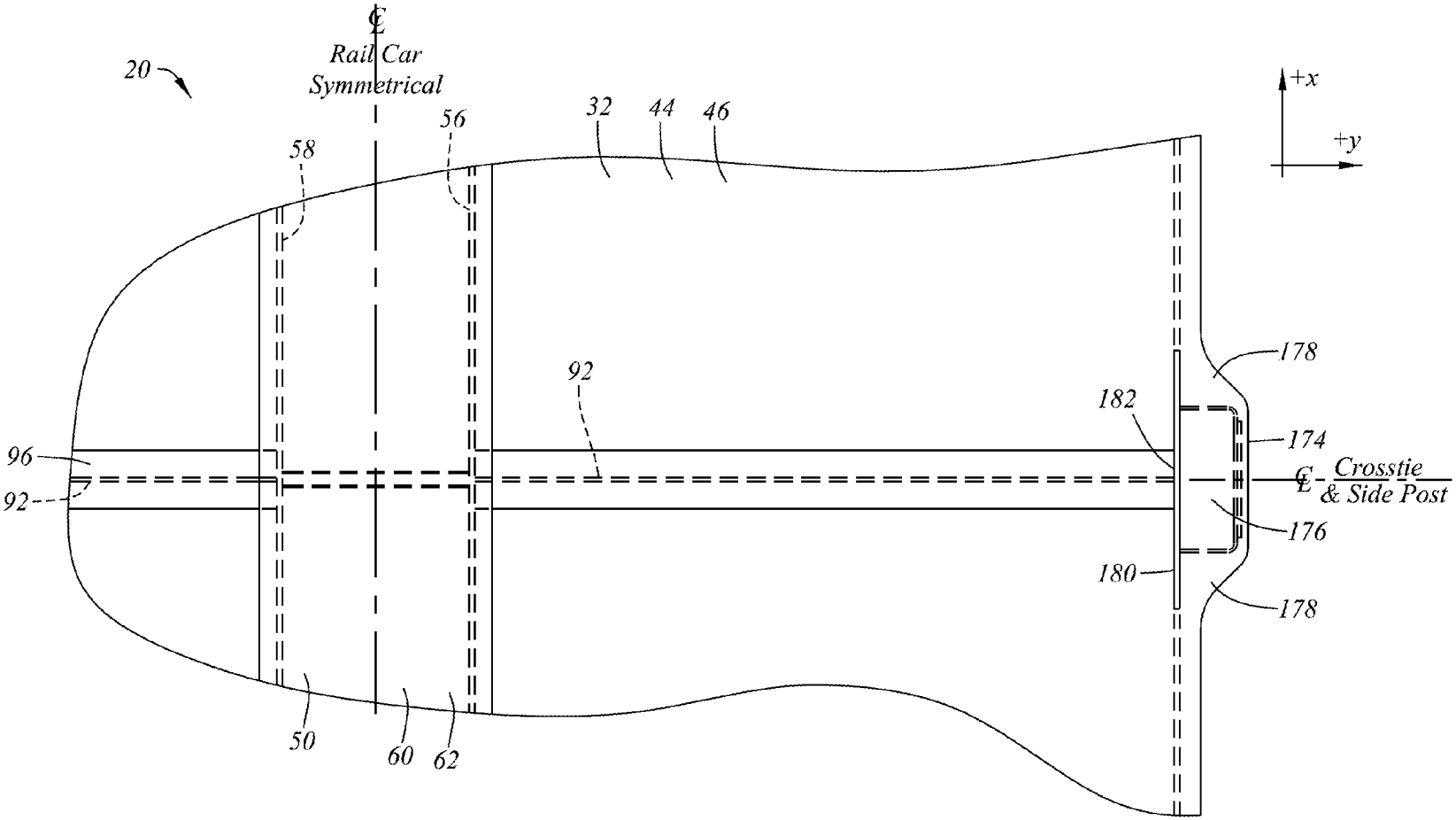
FIG. 4*h* is a view looking upward on arrow 4*h* of FIG. 4*c;*
Figure 5A:
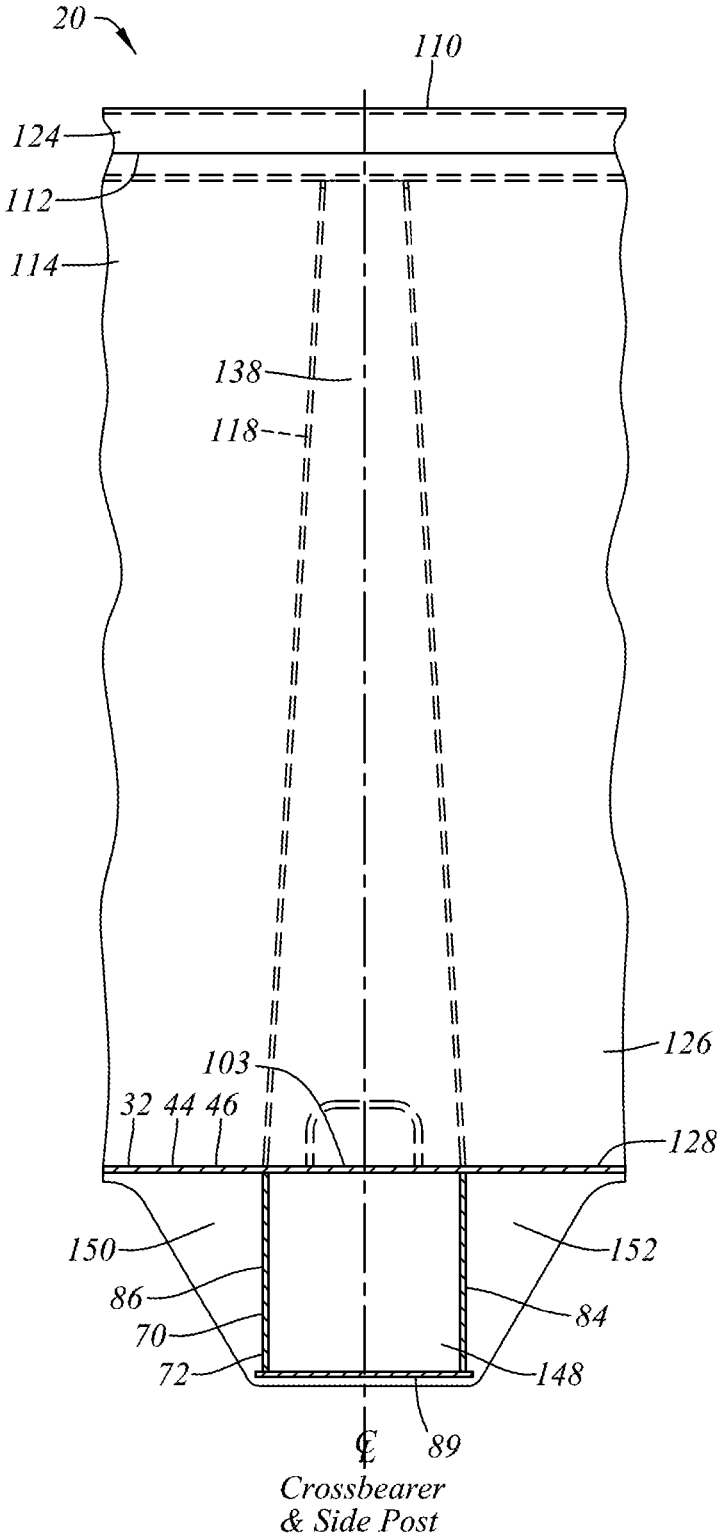
FIG. 5*a* is a view corresponding to the view of FIG. 4*d*, or an alternate embodiment of side post to cross-bearer connection.
Figure 5B:
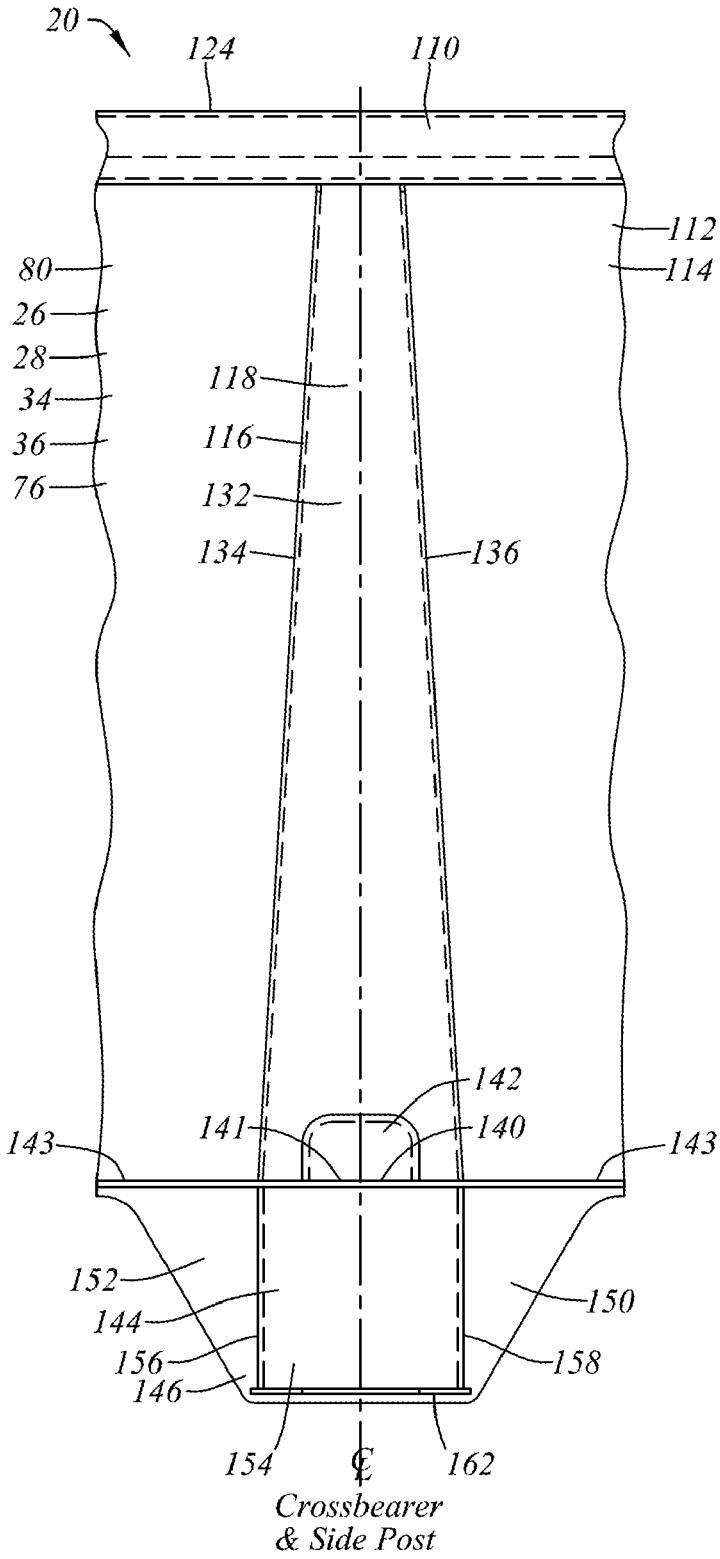
FIG. 5*b* corresponds to the view of FIG. 4*e* of the alternate embodiment of FIG. 5*a;*
Figure 5C:
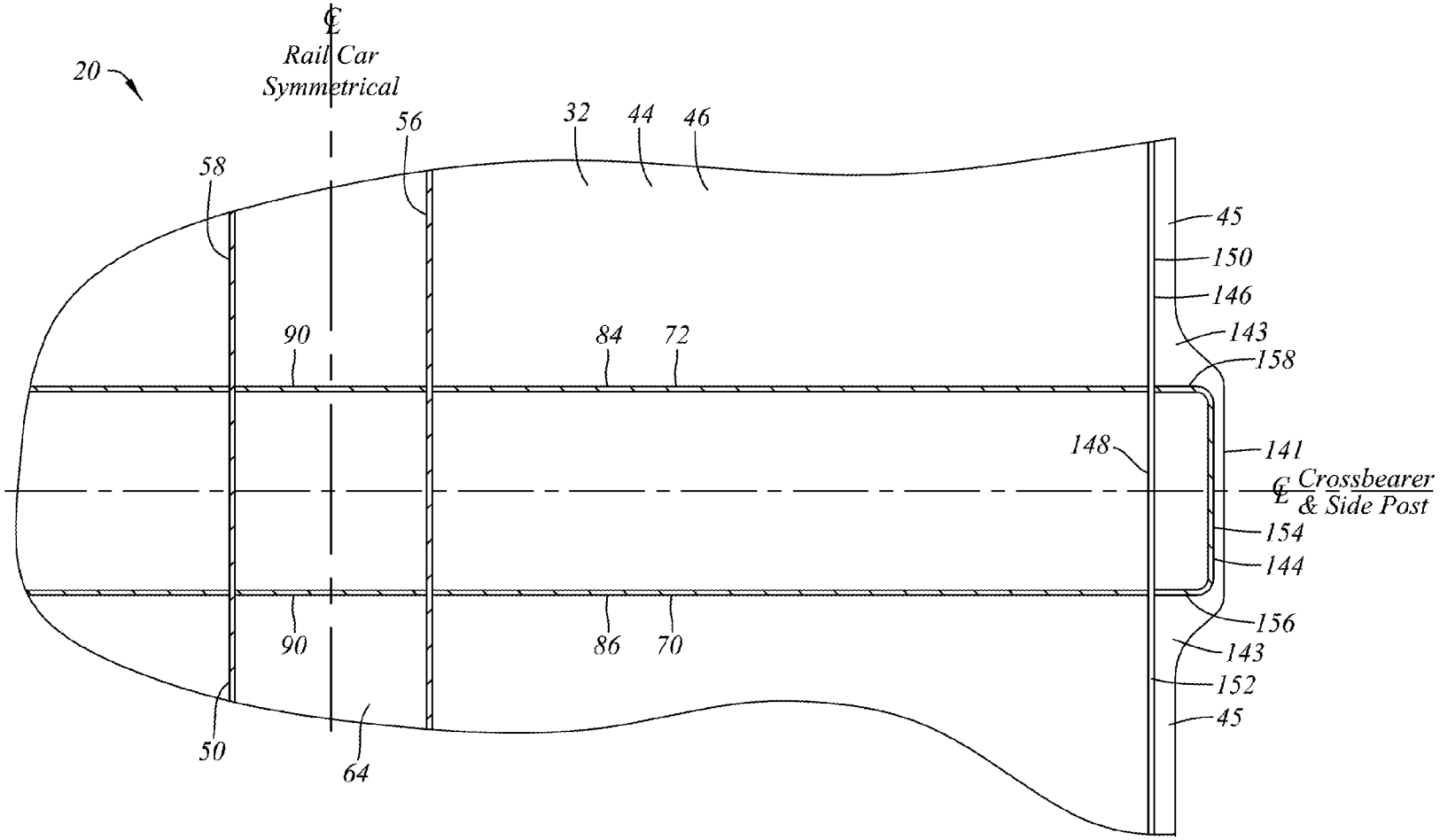
FIG. 5*c* is a view corresponding to that of FIG. 4*f* of the alternate embodiment of FIG. 5*a*, but is taken through a mid-level section of the cross-bearer webs looking upward toward the floor panel of the gondola car.
Figure 5D:
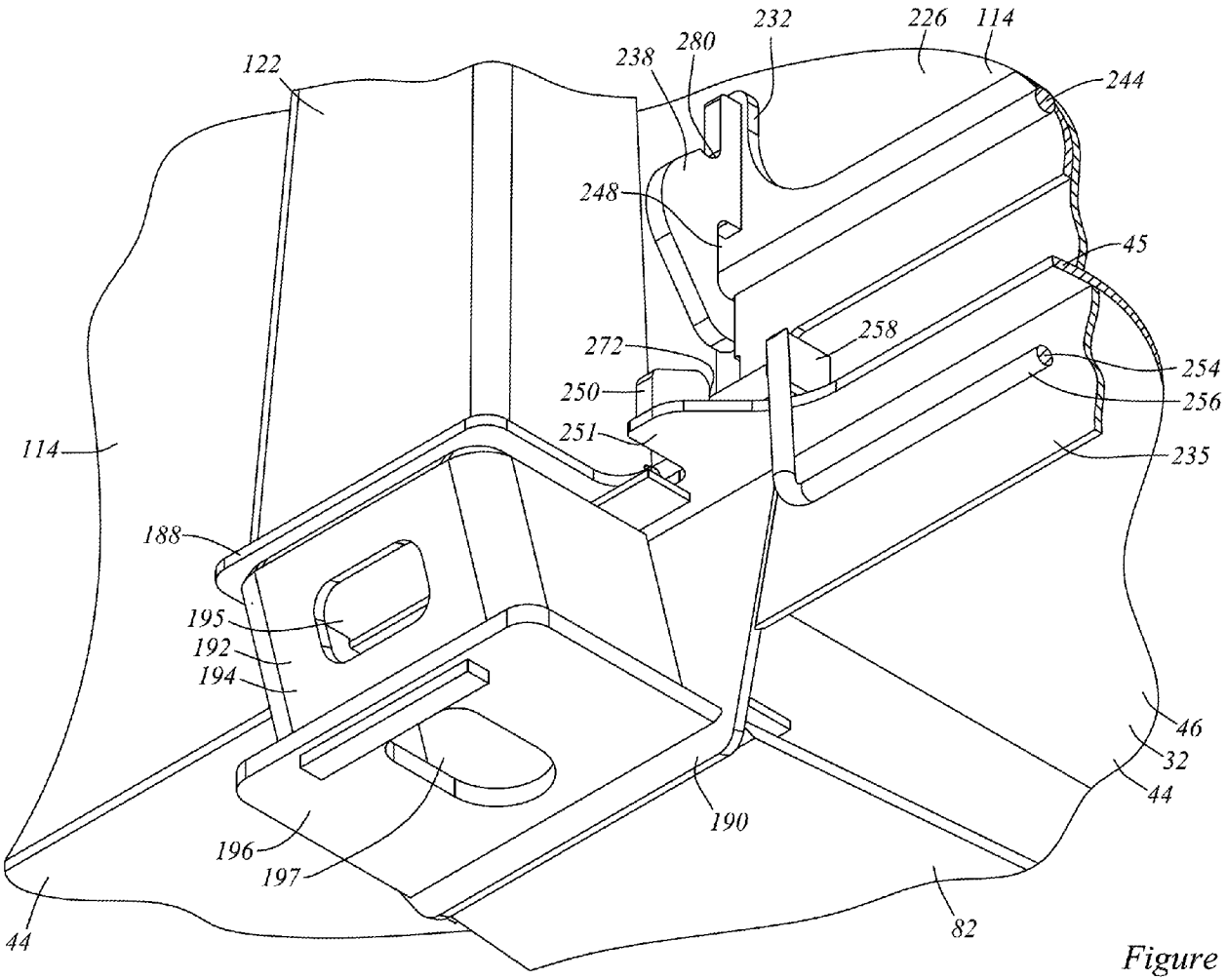
FIG. 5*d* is an isometric detail of a main bolster end connection of the railroad car of FIG. 1.

In the embodiment of FIGS. 4*d*, 4*e* and 4*f*, each cross-bearer 72 may include a web 85, and a bottom flange member 88. Bottom flange member 88 may include a flared or broadened laterally outboard end portion 87, and a narrower more laterally inboard portion 91 extending to mate with center sill bottom flange cover plate 62 in flange continuity. Alternatively, as shown in the embodiment of FIGS. 5*a*, 5*b*, and 5*c*, each cross-bearer 72 may include a pair of first and second, spaced apart upstanding webs 84, 86, and may include a bottom flange member 89. In either case, web 85, or webs 84 and 86 may abut floor panel 44 directly, and be connected directly thereto by such means as welding. That is, in one embodiment, cross-bearer 72 does not have a distinct top or upper flange apart from floor panel 44. Put differently, there is a direct shear flow connection between the upper margins of webs 85, 84, 86 (as may be) that is exchanged directly with floor panel 44, rather than, for example, passing into or through an intermediate member. Center sill 50 may have web separators 90 that may be located in line with (i.e., are substantially co-planar with) webs 85, 84 and 86 (as may be) of the respective cross-bearers 72 such that there is web continuity between left and right hand cross-bearer pairs across center sill 50. Inasmuch as webs 56 and 58, and cover plate 62 of center sill 50 may be pre-fabricated and pre-assembled before being mated to floor panel 44, web separators 90 may terminate shy of the upper margins of webs 56, 58, and may terminate with a T-shaped head, the cross-bar of the T lying parallel to, but marginally spaced from, floor panel 44.

Each cross-tie 76 may have a single web 92, or more than one web 92. Each web 92 extends downwardly from floor panel 44. A bottom flange 96 is welded across, and along, the bottom margins of the web, or webs 92 as may be. As with cross-bearers 72, the web or webs 92 of cross-ties 76 may abut floor panel 44 directly, without the intervention, or addition, of a top flange or cover plate, other than floor panel 44. As such, any shear flow may tend to flow directly from one to the other.

Figure 3A:
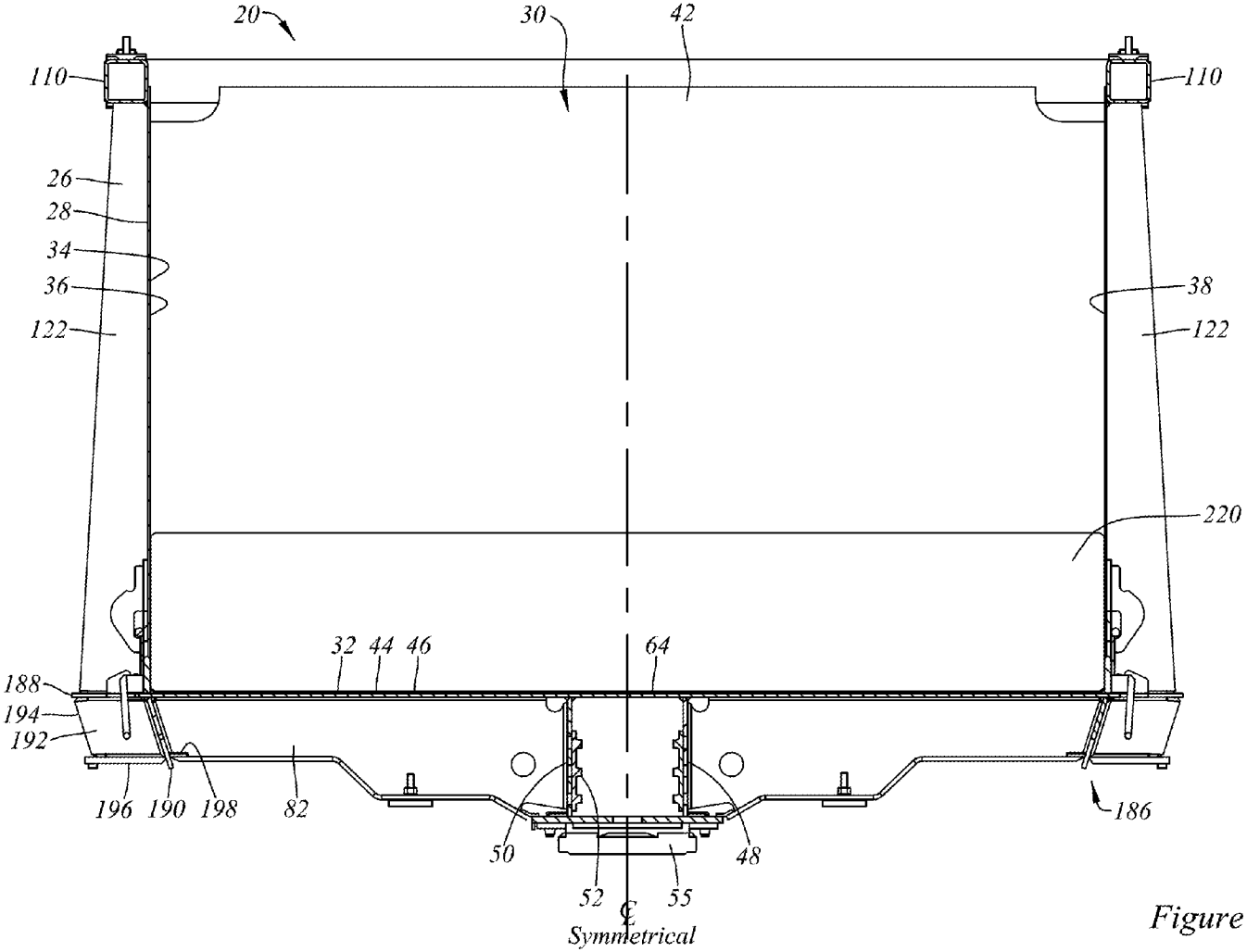
FIG. 3*a* is cross-sectional view, in elevation, on section '3*a*-3*a*' of the gondola car of FIG. 1 looking toward the main bolster with the truck removed.
Figures 3B, 3C:
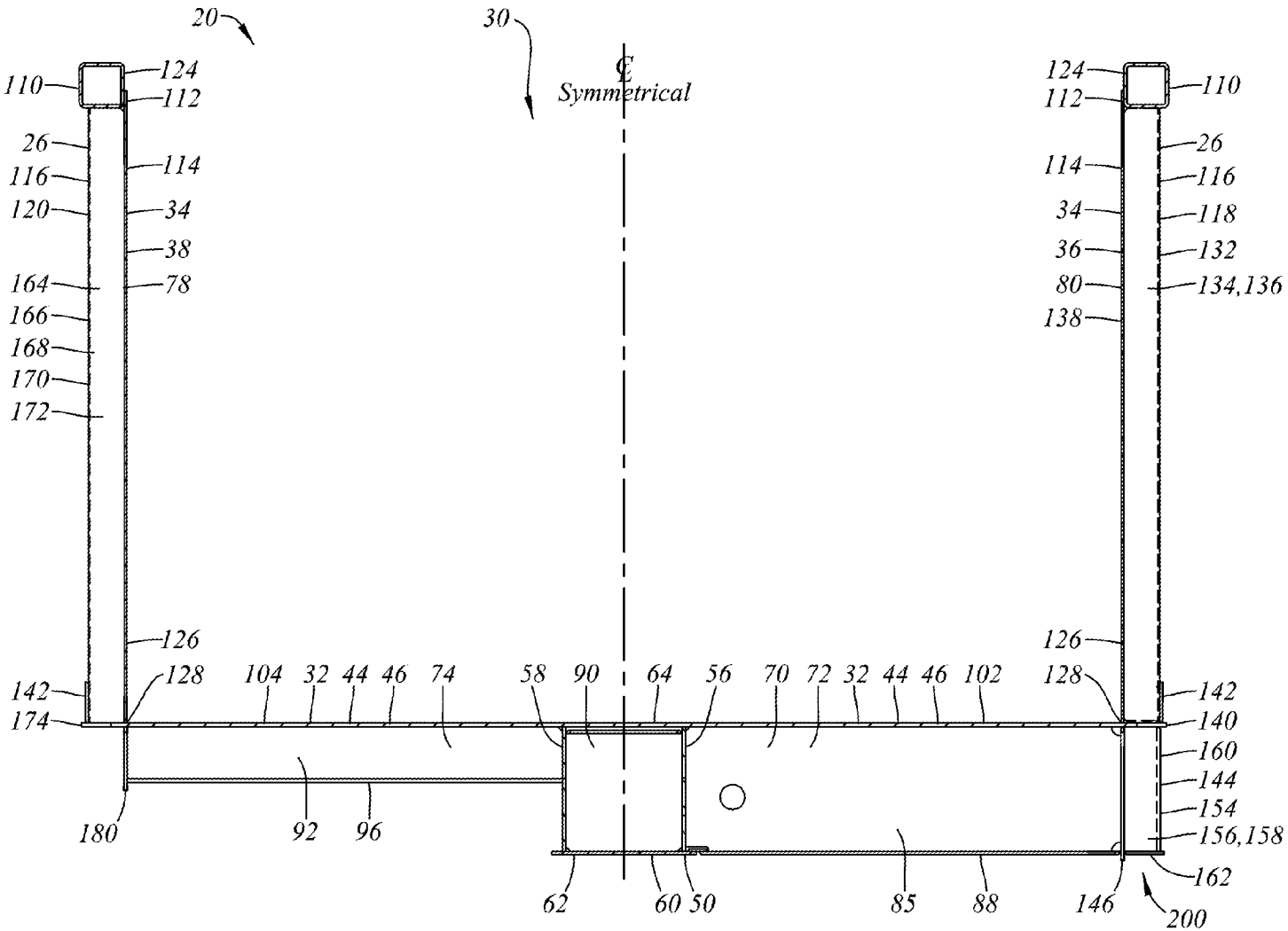
FIG. 3*b* is a right hand half cross-sectional view, in elevation, on section '3*b*-3*b*' of the gondola car of FIG. 2*a* looking toward a cross-bearer.
FIG. 3*c* is a left hand half cross-sectional view, in elevation, on section '3*c*-3*c*' of the gondola car of FIG. 2*a* looking toward a cross-tie.

As shown in FIGS. 3*b* and 3*c* floor panel 44 may tend to define the upper flanges of both cross-bearers 72 and cross-ties 76. As discussed above in the context of the top flange of center sill 44, the effective cross-bearer upper flange region 102 of cross-bearer 72 and upper flange region 104 of cross-tie 76 may have an effective width of the order of 40-60 times the thickness of the floor panel sheet, and may for convenience sometimes be taken as being 44-48 times that thickness where there is a single web, and that much plus the web spacing where there are two webs.

As shown in FIG. 3*a*, floor panel 44 may also overlie main bolsters 82. Each main bolster 82 may have an upper flange, web, and lower flange, side bearing fittings and so on. The main bolster meets center sill 50 at the truck centers. A center plate 55 may be mounted to center sill 50 at this junction.

Side Beam Construction

Side beams 78 and 80 are substantially identical in structure. Hence a description of side beam 80 may also be taken as a description of side beam 78. Side beam 80 may include a top chord member 110, and may have a generally upstanding web 114. Web 114 may have an inbound face or inwardly facing surface oriented toward receptacle 30, and an outbound face, or outwardly facing surface oriented away from receptacle 30. An array of vertical stiffeners 116 may be mounted to web 114 at longitudinally spaced locations along side beam 80. Vertical stiffeners 116 may be mounted outbound of web 114. Vertical stiffeners 116 may include a first array, or sub array, of stiffeners 118 mounted at locations for structural co-operation with (and typically abreast of) the cross-bearers, and another array, or sub-array, of stiffeners 120 for structural co-operation with (and typically abreast of) the cross-ties 76. There may also be vertical stiffeners 122 abreast of, and for co-operation with, the main bolsters 82.

Top chord member 110 may tend to function as the top flange of the side beam 80 (or 78, as may be), and may have a formed cross-section. The cross-section may be that of a structural angle, or it may be that of an I-beam or wide flange beam, or it may be a specialty formed section, such as a bulb angle, or it may be a channel, or it may be a closed hollow section, such as a rectangular or square steel tube 124. Top chord member 110 may include one or more doublers along part or all of the upper portions thereof, such as a central, or mid-span portion corresponding to the location of greatest bending moment due to vertical lading loads in the gondola.

In one embodiment, web 114 may be a monolithic steel sheet cut from a single piece of stock and which may run substantially the entire length of car 20 from truck center to truck center or from end bulkhead to end bulkhead. That monolithic steel sheet may have an upper margin 112 mated with top chord member 110, typically at a welded lap joint; and a lower margin 128 mated directly with the decking of the car, namely floor panel 44. The junction at floor panel 44 may be such that floor panel 44 extends somewhat beyond web 114 in the laterally outboard direction by some marginal distance. That is to say, the lower margin of web 114 may abut the floor panel 44. This abutment may occur at a T-joint in which floor panel 44 has a laterally outboard margin 45 that may extend laterally proud of web 114, or of the junction of web 114 with floor panel 44. This laterally outboard margin 45 may run substantially continuously along the length of car 20 and may vary in width. In one embodiment the minimum width of margin 45 beyond web 114 may be at least as great as the thickness of floor panel 44 and may, in one embodiment, be at least twice as great as the floor thickness, or may be 1½ inches or more. That marginal distance may be more than ½ inch, and may be in the range of ½ to 4 inches. In another embodiment that distance may be 1 to 20 times the thickness of floor panel 44, and in another embodiment 3 to 10 times the thickness of floor panel 44, and in another embodiment may be about 5 times the thickness of floor panel 44. In one embodiment, that marginal overlap may exist all along the junction, between any two adjacent web stiffeners, be they stiffeners 118 or 120. Expressed differently, web 114, or a major portion of web 114, may lie in a plane, or on a two dimensional surface (such as a continuous cylindrical surface). That plane or surface may intersect the plane of floor panel 44 along a line of intersection. The laterally outboard edge of floor panel 44 may lie at least as far outboard as the line of intersection, and may extend further outboard to define margin 45.

Web 114 may not necessarily be a monolithic member, but could be made of two or more pieces joined together side-by-side, as by welding. Alternatively, web 114 might be connected to supporting members or to longitudinal stiffeners by mechanical fasteners such as Huck™ bolts. In any case, web 114 may be substantially planar, or may have a major portion thereof lying in a plane. That plane may be a vertical-longitudinal plane (i.e., an x-z plane) or may be an inclined plane, or an arcuate curve ascending from the decking toward the top chord. The lower portion of web 114 may be indicated as 126, and may include lower margin 128. Whether web 114 is monolithic or not, it may be that lower portion 126 of web 114 immediately next to, and adjoining floor panel 44 may be monolithic (i.e., formed from a single sheet of stock without intermediate joints). A monolithic piece may run substantially the full length of floor panel 44. Portion 126 may be of substantial width, such as to extend from floor panel 44 a substantial distance up stiffeners 116 toward top chord member 110. That width, which may be as little as about 3 inches, may be greater than 18 inches, and may be as great or greater than ⅕ of the total width of web 114 from floor panel 44 to top chord member 110.

Lower margin 128 may be formed to abut floor panel 44, and may be joined directly thereto as by welding, such as by fillet welds running both on the inboard and outboard fillets, along the joint from one end of the gondola receptacle to the other. Such welds may be made with automatic welding machines. In this embodiment, the shear flow associated with the vertical lading in the receptacle may pass directly from the lower margin of web 114 to the adjoining floor panel 44. As discussed elsewhere, floor panel 44 may be of abnormally great thickness. A region of floor panel 44 running alongside lower margin 128 may be influenced by web 114, and may tend to act as a bottom flange on side beam 80 (or 78 as may be). The effective width of that bottom flange region may be in the range of 20 to 30 times the thickness of the floor panel plate to the inside, and the width of margin 45 to the outside, and, in one embodiment may be about 22-24 times the plate thickness to the inside. In such an embodiment, the railroad car is free of any separate and distinct longitudinally running member, such as a dedicated side sill, and the lower flange function of side sill may be performed by the co-operative interaction of web 114 and floor panel 44. In an alternate or optional feature shown in FIG. 4*c*, the connection between lower margin 128 of web 114 may be overlain by a longitudinally running protective shroud member 130, which may be a chamfered flat bar lying at an angle such as might run a portion or substantially all of the length of the side beam. Shroud member 130 may be joined to floor panel 44 and web 114 by welding, and may serve to protect the welded joint between web 114 and floor panel 44. In operation, the shear flow through shroud member 130 may tend to be smaller than that flowing directly through the joint of floor panel 44 to web 114. Similarly, the cross-sectional area of shroud member 130 may be smaller, if not much smaller, than the effective cross-sectional area of the floor panel (that area being in the range of 40-60 times the thickness multiplied by the thickness, or, in one embodiment, about 44-48 times the square of the thickness). In either case, the dominant structural member is the effective horizontal flange defined by the floor sheet, floor panel 44, and the predominant portion of the shear flow may be carried directly between the shear web 114 and floor panel 44 without an intervening intermediate member such as a dedicated side sill. In one embodiment, this predominance may be greater than ⅔ of total shear flow, in another it may be more than 80% of total shear flow at the bottom margin of the web. In an embodiment where there is no shroud member, it may be substantially 100%.

It may be that web member 114 is a continuous sheet. It may also be that in some embodiments the greater portion of web 114 may be relatively thin, being perhaps less than 3/16 inches thick, and on some embodiments ⅛ inch thick or less. In one embodiment the web thickness may be about 1/10 inch. It may be a challenge to form a continuous weld to floor panel 44 along the lower margin of such a web. It may also be that such a weld may be susceptible to rough treatment. It may also be a challenge to maintain a span tolerance on the web in the upward direction between the top chord and the floor. To the extent that any of these things may be so, it may be desirable to thicken the bottom margin of web 114. In one embodiment, this may be done by mounting a doubler, or base margin plate, along the bottom edge of the web, either on the inside, or on the outside. The doubler or base margin plate may have a depending margin that is not overlapped by the main portion of the web, and the doubler or base margin plate itself may be thicker than the main portion of the web, and may have a thickness comparable to (i.e., within +/−40% of) the thickness of floor sheet 44. The base margin plate may have a depending edge extending lower than the lower margin of the thinner main web sheet. The two parts may be joined at a lap joint. The lower edge of the base margin plate may be beveled on one or both sides, and may be joined to floor plate 44 at a full penetration weld, which may be formed by an automatic welding machine. Examples of reinforced or thickened bottom margin assemblies are shown in FIGS. 8*d*, 8*e*, 8*l* and 8*m*, and described below.

Each of the predominantly vertically upstanding stiffeners 118 may be located at the same longitudinal stations as the various cross-bearers. There may be a moment connection formed between each such stiffener 118 and the associated cross-bearer 72, and that moment couple connection may have the form of a structural knee, as explained below.

Stiffeners

Vertical stiffener 118 may have a cross-section in a variety of forms, be it and I-beam, a structural section of arbitrary shape, an H.S.S. tube, and so on. In one embodiment, it may include a back 132 and a pair of legs 134, 136 mounted to cooperate with an adjacent opposed region 138 of web 114. Back 132 and legs 134, 136 may be an integrally formed pressing, or a pre-fabricated sub-assembly which is then joined to web 114. Back 132 may stand spaced from web 114, and may be in a parallel plane, to that of web 114, which plane may be an x-z plane, with the width of stiffener 118 being in the longitudinal, or x-direction, and the length being in the vertical or z-direction, or generally upward direction toward top chord 112. Legs 134, 136 may connect back 132 to web 114, the distal ends of legs 134 and 136 being connected thereto by suitable means, such as welding. A closed hollow section may be developed, such as may define an upwardly running beam for resisting lateral deflection of web 114 and top chord member 110 of beam 80 generally. Stiffener 118 may be of constant section from bottom to top, or may have a tapering section. A tapering section may be broad at its base, near floor panel 44, and narrower at its tip, where it may be connected to top chord member 110. Put somewhat differently, stiffener 118 may be such that, in the context of resisting lateral deflection of top chord member 110 and web 114, the effective second moment of area at the base (including the co-operative effect of the adjoining region 138 of side sheet web 114) of stiffener 118 may be greater than at the tip, and may diminish progressively along the length thereof. The effective width of cooperative adjoining region 138 may be the distance between legs 134, 136 plus an effective distance to either side thereof that is, in total, in the range of 20-30 times the thickness of web 114. In one embodiment, this effective distance may be about 24 times that thickness plus the distance once between the webs. Depending on the type of lading it may be intended to retain, web 114 may be in the range of about ⅛ or ¼ to about ⅝ inches thick.

Floor panel 44 may include floor panel extensions 140 that underlie the respective bases of stiffeners 118. Extensions 140 may be formed by trimming the floor panel stock, such that extensions 140 are integral parts of floor panel 44, rather than being joined after-the-fact as gussets welded in place. Extensions 140 may have a generally trapezoidal plan form, with a generally rectangular central portion 141 that may tend generally to underlie the substantially rectangular footprint of stiffener 118 and triangular webs or gussets 143 that remain proud of legs 134, 136, running from the outboard back of stiffeners 118 toward the side sheet web 114 more generally, the gussets being smoothly radiused both near web 114 and near back 132. To the extent that the side panels or beams (80 or 78) may be prefabricated as a sub-assembly, including stiffeners 116 and then mated to floor panel 44, the outer flange member, back 132, of stiffener 118 (or 120, as described below) may have a cut-out formed at the base margin thereof to permit the assemblies to be welded together fully along the outboard fillet of web 114 with floor panel 44. A welding opening cover plate 142 may be used to close this opening and be welded in place itself to provide a measure of flange continuity of back 132 to floor panel 44.

It may be that a side web extension 146 may be mounted beneath floor panel 44, and a stiffener extension assembly 144 may be mounted outboard of side web extension member 146. Side web extension member 146 may be a substantially planar sheet, which may be of substantially the same thickness as side web 114, or may be formed of a thicker bar. Side web extension member 146 may be mounted to the underside of floor panel 44, and may be mounted such that the mating of the upper margin of extension member 146 lies in general alignment with, and may lie directly opposite to, the mating of side web member 114 with floor panel 44, such that a tensile load in side web 114 may, in whole or in part, be carried into web extension 146 substantially without transverse travel through floor panel 44 such as might otherwise tend to give rise to a bending moment in floor panel 44 between the line of action of web 114 pulling up on floor panel 44 and the line of action of web extension 146 pulling down on floor panel 44. Expressed alternately, it may be that web 114 and extension 146 are mated to plate 44 in a manner tending to discourage unduly eccentric transmission of stress from one to the other. In that regard, extension member 146 may be substantially co-planar with side web member 114. Extension member 146 may include a first or central portion 148 corresponding in width to the width between, and being mounted between, webs of stiffener extension assembly 144. In one embodiment, central portion 148 may extend more than 3 inches below floor panel 44. In another embodiment, central portion 148 may extend more than half the depth of web 85, or 84, 86 (as may be) from floor panel 44. In a further embodiment, central portion 148 may extend to substantially the full depth of webs 85, or 84, 86, (as may be) such that the upward- and downward length or depth corresponds to the distance between floor panel 44 and cross-bearer bottom flange member 88.

Extension member 146 may also include adjacent wing portions 150, 152 which may be co-planar with central portion 148, all of which may be co-planar with web member 118. Wing portions 150, 152 may each have a substantially triangular or somewhat trapezoidal form, and may function as gussets having one vertex mated to an outside face of cross-bearer web 85, or 84, 86, (as may be), most typically as by welding, and a second vertex mated to the underside of floor panel 44 directly opposite web 114. Wing portions 150, 152 may be smoothly and generously radiused at the lowest corner, and smoothly and generously radiused at the distant feathered termination along the vertex adjoining floor panel 44. To the extent that there may be a tensile (or compressive) stress field in the up-and-down direction in web 114 in the neighborhood of the post (namely stiffener 118), gussets 150, and 152 and central portion 148 may tend to collect or distribute that stress, as it passes through floor panel 44, along a line, and may tend to transmit or receive that stress as distributed shear flow along a line of shear in a distributed manner, such as may tend (a) to reduce local bending moments in the junction with floor panel 44, and (b) to reduce peak stresses, and to even out the distribution of stress, at least to some extent, along the line of shear force transfer described below.

A stiffener extension assembly 144 may be mounted beneath each of stiffeners 118 generally in line with each of cross-bearers 72. Stiffener extension assembly 144 may include a first wall or member 154, a second wall or member 156, and a third wall or member 158. The first, second, and third members may be substantially planar, and may be formed as a single, integrally formed part, such as a section of channel 160, which may be a forged, pressed, roll formed or other structural section cut to length as a stub section. That length may be 6 inches or more. That length may be as great as, or greater than half the depth of webs 85, or 84, 86 of cross-bearer 72 at their intersection with the plane of web 114. In another embodiment, that length may correspond, more or less, to the depth of webs 85, or 84, 86 in full. First wall member 154 may be the back of the stub channel 160, and second and third wall members 156, 158 may be the legs of the stub channel 160. Stiffener extension assembly 144 may also include a fourth wall, such as may be identified as a cross-bearer bottom flange extension member 162, which may be welded in place to mate with extension 146 opposite cross-bearer bottom flange member 88, and which may be co-planar with bottom flange member 88. Cross-bearer bottom flange extension member 162 may be welded across the lower end of the stub section of channel 160, to provide a shear flow transfer connection along a line between the lower margins of second and third wall members 156 and 158 and bottom flange extension member 162. The most laterally outboard distal end of bottom flange extension member 162 may adjoin, and be connected to, the lowermost distal margin of first wall member 154.

Stiffeners 120 may be mounted along web 114 in an alternating manner with stiffeners 118. Each stiffener 120 may include a web member 164 running predominantly up-and-down on web 114, and standing predominantly outwardly therefrom, and a flange member 166 running with, and having a shear flow connection with web member 164, the flange member being spaced from web 114, and typically standing laterally outboard thereof. In one embodiment, stiffener 120 may have the form of a formed section such as an angle, a hollow tube, which may be rectangular or square, a roll formed, forged, or U-pressing channel 168 in which flange member 164 may be the back 170 of the channel, and web member 164 may be either of two legs 172 of channel 168 whose toes are welded to web 114.

As with stiffener 118 described above, the co-operation of channel 168 with web 114 may tend to yield a hollow structural section that stiffens web 114 in the up-and-down direction, perpendicular to top chord member 110, and that may tend to discourage buckling of web 114. That structural section may tend to have an effective inner flange width equal to the width of the channel between the legs, plus an effective flange width to either side of 40 to 60 (i.e., 20 to 30 times to each side, for a total of 40 to 60 times the thickness of web 114 (and which may in some embodiments be taken as roughly 44-48 times that thickness).

The upper end of stiffener 120 may be welded to top chord member 110. Floor panel 44 may include floor panel extensions 174 to which the lower end of stiffener 120 may be connected, as by welding. Floor panel extensions 174 may have a generally trapezoidal shape, having a central, generally rectangular region 176 that underlies the hollow section defined by stiffener 120, and a pair of wing portions 178 that define gussets extending to either side of legs 172. In one embodiment, extensions 174 may be formed as monolithic, or integral, parts of floor panel 44 when floor panel 44 is cut from a sheet of stock, rather than, for example, being gussets that are cut separately and welded in place after the fact. In each case, the profile cut corners may be smoothly radiused to merge smoothly into the profile of the adjacent plate.

Web member 114 may also have web extensions 180. Web extensions 180 may be in the form of gussets welded to the underside of floor panel 44 in a position opposite to the locus of mating of side sheet web 114 and floor panel 44 centered on the center line of cross-tie 76 and stiffener 120. Web extensions 180 may have a generally trapezoidal form that may include a rectangular central portion 182 that extends across the distal end of one of cross-ties 76, and is welded to web 92 and bottom flange 96 thereof, as well as to the underside of floor panel 44. Web extensions 180 may also include generally triangular shaped wing portions 184, analogous to wing portions 150 of web extensions 146, that spread the effect of the junction into the adjoining web regions. In contrast to the junction between stiffener 118 and cross-bearer 72, the junction between side stiffener 120 and cross-tie 76 may not include a post extension assembly such as assembly 144, and may not include a structural knee connection, such as described above, and discussed below. (Although such a post extension structural knee assembly could be used in an alternate embodiment).

A structural knee 186 is also formed at the distal ends of main bolsters 82. Stiffeners 122 may be of substantially the same construction as stiffeners 118. Floor panel 44 may have floor panel extensions 188 upon which the posts (namely, stiffeners 122) sit, and with which they are mated in substantially the same manner as extensions 140 of floor panel 44 described in connection with stiffeners 118. Side sheet extensions 190 may differ from web extensions 146 in that they may be positioned with their upper margins welded to floor panel 44 opposite the locus of mating of web 114 with floor panel 44, yet extend at an inwardly and downwardly sloping angle, rather than being co-planar with web 114. Knee 186 may include a post extension assembly 192 that is substantially similar in structure to assembly 144 described above in the context of stiffeners 116. Post extension assembly 192 may include an outer wall member 194 having an eye 195, which may also be termed a lifting lug, to permit the car body to be lifted. In addition, post extension assemblies 192 may include a thick doubler plate 196 mounted to the underside of the lower flange portion of assemblies 192, plate 196 having an eye 197 such as may accommodate a lifting lug. Plate 196 may also provide a reinforced jacking point by which the end of the car body may be lifted. The all welded connection may include backing members 198.

The Structural Knees

The railroad freight car 20 may have structural knees, as noted above. For the purpose of the following discussion, those knees may be identified as 200 at the junction of the cross-bearers and their associated side posts, as well as at the junction of the main bolsters and their associated vertical side posts. The foregoing description of the connection of side posts (i.e., stiffener 118) to cross-bearer 72 is a description of a structural knee 200.

Conceptually, it may be desired for the side posts at the cross-bearer ends to act as springs that may tend to resist lateral deflection of the top chord, and perhaps of the side beam generally, due to the lading, and such other forces as may tend to wish to flex the top chords laterally. In this regard, the lading may be considered as a distributed lateral pressure load, $P_{Lading}$ working against the side beams 78, 80, and, more particularly, working against the containment membranes. The containment membranes may, in this context, be the webs, or web sheets, of the side beams namely web 114 as well as floor panel 44, and the end wall bulkheads. To this end, it may be desirable for the structural connection between the upstanding side posts and their associated cross-bearers to be able to transmit a bending moment.

In as much as the loads may be large and cyclic, it may be desirable to avoid sharp stress field discontinuities. The general object then is to transmit a moment couple carried by the side post flanges (e.g., 132 and 138) around a corner and into the flanges of the cross-bearer (e.g., 88 and 102 or 89 and 103) while trying to avoid unduly sharp variations in the stress fields in the flanges and webs, and while trying to keep the stress fields relatively evenly spread out such that the peak stresses may be closer to the mean stresses than they might perhaps otherwise be.

As this is a multi-dimensional stress field problem, understanding may be aided by considering the illustration of FIG. 4*b*. In FIG. 4*b*, a side post such as stiffener 118 is to be considered in the generic sense as representing any side post. This conceptual explanation may be understood in the context of an embodiment in which the side post has a single web, or in the context where it is understood that side post has a hollow section, such as a roll formed section having a back or flange, and a pair of spaced apart legs. There is an associated cross-bearer 72. It may be that cross-bearer 72 has the same number of webs as the side post or it may not. Referring to FIGS. 4*b*, 4*c*, 4*d* and 4*e* for the purposes of this discussion, a Cartesian co-ordinate system is defined in which the x-axis is perpendicular to the page (i.e., parallel to the longitudinal centerline axis of the car more generally). The z-axis is the vertical axis, and the y-axis is the lateral axis, with the positive y direction being oriented away from the longitudinal centerline axis of the car (i.e., y increases in the laterally outboard direction).

There is structure identified in association with the side post that performs the function of a first flange member (region 138); that performs the function of a second flange member (back 132); and also structure that performs the function of a shear transfer web member (leg 134 or 136) joined to and working between the flanges. In the illustration of FIG. 4*b*, region 138 is shown as running vertically and extending (i.e., having a width perpendicular to the paper) in the longitudinal direction. That is, it may be substantially planar in the z-x plane. This need not necessarily be so. The plane could be inclined with respect to the vertical, or might not necessarily be a plane at all, but could be a curve. However, considering a flange member such as region 138 to be planar may tend to facilitate conceptual understanding of the analysis. Similarly, the other spaced away flange member (back 132) may tend to be planar, and may lie in a parallel x-z plane but, generically, it need not necessarily be planar, and need not be parallel, but could in one embodiment be at an inclined angle. The second flange member may also tend to have a width perpendicular to the page, and may tend to run, and carry tensile or compressive stresses, in the generally up-and-down direction of the flange generally. The web members' legs (134, 136) are also intended to define a generic shear coupling between the flange members, and need not be planar. However, the web member, or members, may be generally planar, and may lie in a plane that is perpendicular to the flange members, such as a laterally outboard extending, vertically running, y-z plane.

As with beam theory generally, it is assumed that web member(s) carry the lateral load due to the lading working against the sidewall, and the flange members carry the accumulated bending moment associated with lateral load. Since the lateral load $P_{Lading}$ is a distributed load working in the positive y-direction (i.e., laterally outboard) it is assumed that the inboard flange carries a tensile stress field, and the outboard flange carries a compressive stress field, the two stress fields, identified as $\sigma_{t\text{-}Post}$ and $\sigma_{c\text{-}Post}$, being such that, when integrated and taken over their moment arms, define a moment couple, $M_{Lading}$ having a generally clockwise sense when viewed looking into the page. Ideally, these stress fields would have a roughly uniform stress distributed across the flanges and the moment couple would be roughly the product of that stress multiplied by the areas of the flanges, multiplied by the square of the moment arm, it being conservatively assumed that the share of the moment carried by the webs can be ignored as small. In this explanation, the inboard flange may be a flange of a formed post, or may be a portion of the side sheet web (e.g. web 114) of the side beam of the railroad car more generally, where the effective width of the flange relative to the intersecting web is a function of side beam web sheet thickness, for example.

Similarly, there is structure identified in association with cross-bearer 72 that performs the function of a first flange member, which may be an upper flange member such as region 102; structure that performs the function of a second flange member, which may be a bottom or lower flange member such as member 88; and also structure that performs the function of a shear transfer web member (web 85, or webs 84, 86) joined to and working between the flange members. In the illustration, the upper flange member (region 102) is shown as extending horizontally and running in the longitudinal direction. That is, it may be substantially planar in the x-y plane, with a width perpendicular to the page, and a major dimension, or length, along which tensile $\sigma_{t\text{-}Floor}$ or compressive $\sigma_{c\text{-}Floor}$ stresses due to the moment couple $M_{Reaction}$ may be carried, that major dimension being substantially parallel to the y axis. This need not necessarily be so. The plane might be slightly inclined, or might not necessarily be a plane at all, but could be a curve, or have a slight camber. However, considering the upper flange member to be planar, as a floor sheet underlying cross-bearer flange might be in general, may tend to facilitate conceptual understanding of the analysis. Similarly, the lowest flange member 88 may tend to be planar, and may lie in a parallel x-y plane to that of the upper flange member, but, generically, it need not necessarily be planar, and need not be parallel. Some embodiments of cross-bearer 72 may tend to taper from a wide root at the center sill, to a shallower outboard tip. Web 85 (or webs 84 and 86 as may be) is also intended to define a generic shear coupling between the flange members, and need not be planar. However, the web member or members may be generally planar, and may lie in a plane that is perpendicular to the flange members, such as a vertically extending, laterally outboard running, y-z plane.

As above, it may be assumed that each web member provides a shear connection between the flange members and that those flange members carry the bending moment reaction $M_{Reaction}$ to moment $M_{Lading}$. Since $M_{Lading}$ works clockwise in the example, the reactive moment $M_{Reaction}$ must be counter-clockwise, such that it is assumed that the first, or upper flange member carries a tensile stress field $\sigma_{t\text{-}Floor}$, and the second or lower flange member carries a compressive stress field, $\sigma_{c\text{-}Floor}$, the two stress fields, when integrated and taken over their moment arms, defining the reactive moment couple. $M_{Reaction}$ clearing, for static determinacy the sum of $M_{Lading}+M_{Reaction}=0$, i.e., they are equal and opposite.

Although not necessarily generically essential, and not always possible, it may often be desirable for the various flanges and associated webs to be substantially planar and mutually perpendicular. This may tend to minimize, or to avoid giving rise to, secondary or tertiary out of plane forces (and hence also to avoid the need for provision of reaction load paths for those secondary or tertiary out-of-plane loads). These secondary and tertiary out-of-plane forces may not necessarily be considered benign. Where out of plane members are employed, they may sometimes be employed in opposed pairs in which the out-of-plane effects may be equal and opposite, and so may tend to have a balancing effect.

Web portion 202 may be considered part of, or an extension of, web 85, 84 or 86 of cross-bearer 72, or may be considered part of, or an extension of the web (i.e., leg 134 or 136) of the post (stiffener 118). This web portion may be part of either, or an extension of either, or may be a separate member that is not formed as an integral part of either, but is attached to both by fabrication, such as welding. Similarly, web portion 202 may be bounded by stress field transfer members such as an inboard post flange continuity member (e.g. 146), an outboard post flange continuity member (e.g. 154), an upper cross-bearer flange continuity member (e.g. 140), and a lower cross-bearer flange continuity member (e.g. 162). Each of these members may have the form of a substantially planar gusset, or may have another form, such that one edge abuts, or is substantially aligned with, and connected to communicate compressive or tensile forces with, the flange member with which it is associated, and another portion thereof runs along, and is connected to transmit shear forces to, an associated edge of web portion 202. For its part, one edge of web portion 202, such as a first edge 204 may be located opposite lower edge 206 of the post web namely member 134, 136 and a second edge, 208 may lie opposite the laterally outboard edge 210 of web 85, 84 (or 86 as may be) of cross-bearer 72. Put differently, the junction of web 84 or 86 with upper cross-bearer flange continuity member (140) may lie in substantially the same plane as web portion 202 and the junction of the cross-bearer web, be it 85, 84 (or 86) with the side post inboard flange extension member (e.g. 146) may also tend to lie in substantially the same plane as web portion 202. A third edge 212 of shear web portions 202 may lie along, and form a shear transfer connection with, the post outboard flange extension, of which back 154 is an example. A fourth edge 214 of shear web portion 202 may lie along, and form a shear force transfer connection with, the cross-bearer bottom flange extension member, of which member 162 is an example.

Generally speaking, it may be that the various flange members (e.g., 88, 102, 132 and 138) and their respective associated flange extension members (e.g., 162, 140, 154, 146) to have the same through thickness, and, whether that is so, or not, for the respective pairs of members to lie within one thickness of alignment with each other, or to overlap each other in thickness. That is, it may generally be desirable for the flange members and their respective flange extension members to be lined up such that the central plane of the flange member sits opposite, or in line with, the central plane of the corresponding extension member. I.e., generally speaking, they are not offset very far from one another, if at all, such that forces associated with the in-plane tensile and compressive stress fields passed between them may tend not to be passed eccentrically. It may be that this overlap, or alignment, is such that in one embodiment, there is at least some overlap. In another embodiment, at least half the thickness of each member overlaps the opposed member. In another embodiment, the opposed members are less than ⅜ inch offset from each other. In another embodiment, they are substantially directly aligned.

Although it may be convenient, it is not necessary that legs 172 be aligned with any of web 85 (or webs 84 and 86 as may be), or that web portion (or portions) 202 be aligned with any of them. A knee may include a pair of input flanges, a pair of output flanges, and a shear force transfer member that is connected to both pairs of flanges. The flanges of the knee have flange continuity at the locations at which the members of the pairs of flanges intersect. The shear force transfer members may tend to have flanges running along substantially their entire edges to discourage local out-of-plane deflection.

The tensile stress field carried by the inboard flange (138) at its junction with the cross-bearer top flange (102) is then carried into the inbound flange extension member (146) and transferred, from member 146 in shear into web portion 202 along a substantial portion of, and possibly the full length of, edge 208. Similarly, the outboard flange extension member 154 communicates a compressive stress field introduced along its upper vertex into a shear stress field transmitted along much, and possibly all, of edge 212 of web portion 202. The reaction shear stress fields are transmitted by cross-bearer top flange extension 140 into a shear stress field along edge 204, and by bottom flange extension member 162 into a shear stress field along edge 214. For static determinacy, the moment couples are in balance. Extensions 162, 140, 154 and 146 may also tend to discourage out-of-plane deflection of web portion 202.

The foregoing is intended as a generic description of the structural knee. In one embodiment, upper cross-bearer flange extension 140 may merely be part of the upper cross-bearer flange. That is, they may have been formed integrally as part of a rolled beam in the first place, or may have been parts of the same as-rolled plate, cut into a flat bar or panel, and joined by fabrication to web members such as web 84, 86 and web portion 202. Alternatively still, flange extension 140 may be formed as part of the same monolithic stock as floor panel 44 more generally, with the profile of flange extension 140 being formed by a cutting process, such as a plasma arc cutting process.

For the purpose of this explanation with respect to laterally outwardly working forces tending to bend the upstanding posts outboard, the reaction to the vertical lading load is not discussed. The vertical lading load is reacted, primarily, in the side beam, which carries the vertical shear and the associated bending moment to the end sections of the car. It may also be noted that the contribution of the web members of the side post (e.g. 134, 136) and the web members 85 or 84 and 86 of cross-bearer 72 to carrying the bending moments are taken as being small compared to the contribution of the various flanges, such that they may be considered to be zero. In such an analysis, mean stresses in the flange pairs may be made roughly equal by equating the second moments of area of the sections leading to the knee. To the extent that the second moment of area may be calculated according to the formula $\Sigma(1/12)b_ih_i^3+\Sigma A_id_i^2$, in this analysis it is assumed that the $A_id_i^2$ terms predominate and the $(1/12)b_ih_i^3$ terms are small. To the extent that the spacing between the cross-bearer flanges $h_{72}$ may be significantly greater than the spacing between the side post flanges $h_{118}$; and to the extent that the wall thickness of web 114 and the members of stiffener 118 may be thinner than either floor panel 44 or lower flange 88, bottom flange 88 may be narrower than back 132, as indicated by the diminution in section from the flared and radiused end portion 87 and the narrower extending part in 91 of bottom flange 88.

There are a number of ways in which a knee structure such as that discussed above may be fabricated. One embodiment has been described above which employs a post extension assembly 144. In another embodiment, webs 85 or 84, 86 of cross-bearers 72 could be continuous, and could extend outboard of the plane of web 114 to the full extent of floor panel 44. The embodiment may share the common feature of flange continuity, and transfer of longitudinal stress fields in the flanges on one side of the knee by shear flow into shear stress fields in one or more webs at the corner of the knee, which are then again transferred into longitudinal stresses in the flanges on the other side of the knee. In these embodiments, the shear flow is encouraged to occur over a line interface, and out-of-plane deflection of the various flanges is discouraged.

Clean Out

As noted above, car 20 has a car body 22 having a peripheral wall structure. End walls 40, 42, are bulkheads having laterally extending stiffeners, which may be channels of steel tubes, to which an end sheet may be mounted, along with customary features such as a handbrake, ladders at the points of the car, and so on. Inside receptacle 32, car body may include inclined lower end sheets, 220, which extend across the width of the well at the foot of the end wall.

Figures 6A, 6B, 6C:
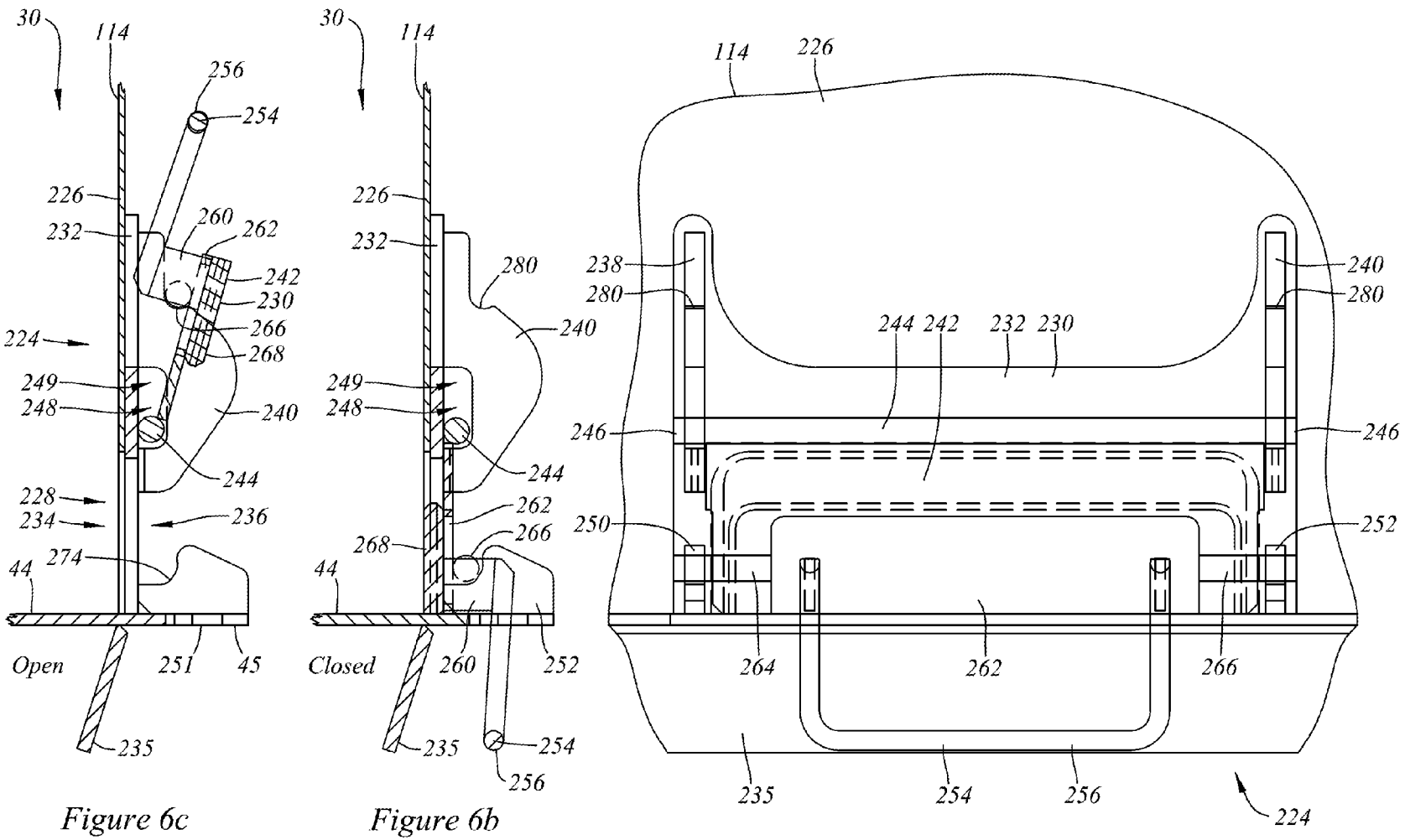
FIG. 6*a* is a detail of a side of the car of FIG. 2*a* showing a side port in a frontal view.
FIG. 6*b* is a sectional view detail of the side of the gondola car of FIG. 5*a* showing a side view of the port of FIG. 5*a* in a closed condition.
FIG. 6*c* is a sectional view detail of the side of the gondola car of FIG. 5*a* showing the port of FIG. 5*a* in an open position.

From time to time, it may be desirable to clean out receptacle 30, as, for example, when it is desired to lade car 20 with a different kind of lading than that with which car 20 may previously have been laded. To that end, car 20 may have porting, such as may include an array of one or more clean outs 224. In one embodiment, there may be four such cleanouts (or more). Each of four cleanouts may be located in a corner region of car body 26. In one embodiment, clean out 224 may be formed in a shear bay web portion 226 of web 114 more generally. Clean out 224 may be located in a bay that is longitudinally outboard of main bolster 82. Cleanout 224 may include an opening 228 formed in a lower region of web portion 226. The lower sill of opening 228 being flush with floor panel 44. Cleanout 224 may also include a gate 230, such as may be moved between an open position, as shown in FIG. 6*a*, and a closed position, as shown in FIG. 6*b*. When in the open position, water and other materials may tend to be permitted to be flushed out of, or drain out of receptacle 32. When gate 230 is in the closed position, lading may be retained within car body 26, and discouraged from exiting receptacle 32. Opening 228 may be relatively small, and may be an opening in a small lower region of the surrounding web. Opening 228 may be less than 2 ft., (and may be less than 18" or 1 ft.,) high, and may be about 3 ft or 30 inches wide, or may be less wide, such as about 24" or 27" or perhaps as little as 18".

Gate 230 may include a framing member 232, extending beside and across the top of opening 228 such as may perform the function of a doubler plate, or reinforcement about opening 228, opening 228 being formed by making a first opening 234 in web 114 and a second, aligned opening 236 in framing member 232. All of these openings may have a generally linear lower edge, which may be flush with, and possibly defined by, floor panel 44. All of these openings may have a generally square or rectangular shape. Gate 230 may also include a pair of spaced apart wall members 238, 240 which may extend laterally outboard from framing member 232 on either side of opening 228. The bottom edge of the opening may be supported by a bottom framing member 235 welded to the underside of floor panel 44. Framing member 235 may be in a generally co-planar position relative to web 114.

Gate 230 may also include a moving closure member 242. Moving closure member 242 may have a hinge 244, which may have hinge rod ends 246 that extend to either side, and protrude through apertures 248 in wall members 238, 240. Apertures 248 may be in the form of vertically extending slots 249 that permit a rotational degree of freedom of rod ends 246, and a translational degree of freedom in the up and down direction (i.e., along the z-axis). Gate 230 may also include a pair of catches, or stops 250, 252 which may be mounted on local extensions 251 of the laterally outboard overhang 45 of floor panel 44 immediately outboard of web 114. Stops 250, 252 may be aligned with (i.e., may lie in the same respective vertical planes as) the corresponding wall members 238, 240. Stops 250 may include an inclined lead-in, or wedge, or ramp, 251, followed by a relief or detent, such as indicated at 253.

Gate 230 may include a handle 254, having a bail 256. Bail 256 may be generally U-shaped, and may include a pair of bail standoffs 258, 260, which are mounted to a main panel 262. Main panel 262 is of greater planar extent than opening 228, such that, in the closed position, main panel 262 obstructs opening 228 and prevents outflow of lading there-through. The proximal, or staff, margin of main panel 262 is mounted to hinge 244, and standoffs 258 and 260 are mounted adjacent to the distal, or distaff margin of main panel 262. A pair of indexing members, or catches, or dogs 264, 266 extend sideways from main panel 262. The lading facing side of the distal portion of main panel 262 carries a doubler, or wear plate 268 that may be of greater thickness than, for example web 114. Plate 268 may be of a thickness corresponding to that of web 114 plus framing member 228. When being swung closed the swinging and falling motion of gate 230, perhaps aided by the urging of an operator at trackside, may tend to cause dogs 264, 266 to ride up the ascending profile of ramps 251, forcing hinge 244 also to move upwardly. After passing the crest of ramps 251, dogs 264, 266 may descend to seat in notches 272, 274 of stops 250 and 252 respectively. In this position, the edge face of plate 268 may seat against floor panel 44, and the shape of notches 272, 274 may be such as to have a sloped contact that may tend to urge plate 268 into opening 228 more or less flush with the inside face of web 114. The subsequent urging of lading against plate 268 may tend to by resisted by dogs 264, 266 backing on notches 272, 274.

Gate 230 may be opened in a two step manner. First, by lifting handle 254 more or less straight upward, and forcing hinge rod ends 246 linearly upward in slots 249, dogs 264 and 266 are released from notches 272, 274. This may be termed an unlatching step. Second, by then rotating handle 254 about the axis of rod ends 246 (counter-clockwise from the closed position shown in FIG. 6*b* to the open position shown in FIG. 6*c*), opening 228 may be uncovered such that cleanout materials may exit receptacle 32. Outstanding wall members 238, 240 include inset radiused portions defining detents 280 into which dogs 264, 266 may seat, or latch, when gate 230 is in the open position of FIG. 6*c*. Closing is the reverse operation of unlatching the dogs from the upper detents, and relatching them by forcing them up the inclined slopes and into the lower detents. Both position thus latch due to gravity, and may tend to discourage accidental dislodgement.

Figure 7A:
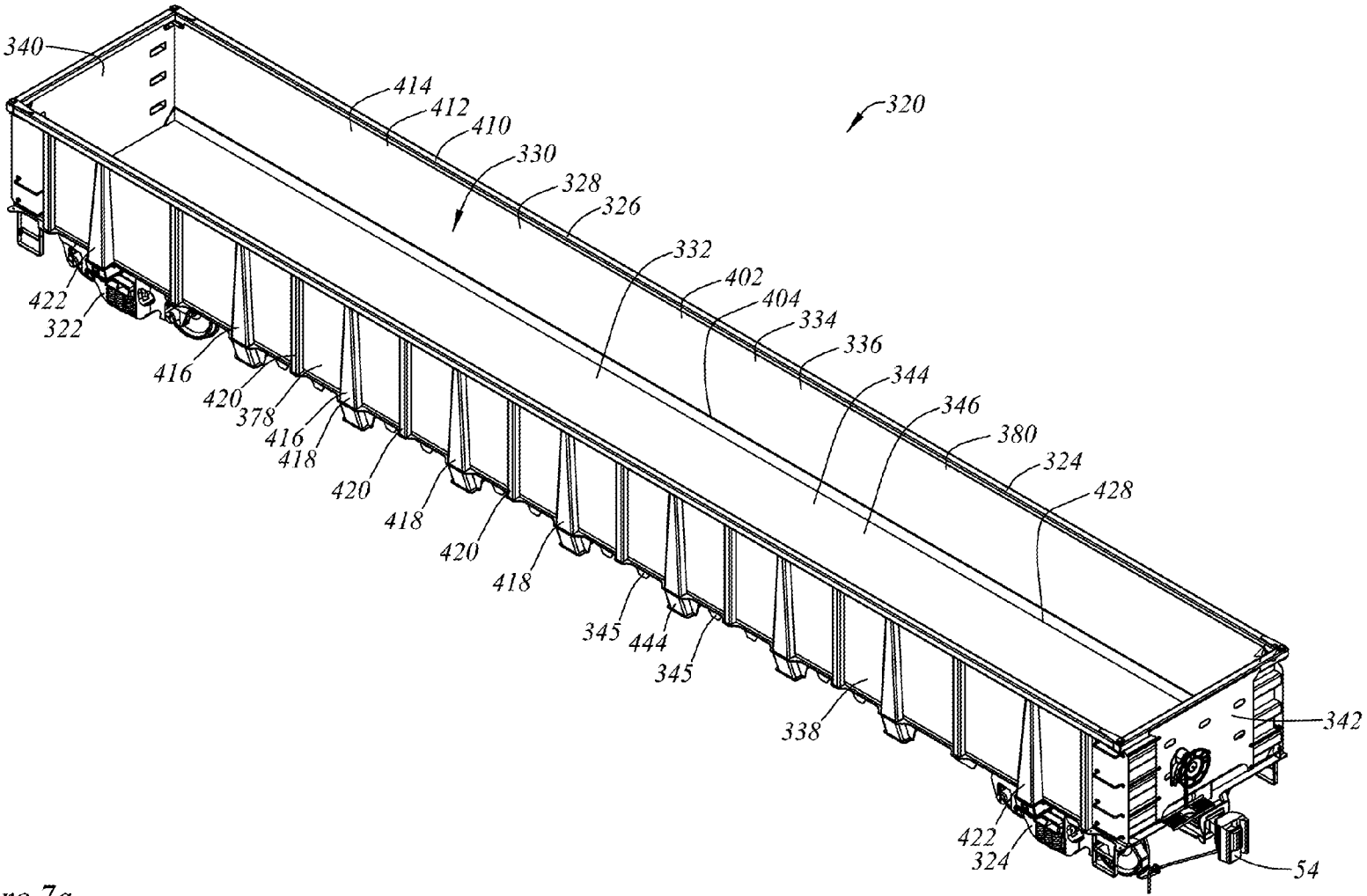
FIG. 7*a* is an isometric, general arrangement view of an alternate embodiment of railroad freight car to that of FIG. 1.
Figure 7B:
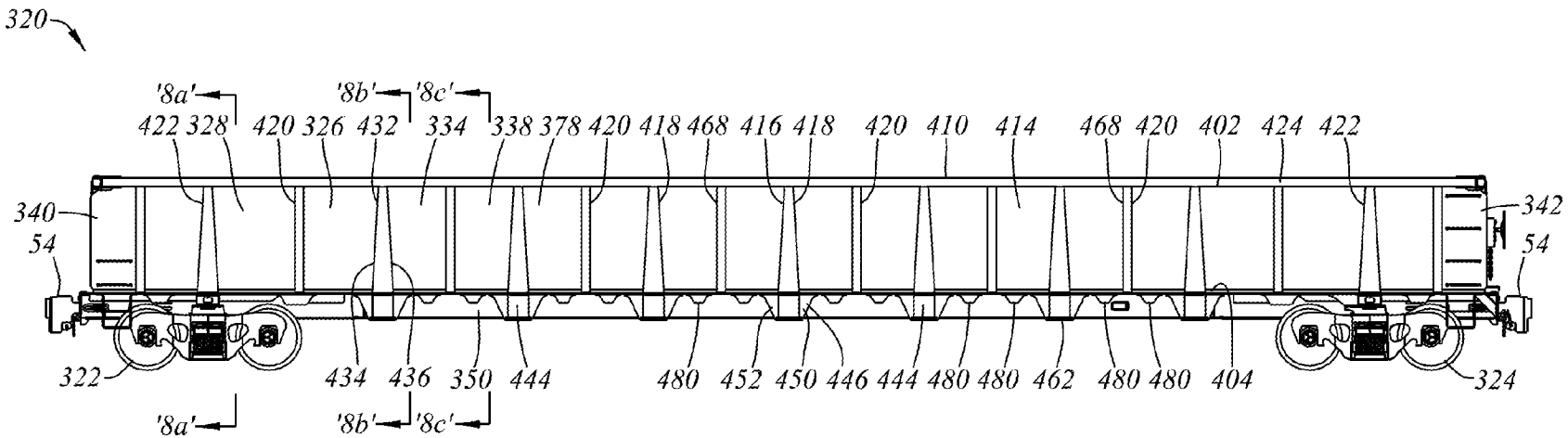
FIG. 7*b* shows a side, or elevation, view of the railroad freight car of FIG. 7*a;*
Figure 7C:
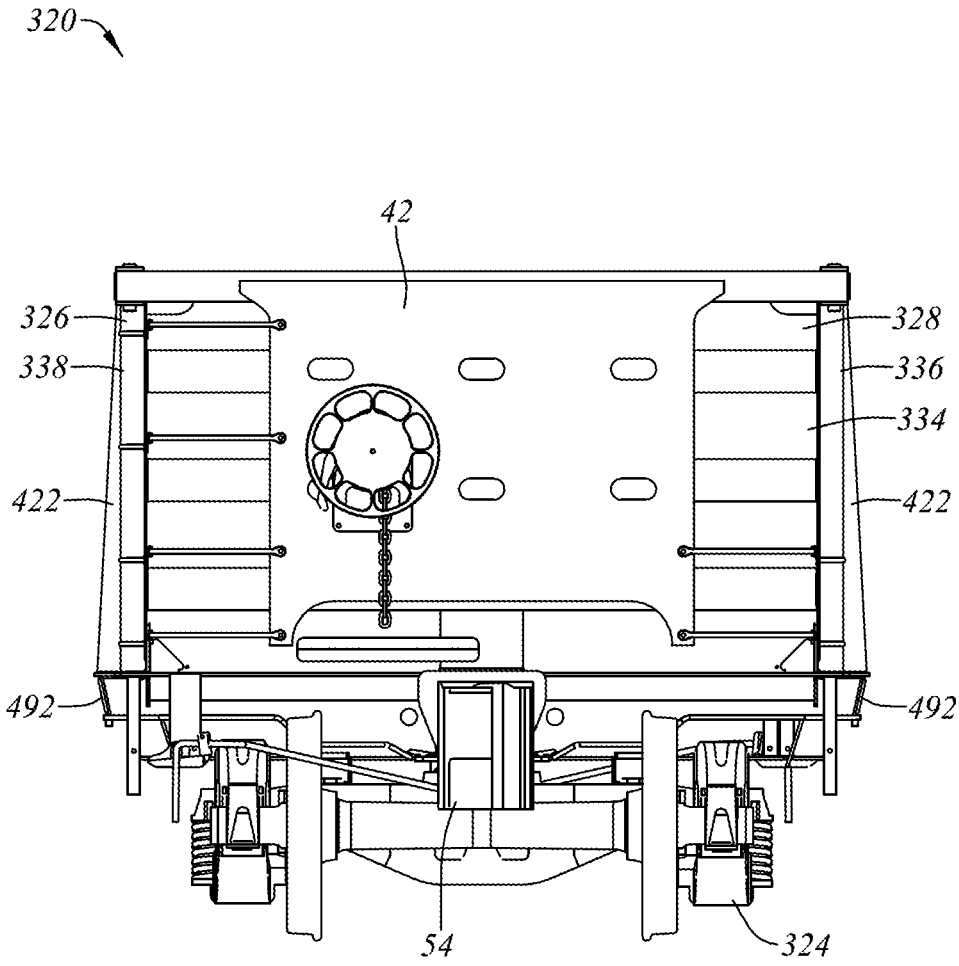
FIG. 7*c* shows an end view of the railroad freight car of FIG. 7*a;*

Embodiment of FIG. 7*a*

FIG. 7*a* shows an isometric view from above and to one corner of an example of a railroad freight car 320 that is intended to be generically representative of a wide range of railroad cars, and which may be a mill gondola car such as may be used for transporting scrap. With the exception of brake fittings, safety appliances and other secondary fittings, car 320 is substantially symmetrical about both its longitudinal and transverse, or lateral, centerline axes. Consequently, where reference is made to a first or left hand side beam, or first or left hand bolster, it will be understood that the car has first and second, left and right hand side beams, bolsters and so on.

Railroad-car 320 has a pair of first and second trucks 322, 324, and a rail car body 326 that is carried upon, and supported by, trucks 322, 324 for rolling motion along railroad tracks in the manner of railroad cars generally. Rail car body 326 may include a wall structure 328 defining a lading containment receptacle 330. Wall structure 328 may include a base wall, which may be in the nature of a floor or flooring 332, and a generally upstanding peripheral wall 334 which may include a pair of first and second side walls 336, 338, and first and second end walls 340, 342. Flooring 332, sidewalls 336, 338 and first and second end walls 340, 342 may tend to define an open topped box, namely receptacle 330, into which lading may be introduced. Generally speaking, car 320 may be of all steel, or predominantly steel construction, although in some embodiments other materials may be used.

Flooring 332 may include a floor panel 344. Floor panel 344 may be made of a plurality of floor sheets joined together, in an abutting fashion such as may yield a continuous lading containing surface, or, in one embodiment, may be made from a single, monolithic steel sheet 346. Steel sheet 346 may be a single sheet having its profile cut from a monolithic sheet of stock by a cutting device, such as a plasma arc cutter. In general, the commentary made above with respect to floor panel 44 applies to floor panel 344 as well. The floor of a mill gondola may tend to be thicker than that of an aggregate gondola. The thickness may be in the range ⅜ to ⅝ of an inch, and may be about ½ inch. Body 326 of car 320 may include an underframe member such as a longitudinally running center sill 350. Center sill 350 may be substantially the same as center sill 50 described above and may be manufactured in substantially the same way. The co-operative effect of the center sill and floor sheets may be the same, or substantially the same, as described above.

Railroad car 320 may include an array 370 of cross-bearers 372 and an array 374 of cross-ties 376. Car 20 may have first and second side beams 378, 380, defining part or all of side walls 336, 338, and may be the dominant structural assemblies of car 320 in terms of resistance to vertical bending and may be aided in that resistance by the co-operative adjoining effective flange width region of the floor panel. Each cross-bearer 372 extends between center sill 350 and a respective one of side beams 378 or 380. Each cross-bearer has a moment connection at both ends (i.e., at center sill 350, and at the side beam, be it 378 or 380. Cross-ties 376 may be placed in pairs or singly between cross-bearers 372. Each cross-tie 376 extends between center sill 350 and one or other of side beams 378, 380. The junctions of the cross-ties with the center sill and the side beams may, conservatively, be analyzed as pin joints as noted above. Car 320 may also have main bolsters 382 that extend laterally from center sill 350 to side beams 378, 380, at the locations of the truck centers (CL Truck).

Each cross-bearer 372 may include a web 385, and a bottom flange member 388. Bottom flange member 388 may include a flared or broadened laterally outboard end portion 387, and a narrower more laterally inboard portion 386 extending to mate with center sill bottom flange cover plate 362 in flange continuity. Alternatively, each cross-bearer 372 may include a pair of first and second, spaced apart upstanding webs as described above and may include a bottom flange member. Web 385 may abut floor panel 344 directly, and be connected directly thereto by such means as welding to yield the sheer flow performance as described above.

Each cross-tie 376 may have a single web 392, or more than one web 392. Each web 392 extends downwardly from floor panel 344. A bottom flange 396 is welded across, and along, the bottom margin of web 392. Cross-tie 376 may include a channel having toes attached to floor panel 344. As with cross-bearers 372, the web or webs 392 of cross-ties 376 may abut floor panel 344 directly, without the intervention, or addition, of a top flange or cover plate, other than floor panel 344. As such, any shear flow may tend to flow directly from one to the other.

Floor panel 344 may tend to define the upper flanges of both cross-bearers 372 and cross-ties 376. As discussed above, the effective cross-bearer upper flange region of cross-bearer 372 and the upper flange region of cross-tie 376 may have an effective width of the order of 40-60 times the thickness of the floor panel sheet, and may for convenience sometimes be taken as being 44-48 times that thickness where there is a single web, and that much plus the web spacing where there are two webs. Floor panel 344 may also overlie main bolsters 382. Each main bolster 382 may have an upper flange, web, and lower flange, side bearing fittings and so on. The main bolster meets center sill 350 at the truck centers. A center plate may be mounted to center sill 350 at this junction.

Side Beam Construction

Side beams 378 and 380 are substantially identical in structure. Hence a description of side beam 380 may also be taken as a description of side beam 378. Side beam 380 may include a top chord member 410, and may have a generally upstanding web 414. An array of vertical stiffeners 416 may be mounted to web 414 at longitudinally spaced locations along side beam 380. Vertical stiffeners 416 may include a first array, or sub array, of stiffeners 418 mounted at locations for structural co-operation with (and typically abreast of) the cross-bearers, and another array, or sub-array, of stiffeners 420. There may also be vertical stiffeners 422 abreast of, and for co-operation with, the main bolsters 382. Stiffeners 420 need not necessarily be located at longitudinal stations corresponding to the longitudinal status of the cross-ties. To the extent that no reliance is placed on the ability to transfer a mount couple, this may permit the spacing at the cross-ties and intermediate posts to differ. For example, where the floor of the car may be subject to large point loads or possible abuse in service, a closer spacing of cross-ties may be appropriate. Where the height of the side beam is not overly tall, and the car is not unduly long, the spacing of the side posts may perhaps be greater than otherwise. For example, it may be that the side beam only needs two shear panel pitches (and hence one intermediate stiffener) of over the same span for which the floor may be better served with three pitches (and hence two cross-ties) between cross-bearers.

In one embodiment, web 414 may include a monolithic steel sheet 402 cut from a single piece of stock and which may run substantially the entire length of car 320 from truck center to truck center or from end bulkhead to end bulkhead. That sheet may have an upper margin 412 mated with top chord member 410, typically at a welded lap joint; and a lower margin 428 more proximate to the decking of the car, namely floor panel 344. Web 414 may also include a second member 404. Member 404 may be a longitudinally running plate in the nature of a skirt or wear plate, (which may be a doubler), and may be of greater thickness than sheet 402. Second number 404 may overlap the lower margin of sheet 402 and may be connected thereto by a lap joint. In one embodiment, member 404 may lie inboard of member 402. In another embodiment it may lie outboard. The lower margin of member 404 may abut, and be welded to, floor panel 344 in the same manner as web 114 and floor panel 44. Plate 402 may then co-operate with the adjacent region of influence of floor panel 344 to perform the function of a side sill.

Top chord member 410 may tend to function as the top flange of side beam 380 (or 378), and may have a formed cross-section, which may be a structural angle, an I-beam or wide flange beam, or may be a specialty formed section, such as a bulb angle, or it may be a channel, or it may be a closed hollow section, such as a rectangular or square steel tube 424. Top chord member 410 may include one or more doublers along part or all of the upper portions thereof, such as a central, or mid-span portion corresponding to the location of greatest bending moment due to vertical lading loads in the gondola.

The junction of member 404 at floor panel 44 may be such that floor panel 44 extends somewhat beyond member 404 and sheet 402 in the laterally outboard direction by some marginal distance. That is to say, the lower margin of member 402 may abut the floor panel 344. This abutment may occur at a T-joint in which floor panel 344 has a laterally outboard margin 345 that may extend laterally proud of member 404 (and sheet 402, for that matter) or of the junction of member 402 with floor panel 344. This laterally outboard margin 345 may run substantially continuously along the length of car 320 and may vary in width. That width may lie in the ranges discussed above in the context of margin 45. That marginal distance may be more than one inch, and may be in the range of 1 to 6 inches. In one embodiment, that marginal overlap may exist all along the junction, between any two adjacent web stiffeners, be they stiffeners 418 or 420. Expressed differently, web 414, or a major portion of web 414, may lie in a plane, or on a two dimensional surface (such as a continuous cylindrical surface). That plane or surface may intersect the plane of floor panel 344 along a line of intersection. The laterally outboard edge of floor panel 344 may lie at least as far outboard as the line of intersection, and may extend further outboard to define margin 345.

Web 414 may not necessarily monolithic, but could be made of two or more pieces joined together side-by-side, as by welding, such as sheet 402 and plate 404, or as a series of plates mounted side-by-side with vertical welds. Alternatively, web 414 might be connected to supporting members or to longitudinal stiffeners by mechanical fasteners such as Huck™ bolts. In any case, web 414 may be substantially planar, or may have a major portion thereof lying in a plane. That plane may be a vertical-longitudinal plane (i.e., an x-z plane) or may be an inclined plane, or an arcuate curve ascending from the decking toward the top chord. The lower portion of web 414 may be indicated as 404, and may include lower margin 428. Whether web 414 is monolithic or not, it may be that lower portion 404 of web 414 immediately next to, and adjoining floor panel 344 may be monolithic (i.e., formed from a single sheet of stock without intermediate joints). A monolithic piece may run substantially the full length of floor panel 344. Portion 404 may be of substantial width, such as to extend from floor panel 344 a substantial distance up stiffeners 416 toward top chord member 410. That width may be greater than 6 inches, and may be as great or greater than 1/12 of the total width of web 414 from floor panel 344 to top chord member 410. In one embodiment, portion 404 may be made from 4 inch wide bar stock.

Lower margin 428 may be formed to abut floor panel 344, and may be joined directly thereto as by welding, such as by fillet welds running both on the inboard and outboard fillets, along the joint from one end of the gondola receptacle to the other. Such welds may be made with automatic welding machines. Alternatively, lower margin 428 may be beveled on the side away from the stiffeners, and a full penetration weld may be made along the bevel. The shear flow associated with the vertical lading in the receptacle may pass directly from the lower margin of web 414 to the adjoining floor panel 344. As discussed elsewhere, floor panel 344 may be of abnormally great thickness. A region of floor panel 344 running alongside lower margin 428 may be influenced by plate 404, and may tend to act as a bottom flange on side beam 380 (or 378 as may be). The effective width of that bottom flange region may be in the range of 40 to 60 times the thickness of the floor panel plate, and, in one embodiment may be about 44-48 times the plate thickness. The lower flange function of side sill may be performed by the co-operative interaction of plate 404 and floor panel 344.

Each of the predominantly vertically upstanding stiffeners 418 may be located at the same longitudinal stations as the various cross-bearers. There may be a moment connection formed between each such stiffener 418 and the associated cross-bearer 372, and that moment couple connection may have the form of a structural knee, as explained below.

Stiffeners

Vertical stiffener 418 may have any of the sections of stiffener 118, and may include a back 432 and a pair of legs 434, 436 mounted to cooperate with an adjacent opposed region 438 of web 414. Back 432 and legs 434, 436 may be an integrally formed pressing, or a pre-fabricated sub-assembly which is then joined to web 414. Back 432 may stand spaced from web 414, and may be in a parallel plane, to that of web 414, which plane may be an x-z plane, with the width of stiffener 418 being in the longitudinal, or x-direction, and the length being in the vertical or z-direction, or generally upward direction toward top chord 410. Legs 434, 436 may connect back 432 to web 414, the distal ends of legs 434 and 436 being connected thereto by suitable means, such as welding. The distal ends of legs 434, 436 may be cut to match the combined profile of sheet 402 and member 404. A closed hollow section may be developed, such as may define an upwardly running beam for resisting lateral deflection of web 414 and top chord member 410 of beam 380 generally. Stiffener 418 may be of constant section from bottom to top, or may have a tapering section. A tapering section may be broad at its base, near floor panel 344, and narrower at its tip, where it may be connected to top chord member 410. Put somewhat differently, stiffener 418 may be such that, in the context of resisting lateral deflection of top chord member 410 and web 414, the effective second moment of area at the base (including the co-operative effect of the adjoining region 438 of side sheet web 414) of stiffener 418 may be greater than at the tip, and may diminish progressively along the length thereof. Stiffener 418 may taper either in depth or in width, or both. The effective width of cooperative adjoining region 438 may be the distance between legs 434, 436 plus an effective distance to either side thereof that is, in total, in the range of 40-60 times the thickness of web 414. In one embodiment, this effective distance may be about 44-48 times that thickness plus the distance between the webs. Web 414 may be about ⅛" to ⅝" thick. In one embodiment it may be about 3/16" thick.

Floor panel 344 may include floor panel extensions 440 that underlie the respective bases of stiffeners 418. Extensions 440 may be formed by trimming the floor panel stock, such that extensions 440 are integral parts of floor panel 344, rather than being joined after-the-fact as gussets welded in place. Extensions 440 may have a trapezoidal plan form, with a generally rectangular central portion 441 that may tend generally to underlie the substantially rectangular footprint of stiffener 418 and triangular webs or gussets 443 that remain proud of legs 434, 436, running from the outboard back of stiffeners 418 toward the side sheet web 414 more generally, the gussets being smoothly radiused both near web 414 and near back 432. To the extent that the side panels or beams (380 or 378) may be prefabricated as a sub-assembly, including stiffeners 416 and then mated to floor panel 344, the outer flange member, back 432, of stiffener 418 (or 420, below) may have a cut-out formed at the base margin thereof to permit the assemblies to be welded together fully along the outboard fillet of web 414 with floor panel 344.

It may be that a side beam web extension 446 may be mounted beneath floor panel 344, and a stiffener extension assembly 444 may be mounted outboard of side web extension member 446. Side beam web extension member 446 may be a substantially planar sheet, which may be of substantially the same thickness as plate 404. Side beam web extension member 446 may be mounted to the underside of floor panel 344, and may be mounted such that the mating of the upper margin of extension member 446 lies in general alignment with, and may lie directly opposite to, the mating edge of plate 404 with floor panel 344, such that a tensile load in side web 414 may, in whole or in part, be carried into web extension 446 substantially without transverse travel through floor panel 344. As explained above in the context of extension member 46, while the two parts may not be in perfect alignment, they may tend to be relatively close, such that the offset is small. As may be generally true throughout this explanation of the various embodiments, the offset, or eccentricity, between the centerline of the section of the extension at the locus of attachment (typically a weld) and the centerline of the section of the opposed web or flange at the line of attachment (again, typically a weld) may be less than one inch. The offset may be less than the full thickness of the thicker member, and in some embodiments less than half that. There may be some overlap of sections, and, in some embodiments, the overlap of sections may be greater than half the thickness of the thinner member. In some embodiments the offset may be less than ⅜", and in some embodiments the two members may be substantially directly aligned. Expressed differently, the offset may tend to be less than three times, and preferably less than two times, the thickness of the intervening plate. In this case the intervening plate is the floor panel, be it 44 or 344, (or 544 as described below). Extension member 446 may include a first or central portion 448 corresponding in width to the width between, and being mounted between, webs of stiffener extension assembly 444. In one embodiment, central portion 448 may extend more than 3 inches below floor panel 344. In another embodiment, central portion 448 may extend more than half the depth of web 385 from floor panel 344. In a further embodiment, central portion 448 may extend to substantially the full depth of web 385, such that the upward- and downward length or depth corresponds to the distance between floor panel 344 and cross-bearer bottom flange member 388.

Extension member 446 may also include adjacent wing portions 450, 452 which may be co-planar with central portion 448. Wing portions 450, 452 may each have a substantially triangular or somewhat trapezoidal form, and may function as gussets having one vertex mated to an outside face of cross-bearer web 385, and a second vertex mated to the underside of floor panel 344 directly opposite web 404. Wing portions 450, 452 may be smoothly and generously radiused at the lowest corner, and smoothly and generously radiused at the distant feathered termination along the vertex adjoining floor panel 344. To the extent that there may be a tensile (or compressive) stress field in the up-and-down direction in web 414 in the neighborhood of the post (i.e., stiffener 418), gussets 450, and 452 and central portion 448 may tend to collect or distribute that stress, as it passes through floor panel 344, along a line, and may tend to transmit or receive that stress as distributed shear flow along a line of shear in a distributed manner.

A stiffener extension assembly 444 may be mounted beneath each of stiffeners 418 generally in line with each, or centered on of cross-bearers 372. Stiffener extension assembly 444 may include a first wall or member 454, a second wall or member 456, and a third wall or member 458. The first, second, and third members may be substantially planar, and may be formed as a single, integrally formed part, such as a section of channel 460, which may be a pressed or roll formed section cut to length as a stub section. That length may be 6 inches or more. In one embodiment that length may be as great as, or greater than half the depth of web 385, of cross-bearer 372 at their intersection with web extension member 446. In another embodiment, that length may correspond, more or less, to the depth of web 385 in full. First wall member 454 may be the back of the stub channel 460, and second and third wall members 456, 458 may be the legs of the stub channel 460. Stiffener extension assembly 444 may also include a fourth wall, such as may be identified as a cross-bearer bottom flange extension member 462, which may be welded in place to mate with extension 446 opposite cross-bearer bottom flange member 388, and which may be co-planar with bottom flange member 388. Cross-bearer bottom flange extension member 462 may be welded across the lower end of the stub section of channel 460, to provide a shear flow transfer connection along a line between the lower margins of second and third wall members 456 and 458 and bottom flange extension member 462. The most laterally outboard distal end of bottom flange extension member 462 may adjoin, and be connected to, the lowermost distal margin of first wall member 454.

As may be noted, stiffener extension assembly 444 may be angled inward, possibly to conform to the AAR underframe clearance envelope. In an angled embodiment, in side view, web extension 446 may be angled with respect to plate 404, rather than being co-planar or lying in a parallel plane. Similarly, the back member, first wall 454, may angle inwardly and downwardly away from the plane of back 432 of stiffener 418, rather than being co-planar therewith or lying in a parallel plane thereto. It may be that the orientation of first wall 454 may be parallel to extension 446. Further, it may be that first wall 454 and extension 446 constitute a first pair of co-operating flange extensions that carry the moment couple from web region 438 and back 432 into the shear panels defined by members 456 and 458; and floor panel extension 440 and cross-bearer bottom flange extension member 462 constitute a second pair of flange extensions that are co-operable to carry the balancing reaction moment from the flanges of the cross-bearer into members 456 and 458. The resulting structure may have the physical form of parallelogram, rather than a rectangle.

Stiffeners 420 may be mounted along web 414 in an alternating manner with stiffeners 418. Each stiffener 420 may include a web member 464 running predominantly up-and-down on web 414, and standing predominantly outwardly therefrom, and a flange member 466 running with, and having a shear flow connection with web member 464, the flange member being spaced from web 414, and typically standing laterally outboard thereof. In one embodiment, stiffener may have the form of a formed section such as a an angle, a hollow tube, which may be rectangular or square, a roll formed, forged, or U-pressing channel 468 in which flange member 464 may be the back 470 of the channel, and web member 464 may be either of two legs 472 of channel 468 whose toes are welded to web 414.

As with stiffener 120 described above, the co-operation of channel 468 with the opposed adjacent region of web 414 may tend to yield a hollow structural section that stiffens web 414 in the up-and-down direction perpendicular to top chord member 410, and that may tend to discourage buckling of web 414. That structural section may tend to have an effective inner flange width equal to the width of the channel between the legs, plus an effective flange width to either side of 40 to 60 (i.e., 20 to 30 times to each side, and which may in some embodiments be taken as roughly 44-48 times that thickness).

The upper end of stiffener 420 may be welded to top chord member 410. Floor panel 344 may include floor panel extensions 474 to which the lower end of stiffener 420 may be connected, as by welding. Floor panel extensions 474 may have a generally trapezoidal shape, having a central, generally rectangular region 476 that underlies the hollow section defined by stiffener 420, and a pair of wing portions 478 that define gussets extending to either side of legs 472. In one embodiment, extensions 474 may be formed as monolithic, or integral, parts of floor panel 344 when floor panel 344 is cut from a sheet of stock, rather than, for example, being gussets that are cut separately and welded in place after the fact. In each case, the profile cut corners may be smoothly radiused to merge smoothly into the profile of the adjacent plate.

Web member 414 may also have web extensions 480. Web extensions 480 may be in the form of gussets welded to the underside of floor panel 344 in a position generally or substantially opposite the locus of mating of side sheet web 414 and floor panel 344. Web extensions 480 are centered on, and welded across the end of, cross-tie 476. Web extensions 480 may have a generally trapezoidal form and may be of substantially the same nature and description as web extensions 180.

Figure 8A:
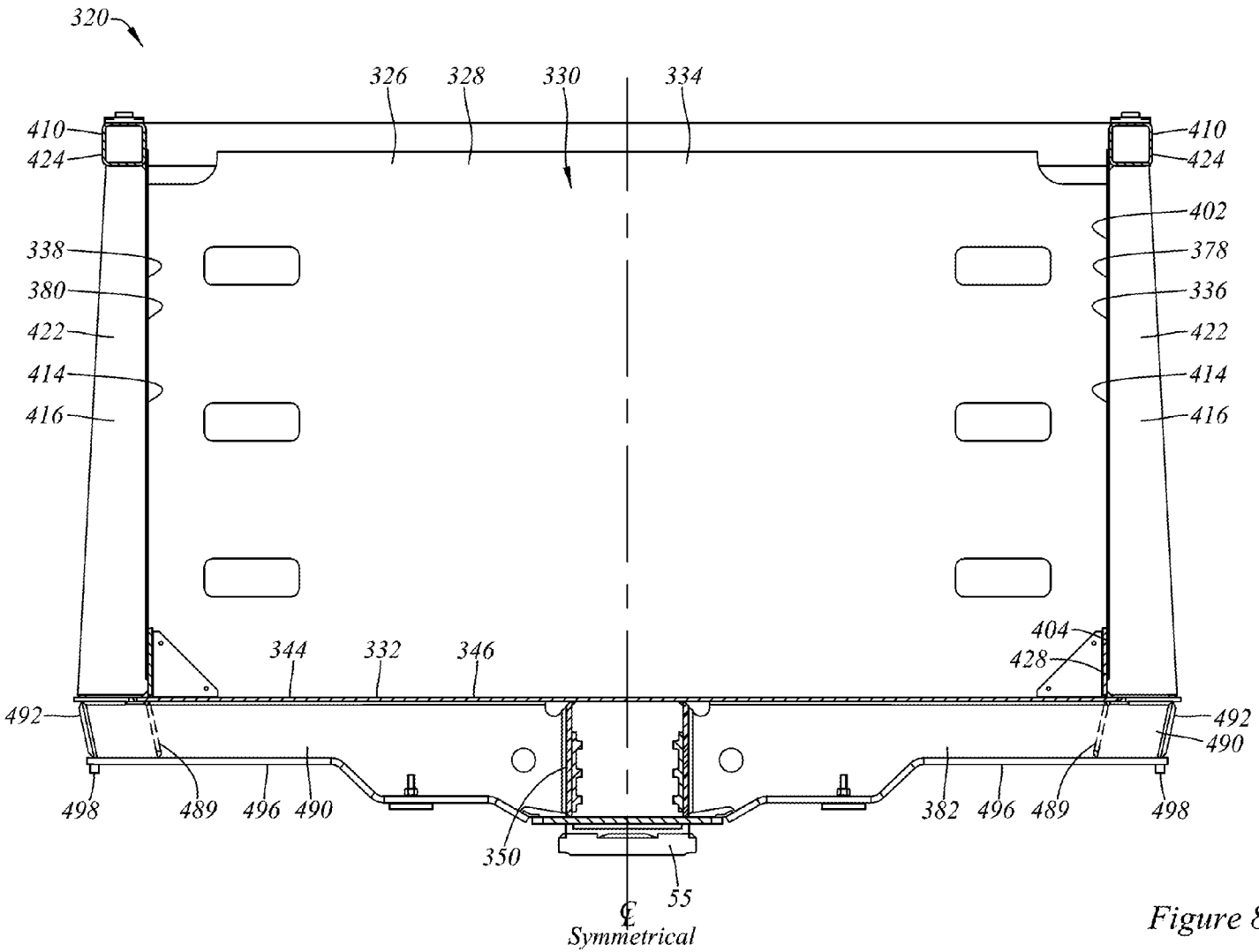
FIG. 8*a* is cross-sectional view, in elevation, on section '8*a*-8*a*' of the railroad freight car of FIG. 7*b* looking toward the main bolster with the truck removed.
Figures 8B, 8C:
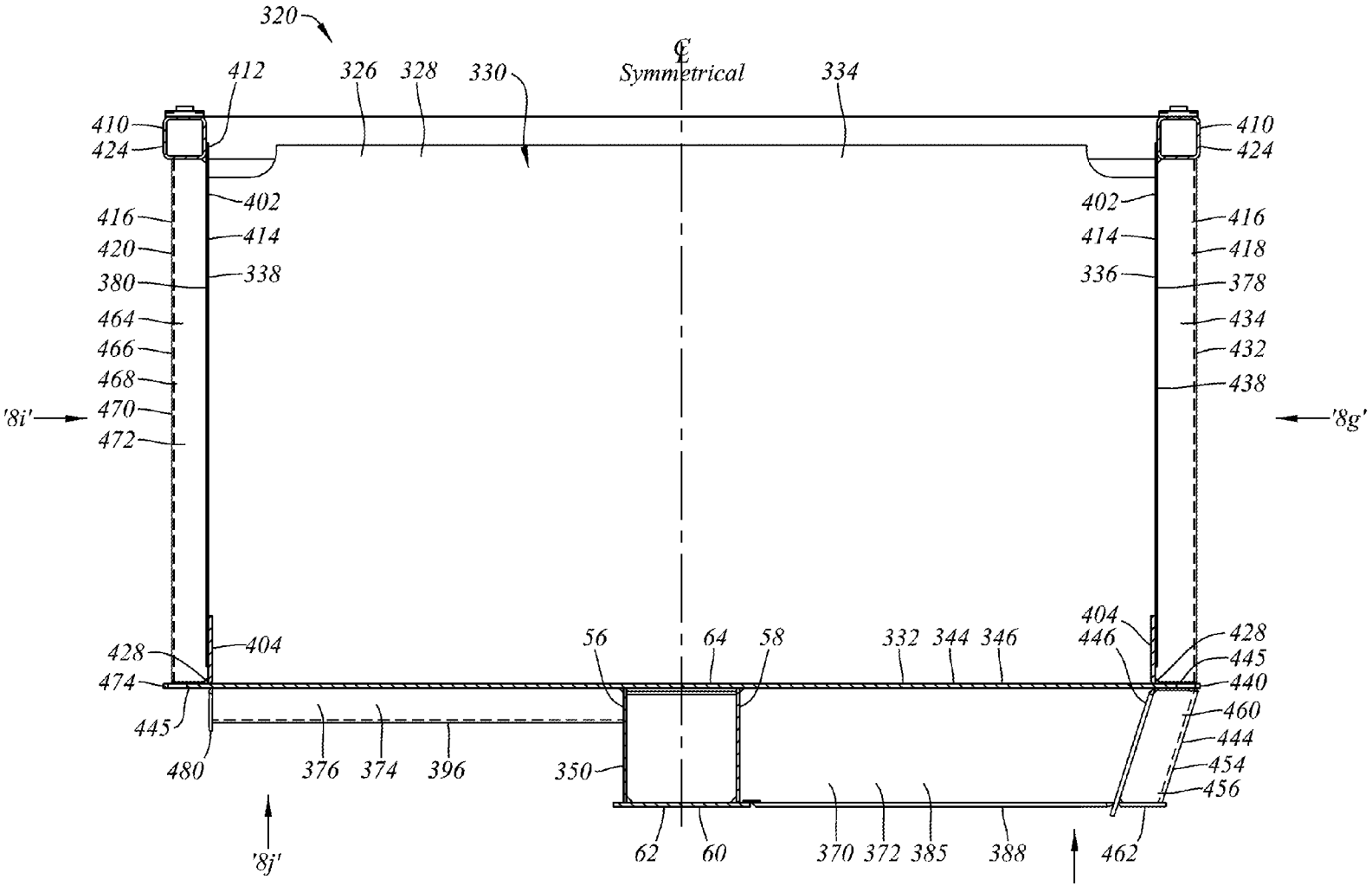
FIG. 8*b* is a right hand half cross-sectional view, in elevation, on section '8*b*-8*b*' of the railroad freight car of FIG. 8*b* looking toward a cross-bearer.
FIG. 8*c* is a left hand half cross-sectional view, in elevation, on section '8*c*-8*c*' of the railroad freight car of FIG. 8*b* looking toward a cross-tie.
Figure 8D:
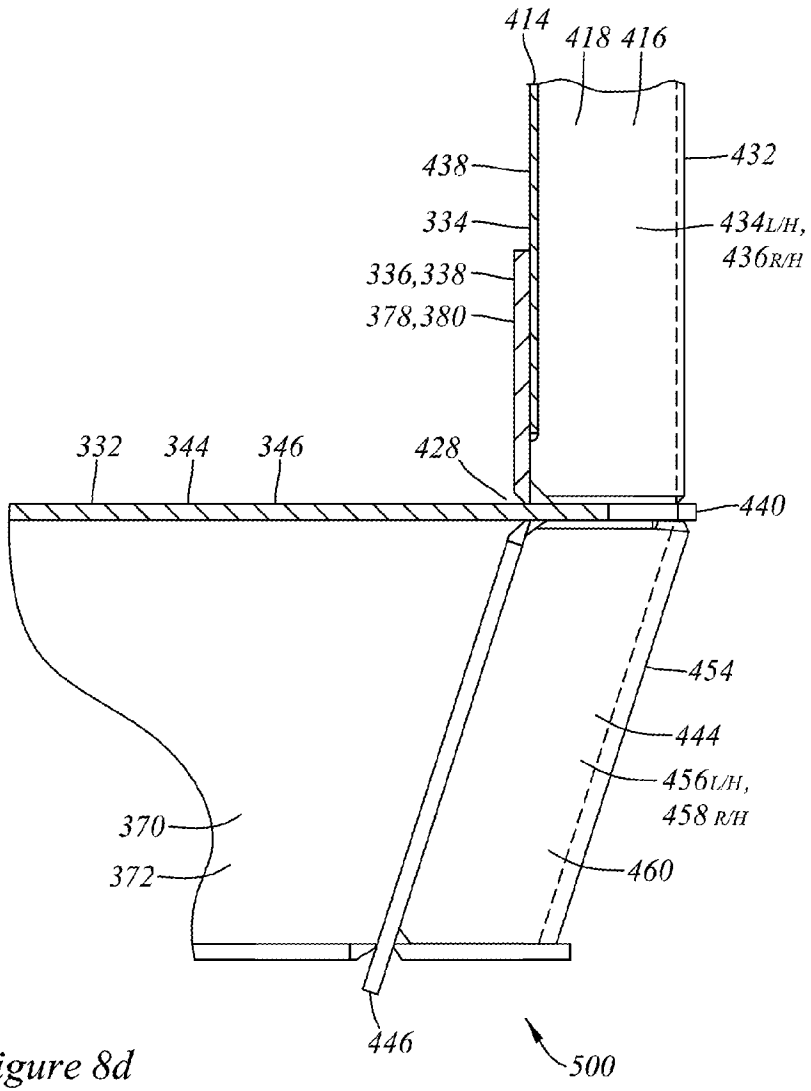
FIG. 8*d* is an enlarged detail of a cross-section of a cross-bearer to side post knee of the railroad freight car of FIG. 7*a;*
Figure 8E:
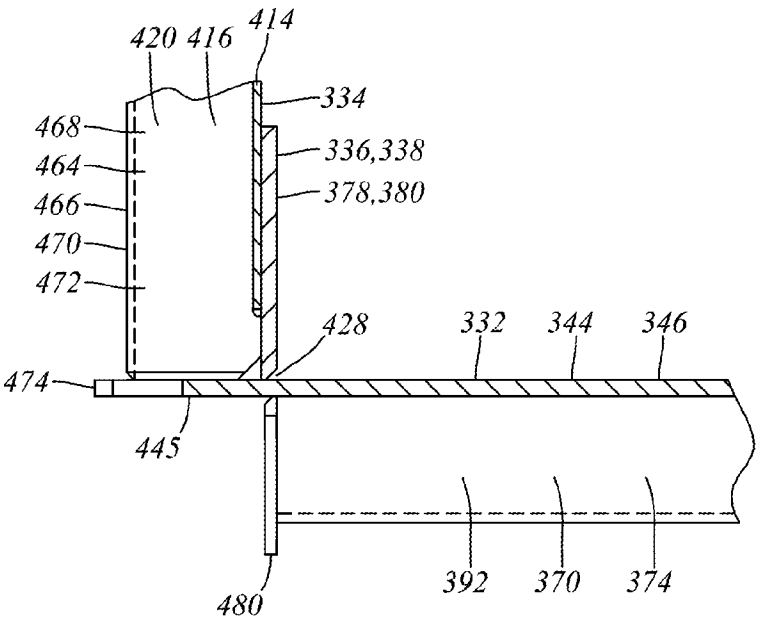
FIG. 8*e* is an enlarged detail facing toward a cross-tie to side post junction of the railroad freight car of FIG. 8*c;*
Figure 8F:
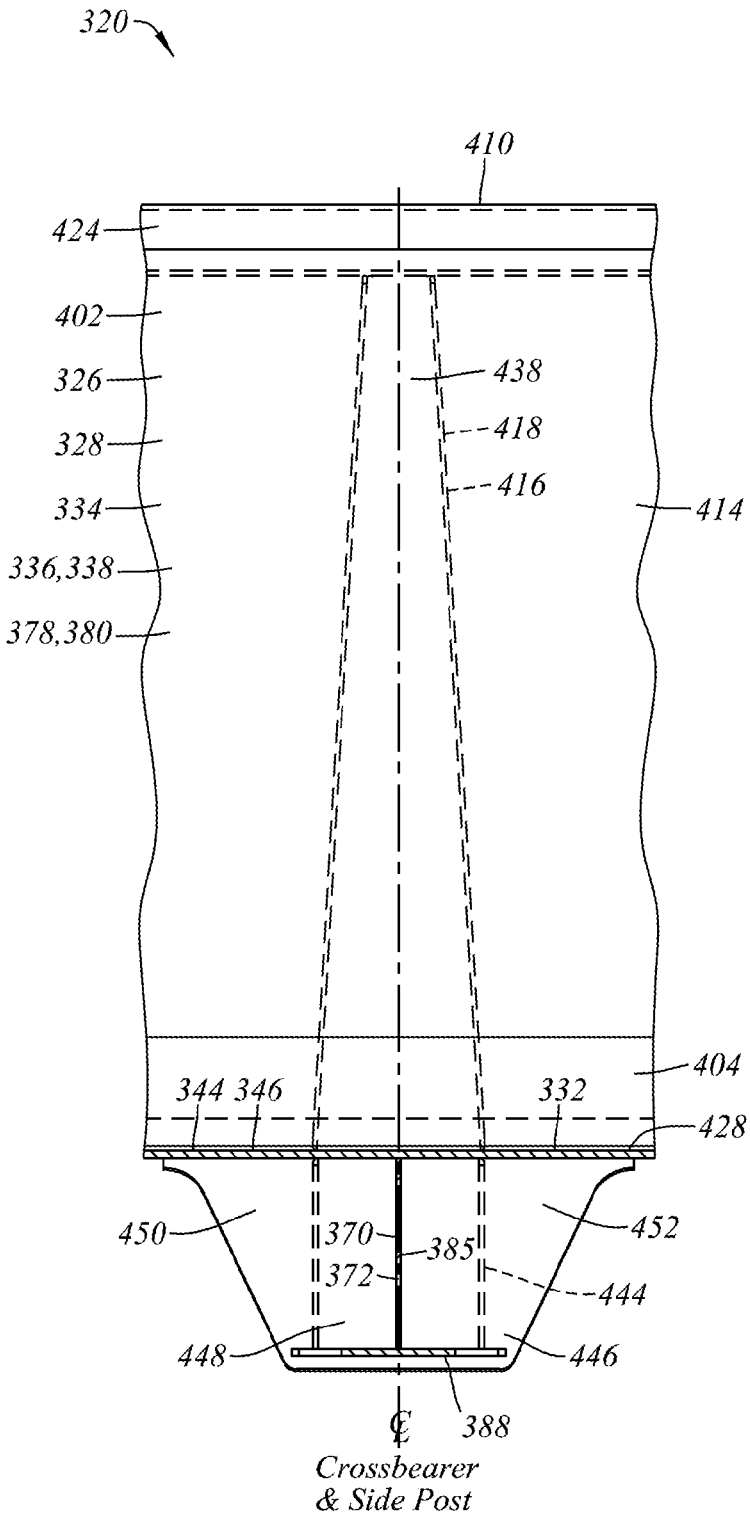
FIG. 8*f* is a view looking outboard on arrow 8*f* of FIG. 8*b;*
Figure 8G:
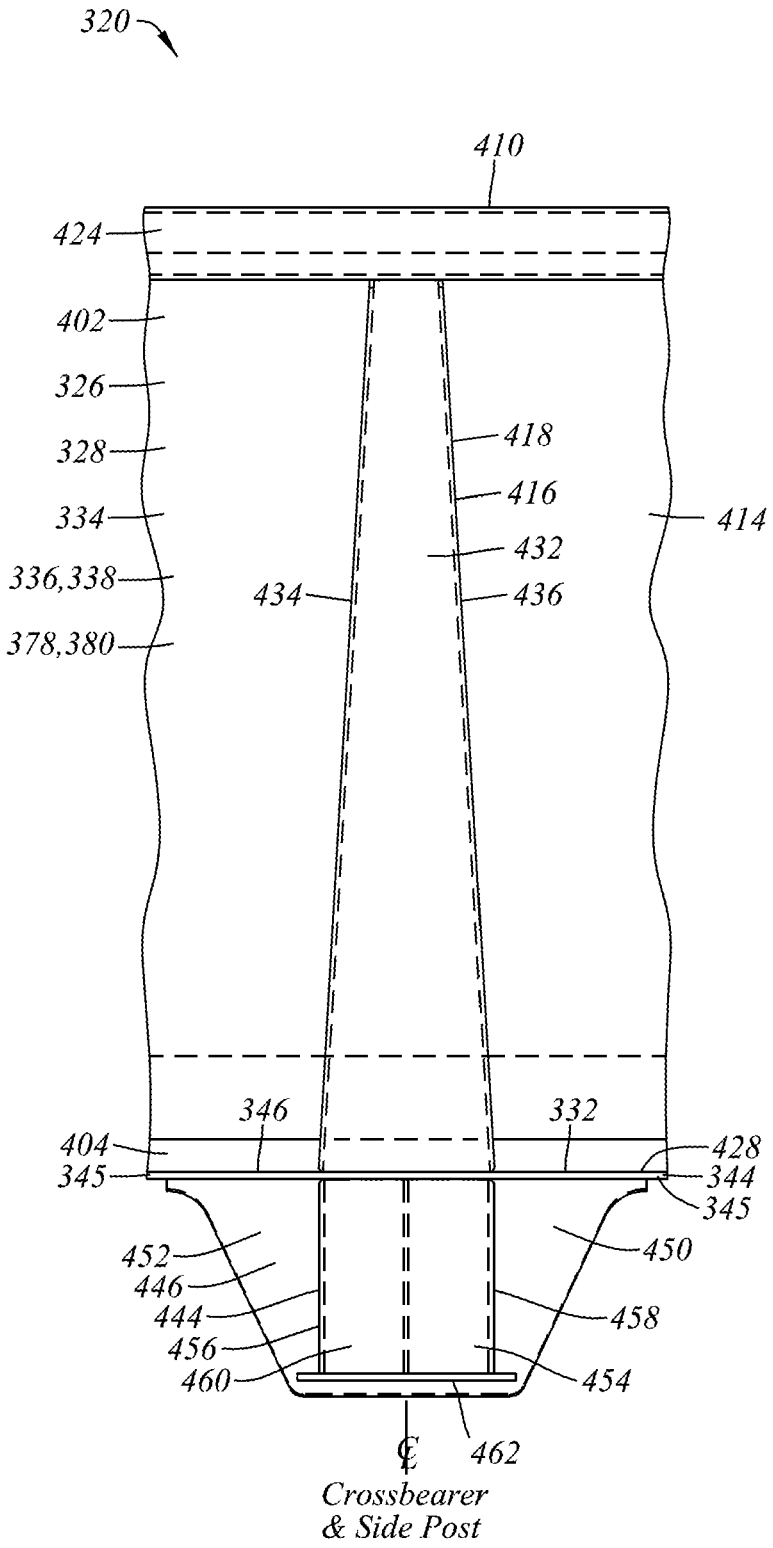
FIG. 8*g* is a view looking inboard on arrow 8*g* of FIG. 8*b;*
Figure 8H:
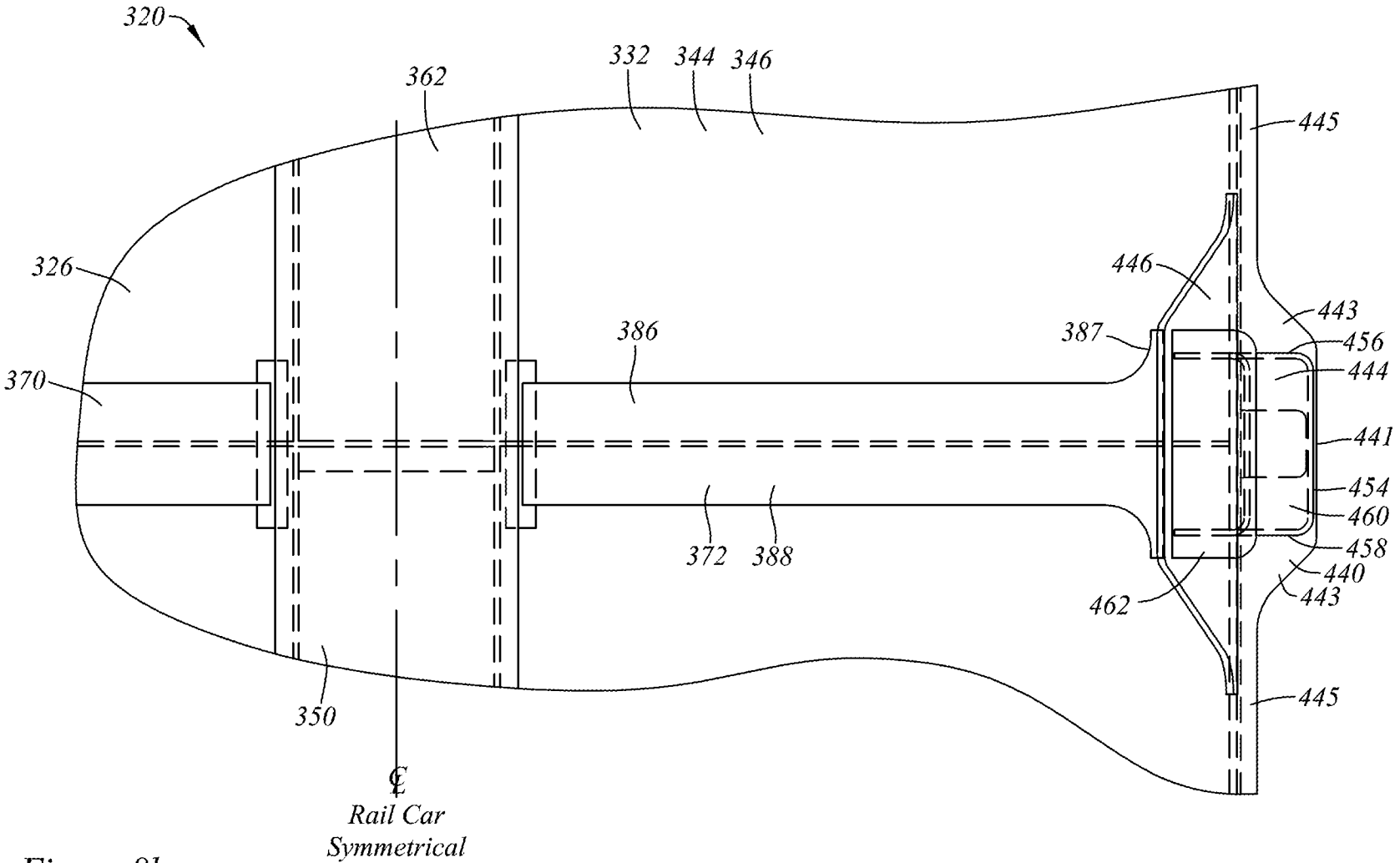
FIG. 8*h* is a scab view looking upward on arrow 8*h* of FIG. 8*b;*
Figure 8I:
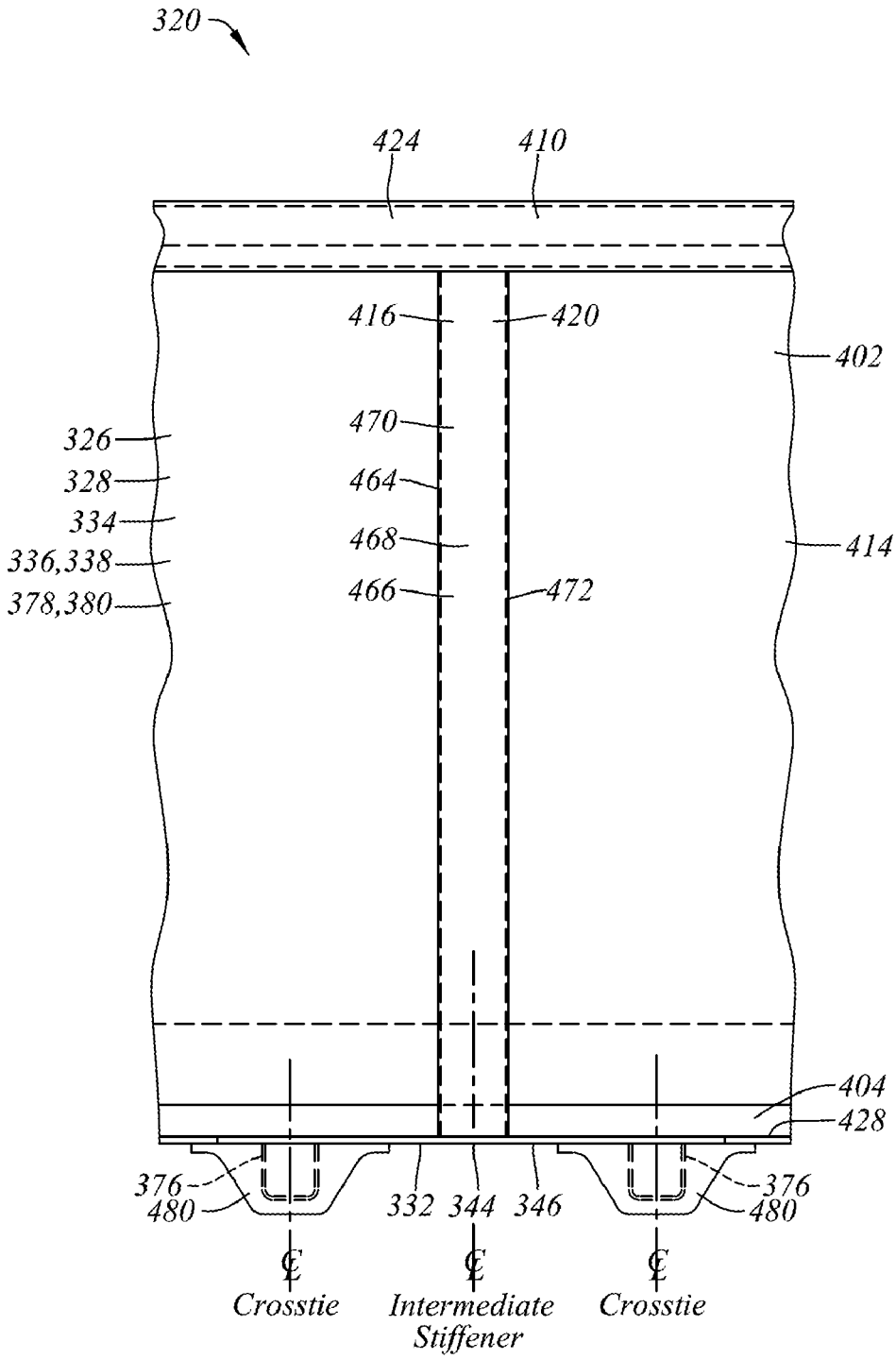
FIG. 8*i* is a view looking inboard on arrow 8*i* of FIG. 8*c;*
Figure 8J:
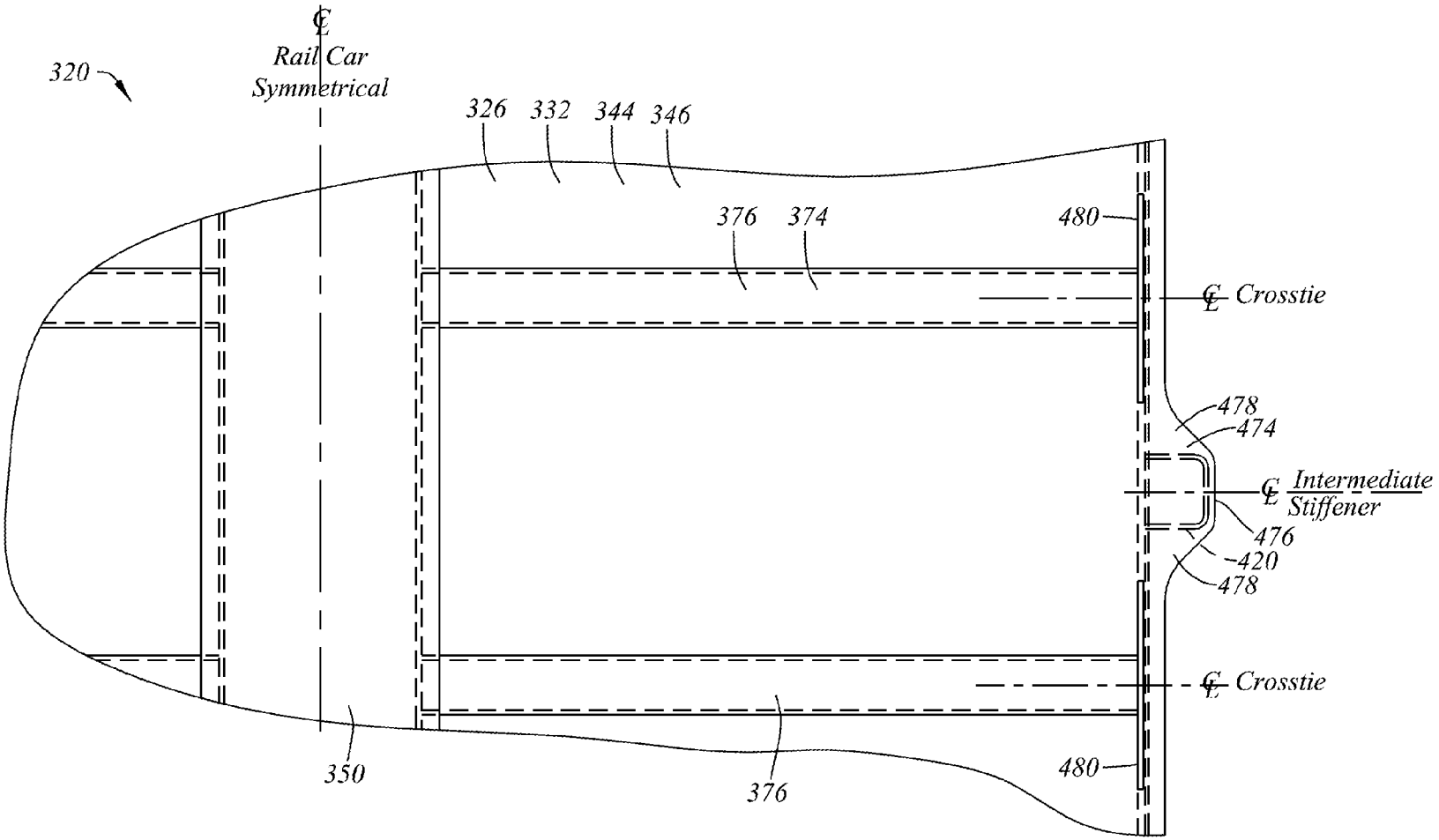
FIG. 8*j* is a view looking upward on arrow 8*j* of FIG. 8*c;*
Figure 8K:
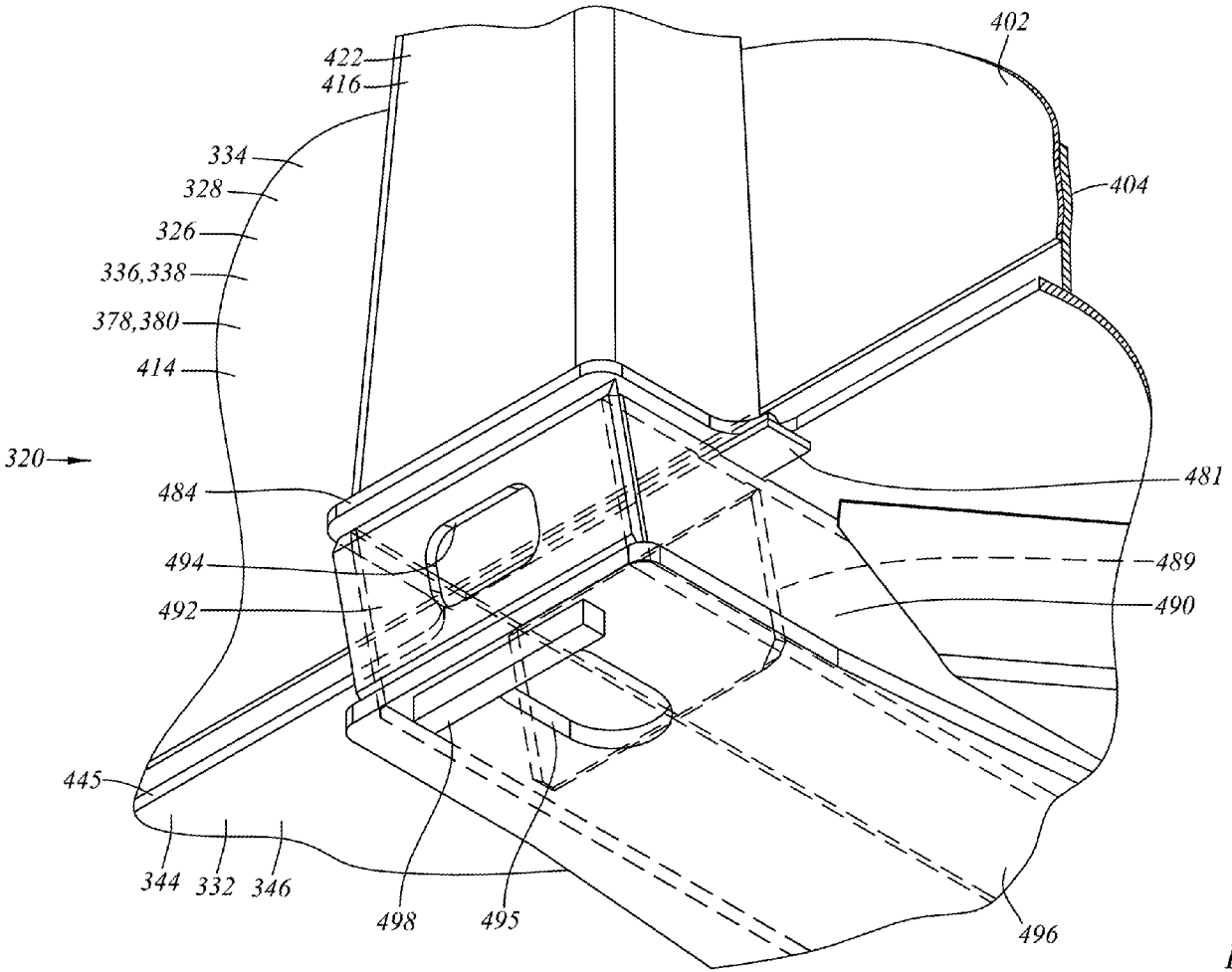
FIG. 8*k* is an isometric detail of a main bolster end connection of the railroad car of FIG. 7*a;*
Figure 8L:
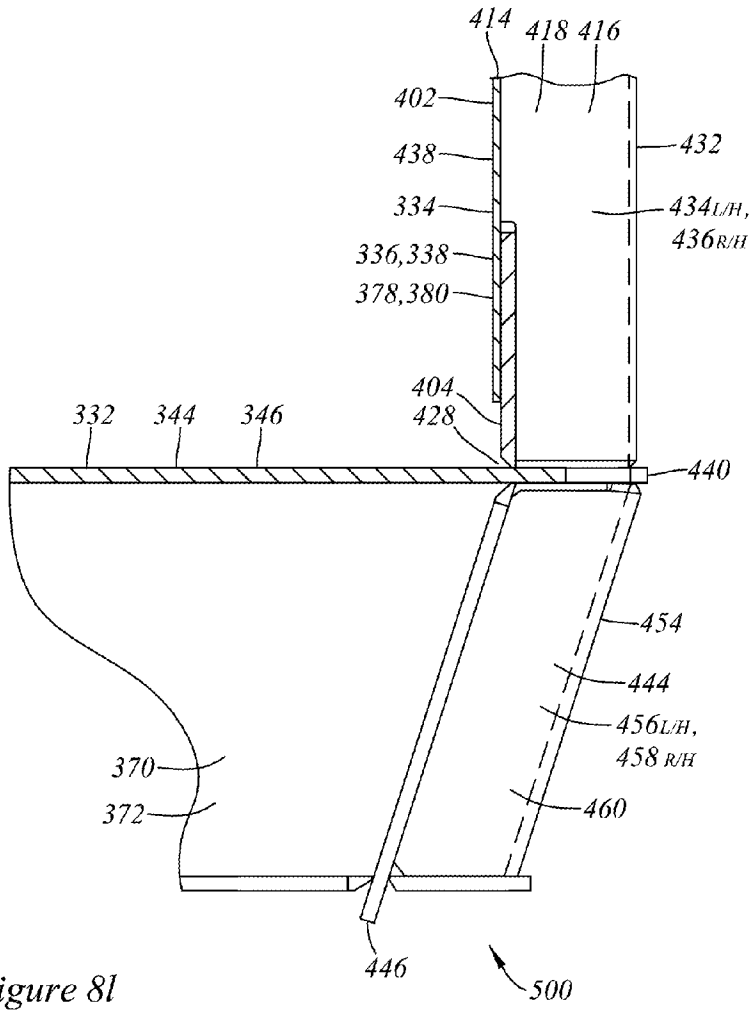
FIG. 8*l* shows an alternate arrangement of structural elements to that of FIG. 8*d;*
Figure 8M:
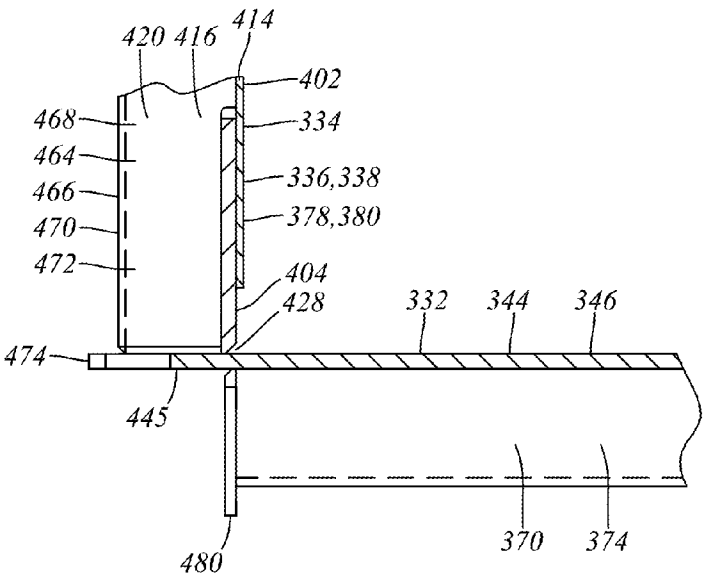
FIG. 8*m* shows an alternate arrangement of structural elements to that of FIG. 8*e;*

A structural knee 486 may also formed at the distal ends of main bolsters 382. Upright stiffeners 422 may be of substantially the same construction as stiffeners 418, although the depth of the legs may be greater. That is, the distance between the back flange and the side beam web at the main post at the longitudinal station of the main bolster may be greater than the corresponding flange spacing of the posts associated with the mid-span cross-bearers. For example, in a car having a truck center spacing in excess of 46'-3", the allowable overall width at the truck centers may be 128" whereas the maximum mid-span overall width may be less than 128" to allow for wing-out on curves. Floor panel 344 may have floor panel extensions 484 that underlie stiffeners 422 and that may be of the same nature as extensions 188 described above, being integral parts of a larger sheet, cut to the desired size. Alternatively, extensions 484 may be fabricated piecemeal, as stub plates, and welded in planar abutment to the laterally outboard margin of floor sheet 346. In FIG. 8*k* a butt weld backing bar for this alternate method of fabrication is indicated as 481. Bolster 382 may be a hollow beam having an internal web, or reinforcement 489 such as may be positioned with its upper edge opposite the lower edge of lower portion 404 of side beam web 414. Internal reinforcement 489 may be a plate that is oriented perpendicular to the long axis of bolster 382, or that may be oriented to stand in a plane substantially parallel to the plane of the bolster end wall, which may have a lifting lug 494. The underside of the bottom flange 496 of main bolster 382 may also have a lifting lug 495 and indexing, or locating bar 498 as shown.

In one embodiment, floor panel 344 may have floor panel extensions substantially the same as extensions 140, 174, 188, 440 or 474 described above. Alternatively it may be that cutting floor panel 344 (as floor panel 44) from a single sheet of stock may involve significant scrap corresponding to those pieces cut out between the floor panel extensions, such as they may be. It may be that the amount of scrap may be reduced by cutting a partial, or truncated, floor extension 486, and using an auxiliary plate 488 such as may abut partial floor extension 486, with the welded joint 487 lying outboard of the locus of the junction of the side beam with the floor plate. Similarly, the back member, first wall 454, may angle inwardly and downwardly away from the plane of back 432 of stiffener 418, rather than being co-planar therewith or lying in a parallel plane thereto. It may be that the orientation of first wall 454 may be parallel to extension 446. Side sheet extensions 492 may be positioned with their upper margins welded to floor panel 344 generally opposite the locus of mating of web 414 with floor panel 344, yet extend at an inwardly and downwardly sloping angle, rather than being co-planar with web 414. While the locus of connection may be substantially directly opposite, there may be some lateral offset distance, that distance being relatively minor.

Figure 4I:
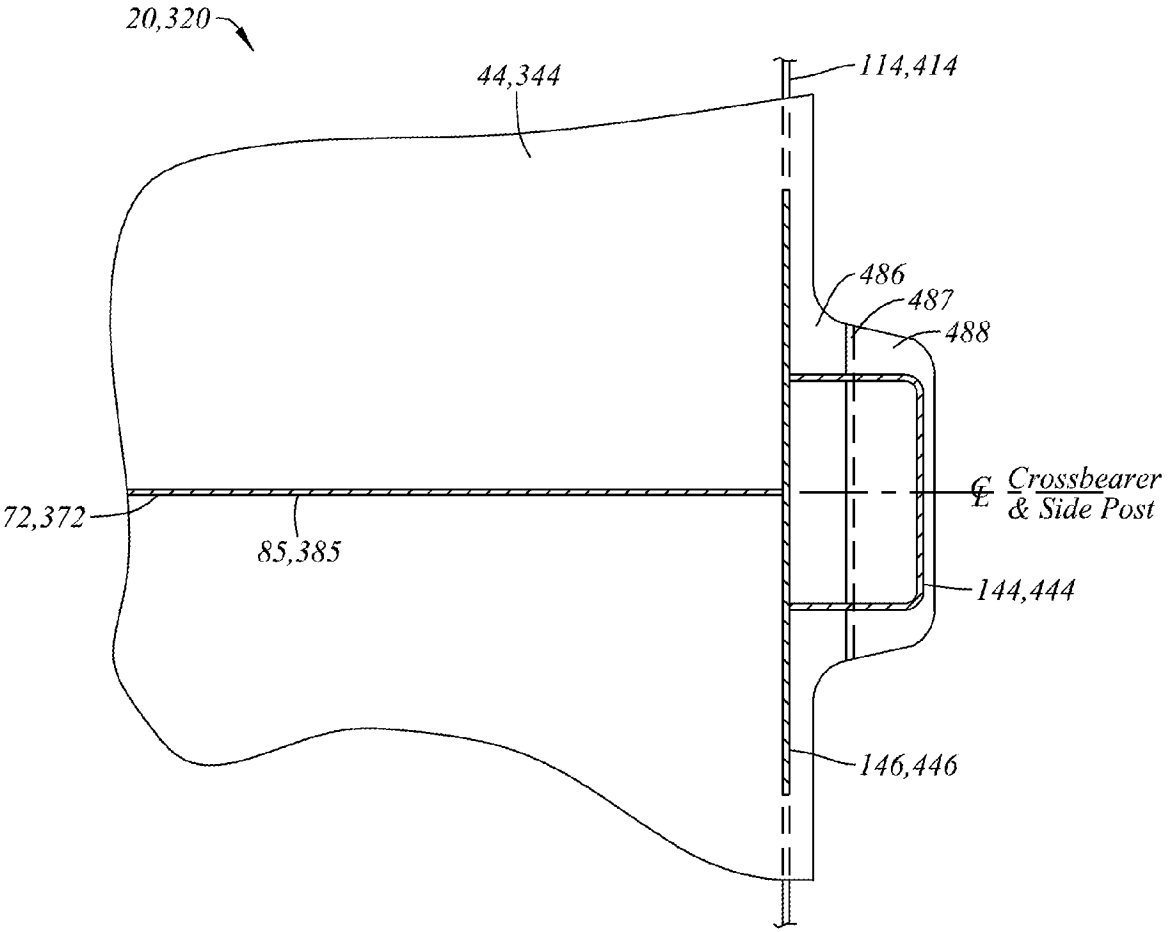
FIG. 4*i* shows an alternate embodiment to that of FIG. 4*f*, on a section immediately below floor level.

In the alternate embodiment of FIG. 4*i*, floor panel 344 may include a partial extension, finger or marginal protrusion 486 and an abutting complementary plate 488, whose combined footprint may corresponds to the footprint of extension 140, 174, 188, 440 or 474, or such other as may be, and such as may underlie an outboard mounted side beam stiffener, be it stiffener 118, 120, 122, 418, 420, 422 or such other tangency as may be. It may be that extension 486 has radiused flanks, with the outboard marginal edge being truncated at the points of tangency of the radii with the profile of the linear flanks of complementary plate 488. Joint 487 between extension 486 and plate 488 lies outboard of the junction of web 414 with floor panel 344. Welded joint 487 may, on average, be located more than an inch outboard of the locus of mating of web 414 with floor panel 344, or alternatively, more than one inch outboard of the locus of mating of such underfloor web extension of web 414 may by mounted to the underside of floor panel 344. Expressed alternatively, it may be that joint 487 is located two floor panel thicknesses, or more; outboard of the loci of connection of the relevant web 414 or web extension, or of the nearer of the two. In one embodiment that distance may be three thicknesses or more, such as may be in the range of 3 to 10 thicknesses, and such as may be in the range of 5 thicknesses. Expressed differently yet again, where the side stiffener, be it 118, 120, 122, 318, 320 or 322, has a depth at the level of the juncture with floor panel 344 from the central plane, or central fiber of, e.g., web 414 to the central plane or central fiber of the opposing back member, such as back 432 or first wall 454, joint 487 may be located more than ⅕ of that distance from the relevant locus (or loci) of, e.g., connection of web 414 or member 446 to floor panel 344, in another embodiment it may lie between ⅕ and ⅘ of that distance, and, in another embodiment may lie about ⅓ or ½ of that distance outboard.

The alternate embodiment of FIGS. 4*l* and 4*m* contrasts with the embodiment of FIGS. 4*d* and 4*e*, and is considered generally applicable to railroad car 20, 320, or 520 (described below). The side web, be it 114 or 414, may include a lower marginal member, such as member 404 described above, which is connected to the main body or immediately adjacent upper or superior portion of the web at a lap joint. It may be that member 404 may be located inboard of the main portion of the web, as in FIGS. 8*d* and 8*e*, or, alternatively, it may be located outboard as in FIGS. 4*l* and 4*m*. An outboard location may be chosen, for example, to avoid intruding upon an interior width envelope dimension between opposed webs 114, or where equipment used to fill or empty the car might tend to catch on an inwardly protruding shoulder. An inboard location may be chosen, for example, in a car having a post depth constraint. E.g., a car having truck centers over 46'-3" may have a narrower than usual width constraint due to swing out. The outside of the posts may remain within the clearance envelope, be it AAR Plate B, Plate C, or some other. Similarly, the internal lading envelope width may be fixed, thus limiting the post depth available. For a stiffener such as 118 or 418 having a moment connection to a cross-bearer, the maximum bending moment may be at the junction with the floor panel, be it 44 or 344. It may be desirable to have a relatively greater depth of section at that location, rather than a shallower depth of section, particularly if the sum of the thickness of member 404 and member 402 is a non-trivial proportion of the overall depth of section of the stiffener.

The railroad freight car 320 may have structural knees, as noted above. For the purpose of the following discussion, those knees may be identified as 500 at the junction of the cross-bearers and their associated side posts. There may be structural knees of a similar nature at the junctions of the main bolsters and their associated vertical side posts. The foregoing description of the connection of side posts (i.e., stiffener 418) to cross-bearer 372 is a description of a structural knee 500. The conceptual explanation given above in the context of knee 200 also applies to structural knee 500.

Figure 9A:
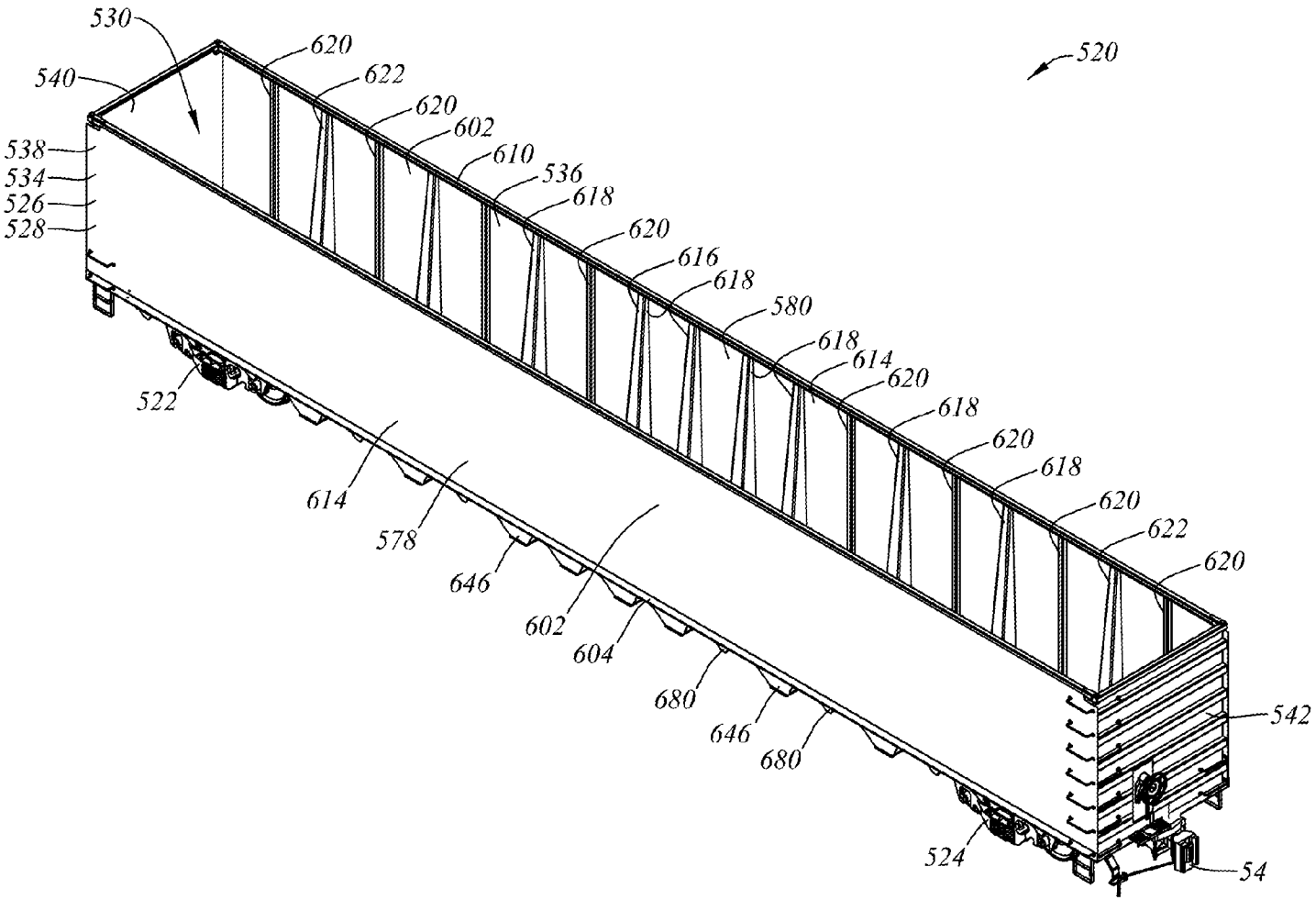
FIG. 9*a* is an isometric, general arrangement view of another alternate embodiment of railroad freight car to that of FIG. 1.
Figure 9B:
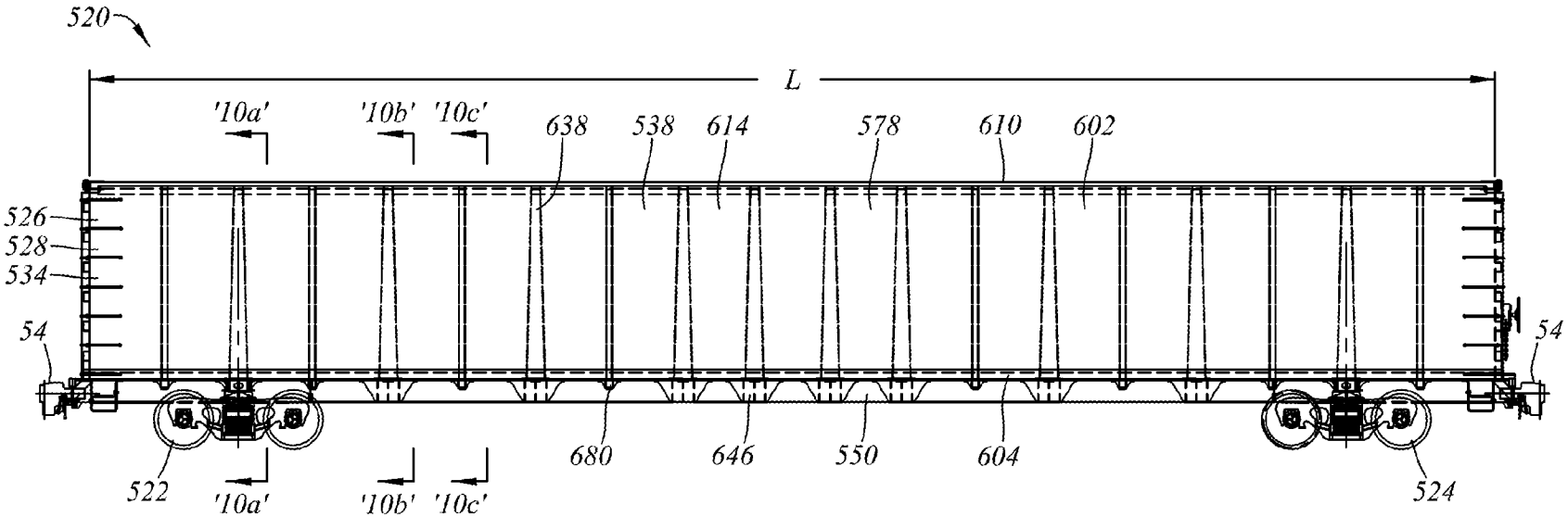
FIG. 9*b* shows a side, or elevation, view of the railroad freight car of FIG. 9*a;*
Figure 9C:
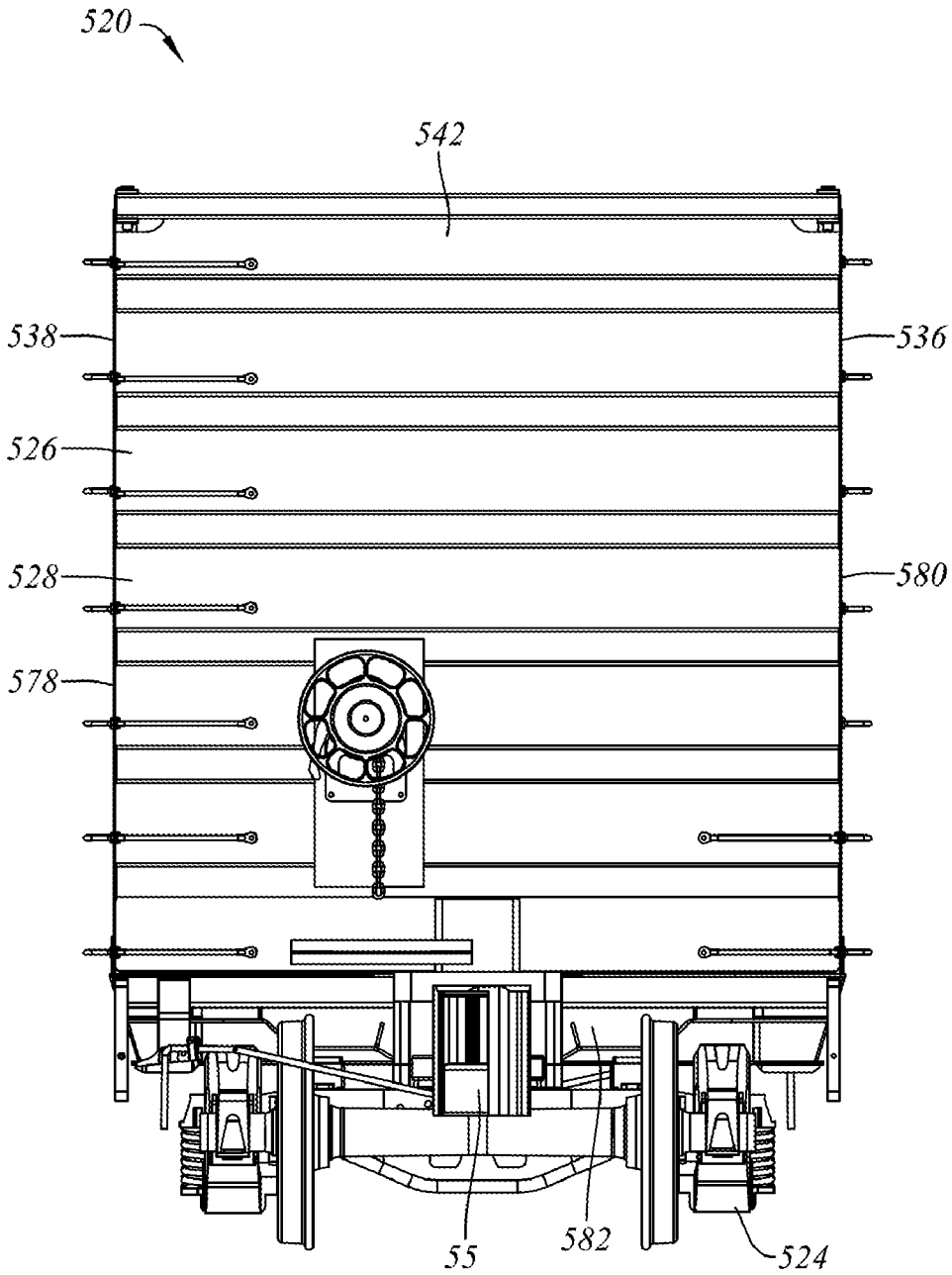
FIG. 9*c* shows an end view of the railroad freight car of FIG. 9*a;*

Embodiment of FIG. 9*a*

FIG. 9*a* shows an isometric view from above and to one corner of an example of a railroad car 520 that is intended to be generically representative of a wide range of railroad cars, and in particular railroad freight cars, in which the present invention may be incorporated. While car 520 may be suitable for many different uses, it may in one embodiment be a gondola car, which may be used for the carriage of scrap steel. With the exception of brake fittings, safety appliances and other secondary fittings, car 520 is substantially symmetrical about both its longitudinal and transverse, or lateral, centerline axes. Consequently, where reference is made to a first or left hand side beam, or first or left hand bolster, it will be understood that the car has first and second, left and right hand side beams, bolsters and so on.

Railroad car 520 has a pair of first and second trucks 522, 524, and a rail car body 526 that is carried upon, and supported by, trucks 522, 524 for rolling motion along railroad tracks in the manner of railroad cars generally. Rail car body 526 may include a wall structure 528 defining a lading containment receptacle 530. Wall structure 528 may include a base wall, which may be in the nature of a floor or flooring 532, and a generally upstanding peripheral wall 534 which may include a pair of first and second side walls 536, 538, and first and second end walls 540, 542. Flooring 532, sidewalls 536, 538 and first and second end walls 540, 542 may tend to define an open topped box, namely receptacle 530, into which lading may be introduced. Generally speaking, car 520 may be of all steel, or predominantly steel construction, although in some embodiments other materials such as aluminum or engineered polymers or composites may be used for some or a predominant portion of the containment receptacle structure.

Flooring 532 may include a floor panel 544. Floor panel 544 may be made of a plurality of floor sheets joined together, in an abutting fashion such as may yield a continuous lading containing surface, or, in one embodiment, may be made from a single, monolithic steel sheet 546. Steel sheet 546 may be a single sheet having its profile cut from a monolithic sheet of stock by a plasma arc cutting device. Body 526 of car 520 may include an underframe member such as a longitudinally running center sill 550. Center sill 550 may have draft sills, or draft sill portions at either end, into which draft gear fittings 52 and releasable couplers 54 may be mounted. Center sill 550 may be fabricated in the same manner as center sill 50, above.

Figure 10A:
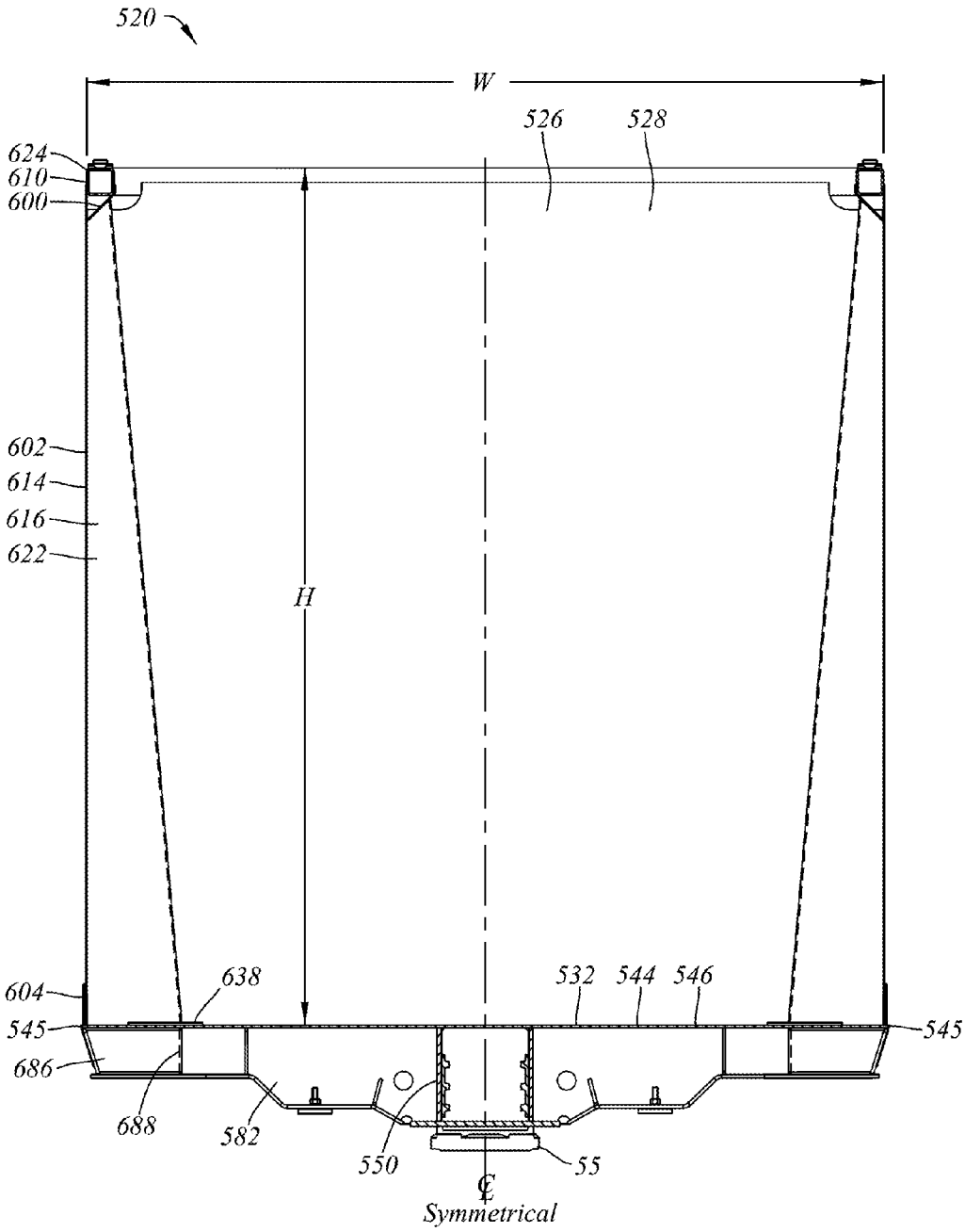
FIG. 10*a* is cross-sectional view, in elevation, on section '10*a*-10*a*' of the railroad freight car of FIG. 9*b* looking toward the main bolster with the truck removed.
Figures 10B, 10C:
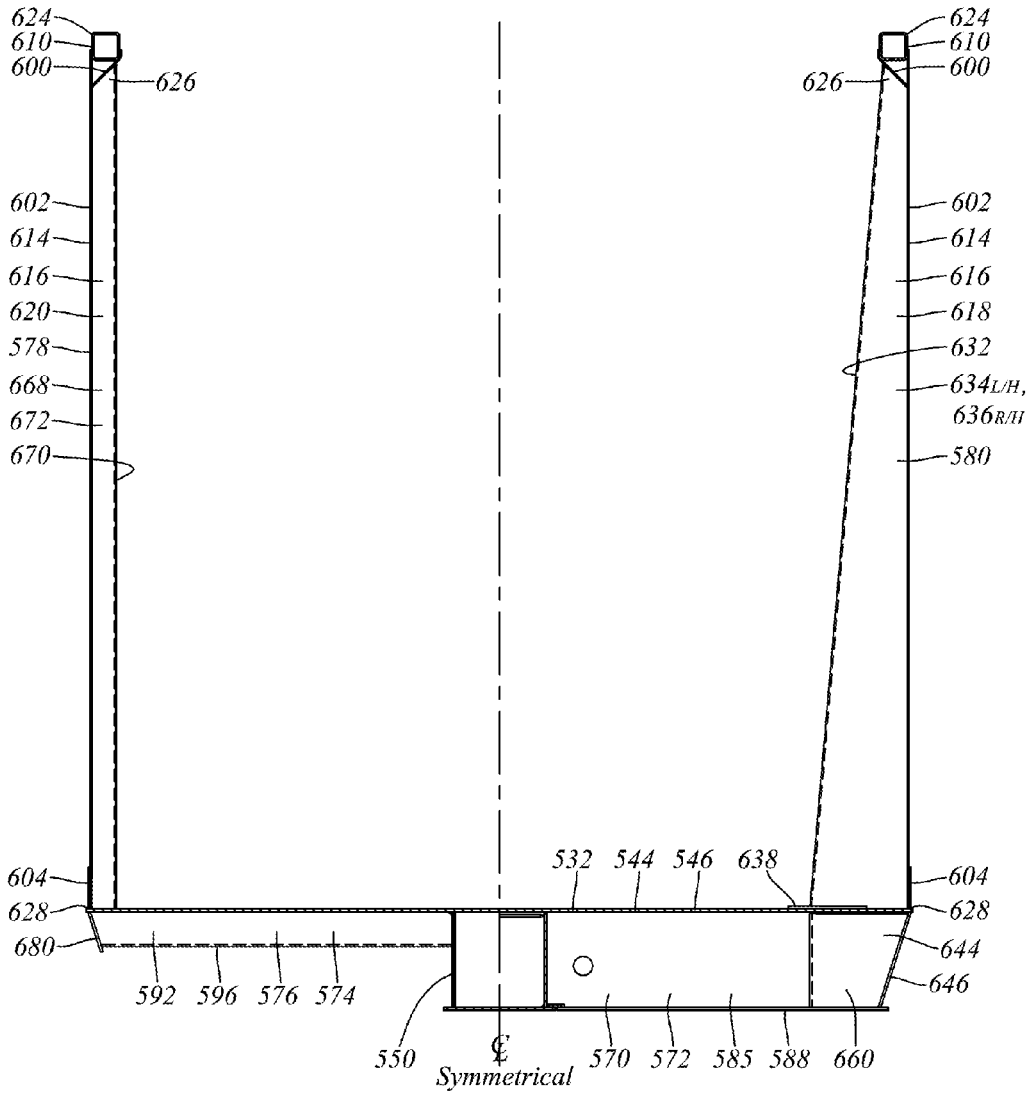
FIG. 10*b* is a right hand half cross-sectional view, in elevation, on section '10*b*-10*b*' of the railroad freight car of FIG. 2*a* looking toward a cross-bearer.
FIG. 10*c* is a left hand half cross-sectional view, in elevation, on section '10*c*-10*c*' of the railroad freight car of FIG. 2*a* looking toward a cross-tie.
Figure 10D:
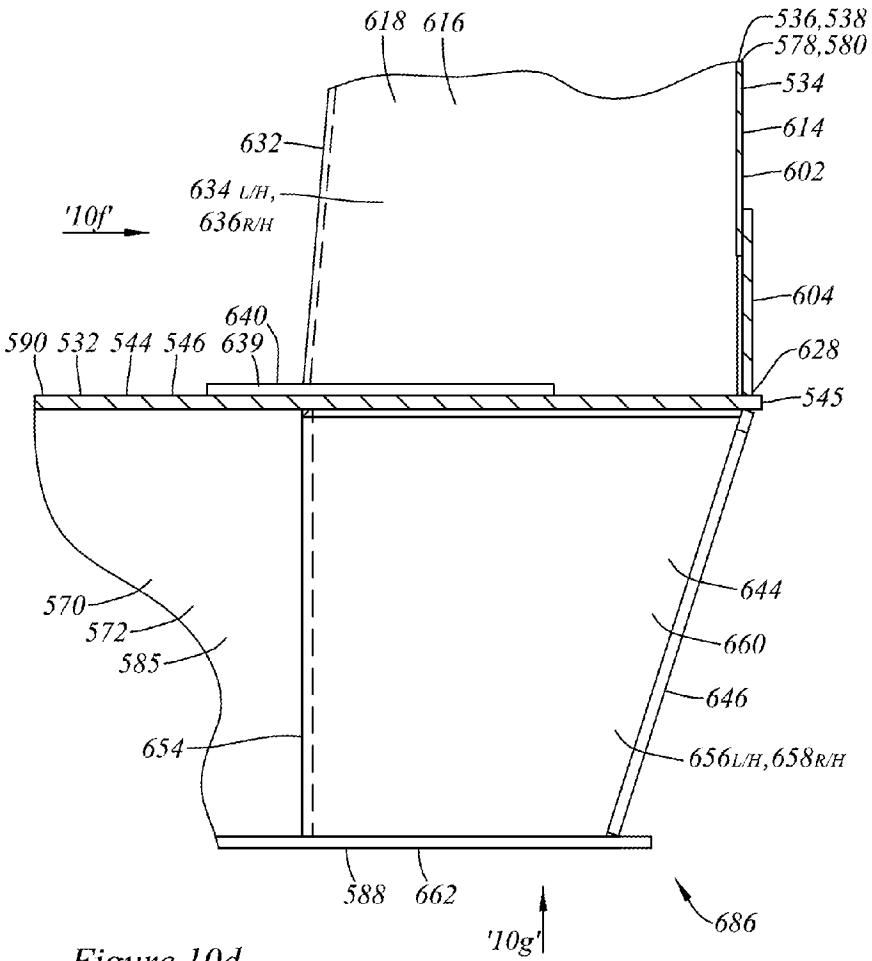
FIG. 10*d* is an enlarged detail of a cross-section of a cross-bearer to side post knee of the railroad freight car of FIG. 10*b;*
Figure 10E:
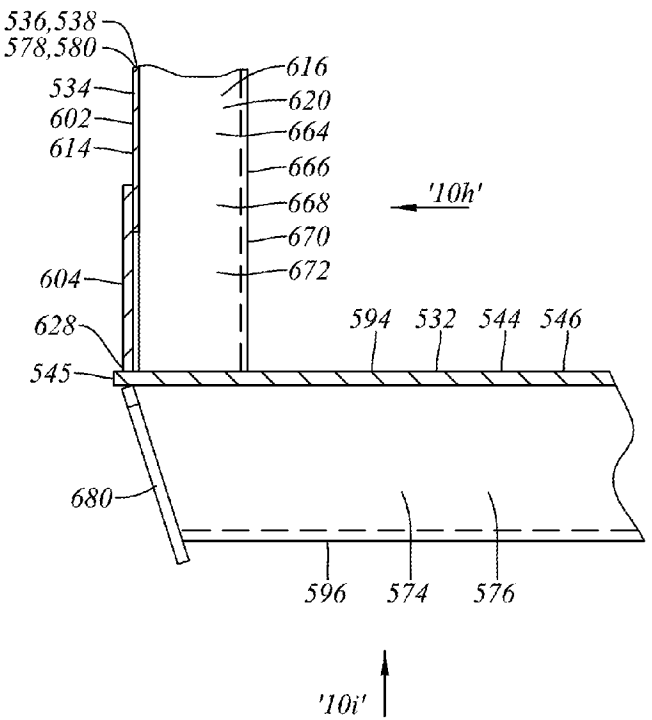
FIG. 10*e* is an enlarged detail facing toward a cross-tie to side post junction of the railroad freight car of FIG. 10*c;*
Figures 10F, 10H:
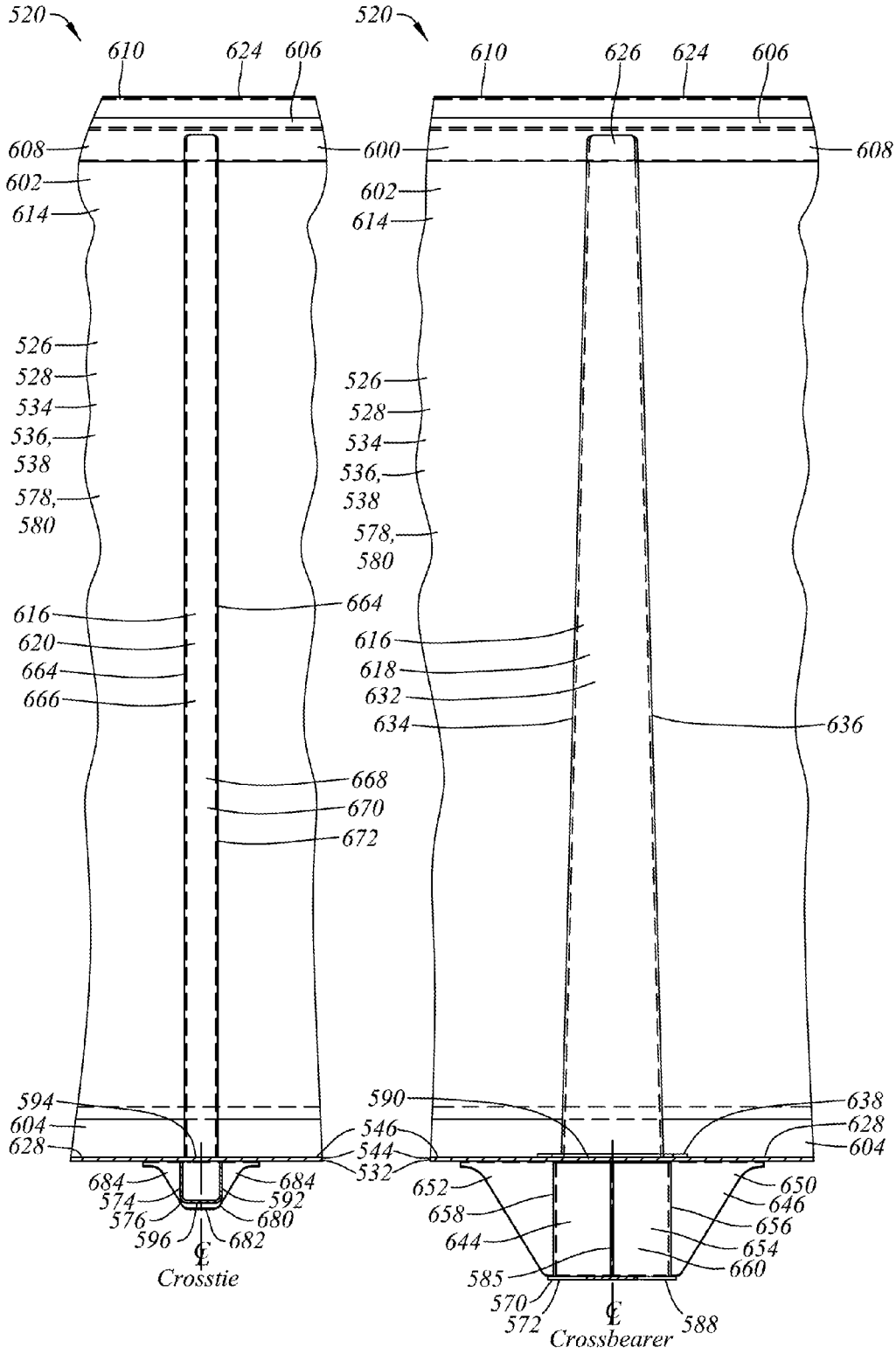
FIG. 10*f* is a view looking outboard on arrow 10*f* of FIG. 10*d;*
FIG. 10*h* is a scab view looking outboard on arrow 10*h* of FIG. 10*d;*
Figure 10I:
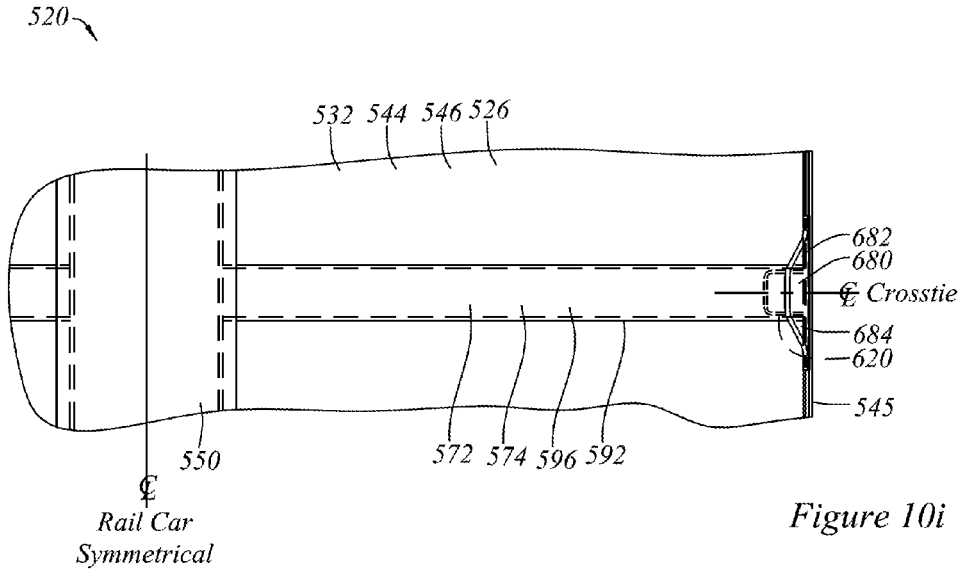
FIG. 10*i* is a view looking upward on arrow 10*i* of FIG. 10*e;*
Figure 10G:
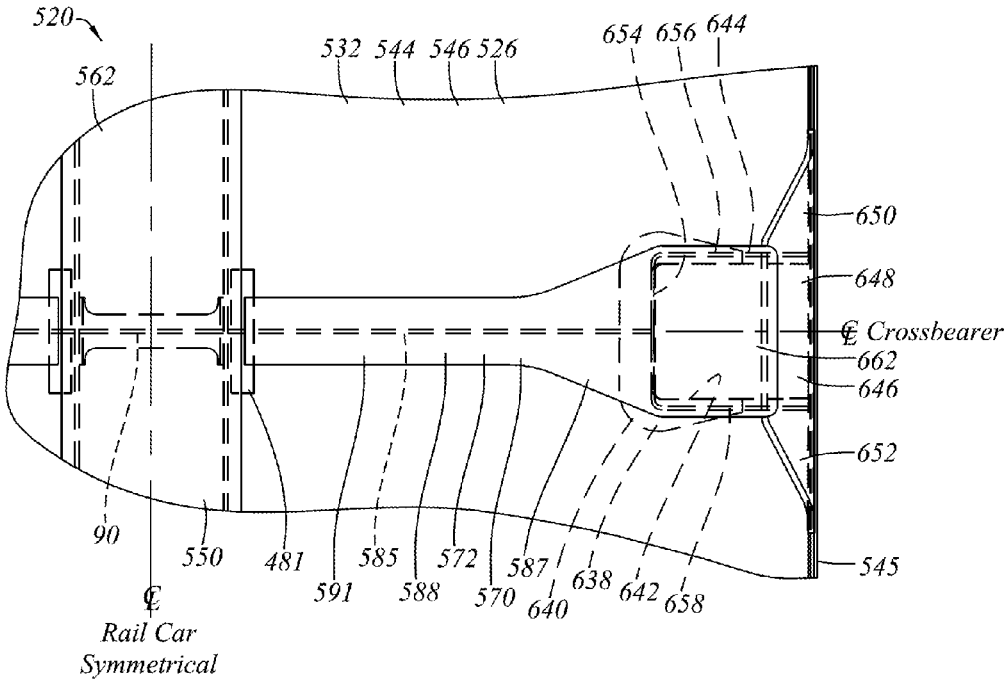
FIG. 10*g* is a view looking inboard on arrow 10*g* of FIG. 10*d;*
Figure 10J:
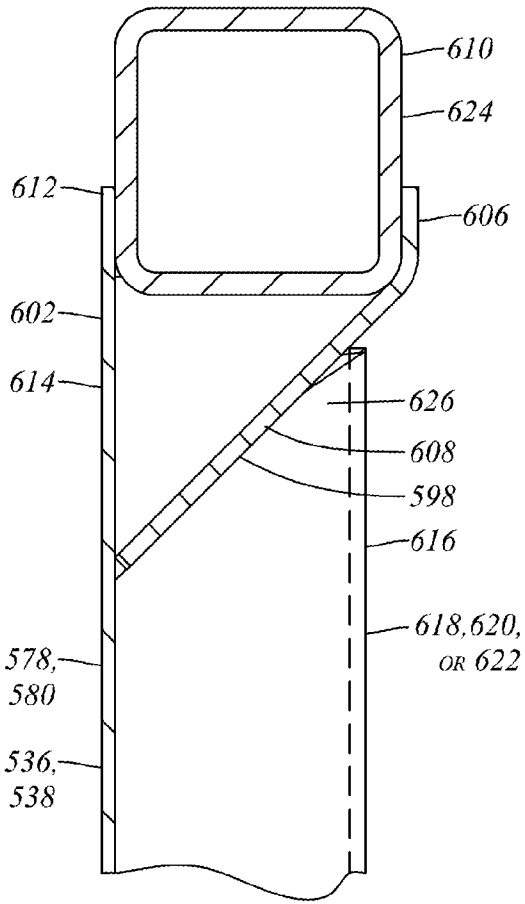
FIG. 10*j* is an enlarged detail of two different embodiments of the top chord of the railroad freight car of FIG. 10*a*.
Figure 10J:
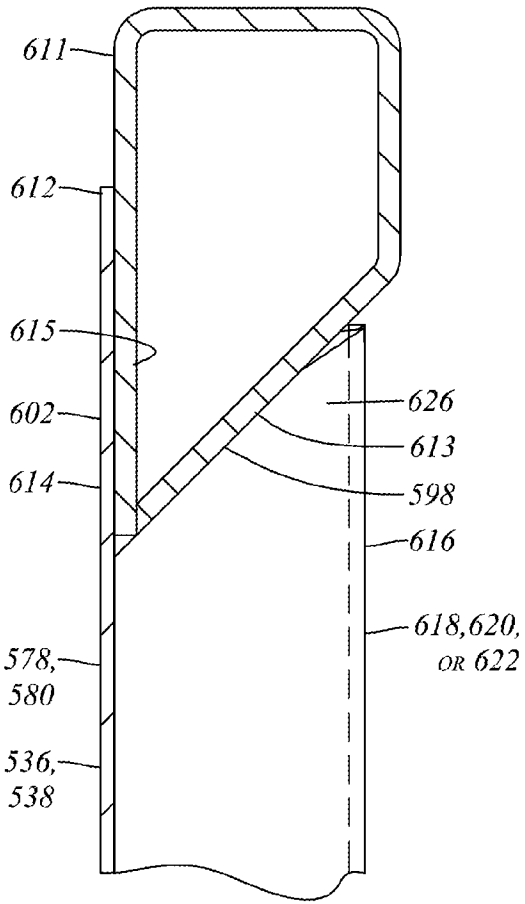
Figure 10K:
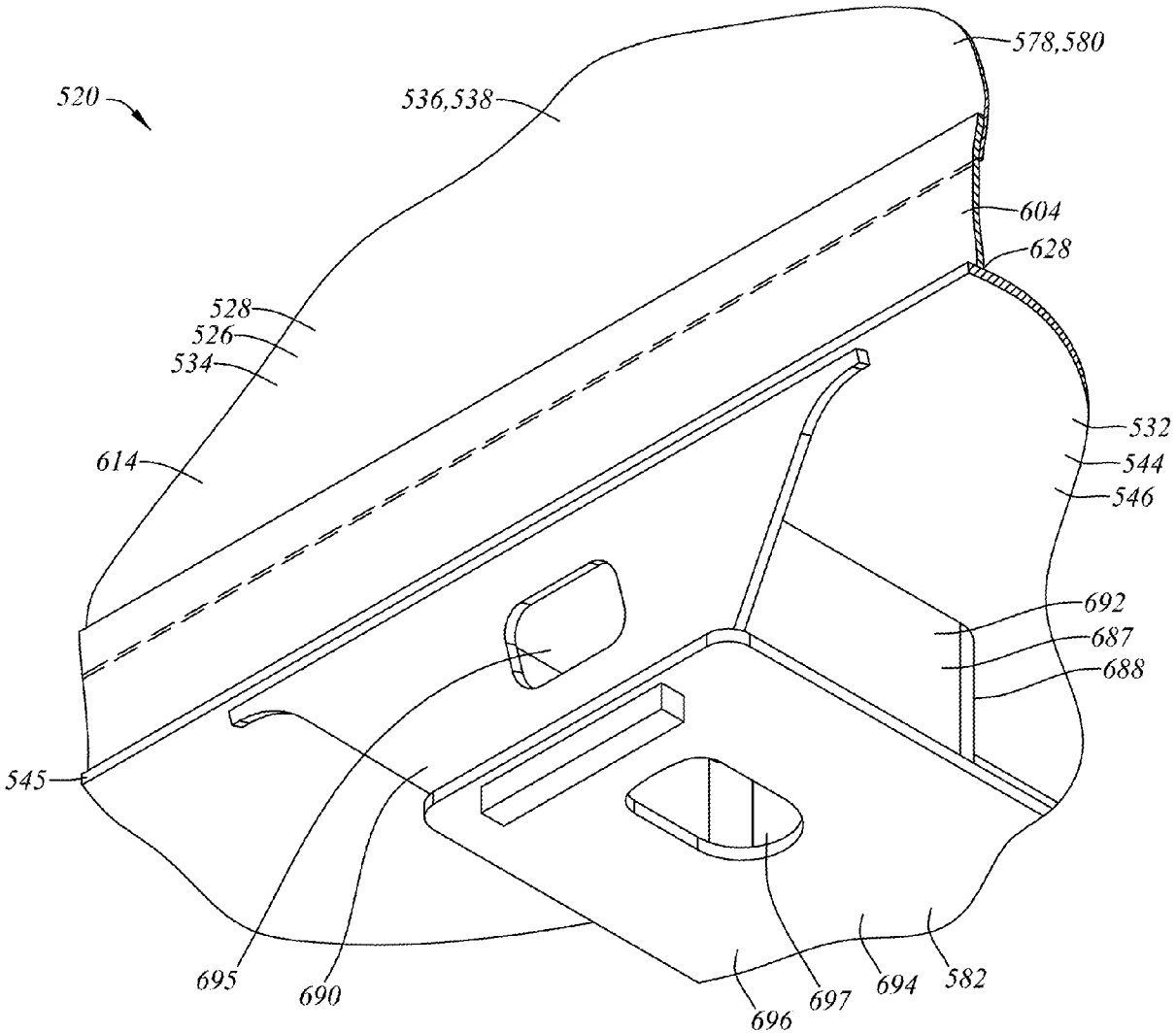
FIG. 10*k* is an isometric detail of a bolster end connection of the car of FIG. 9*a*.
Figure 10L:
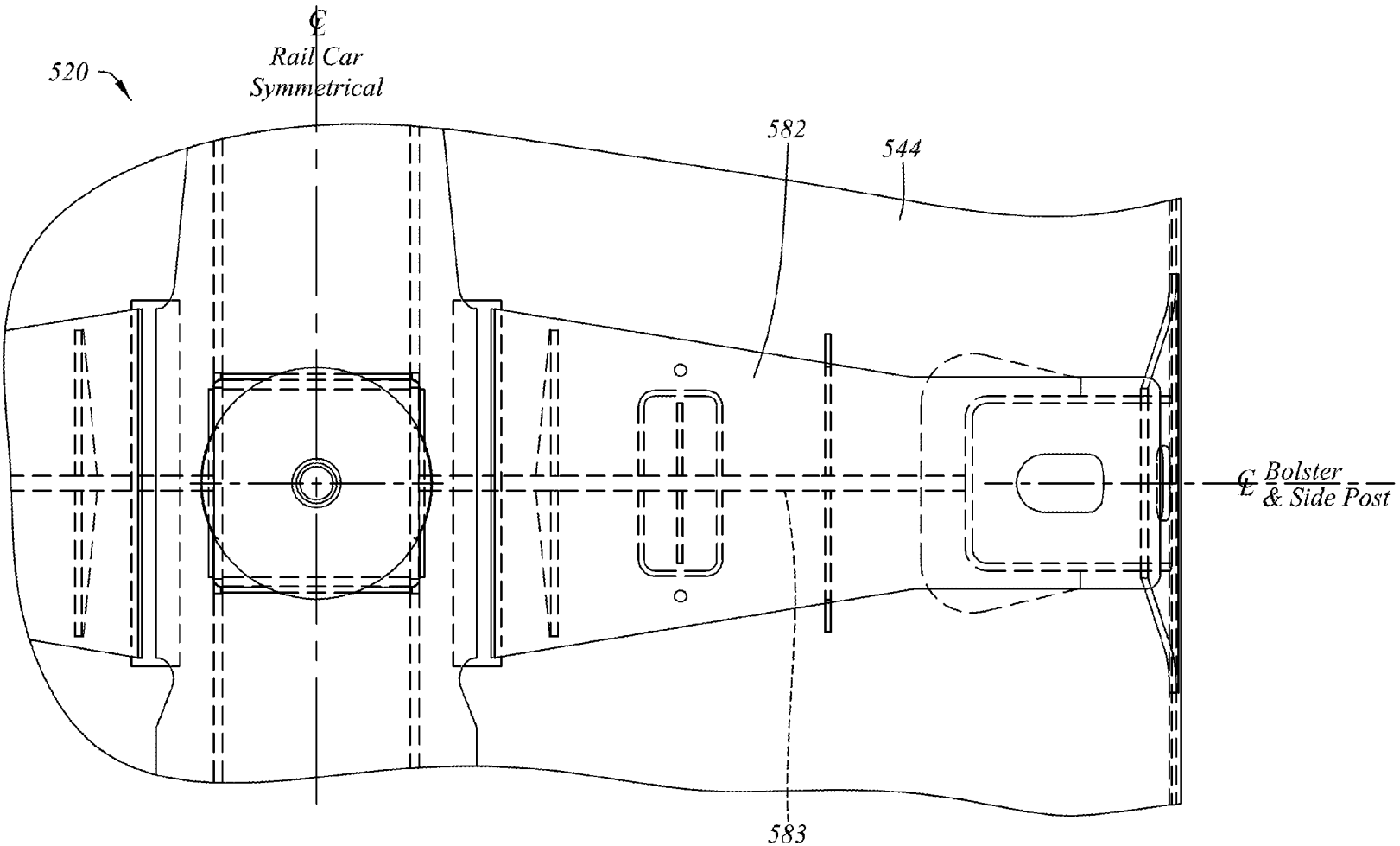
FIG. 10*l* is a view from below of the bolster of FIG. 10*k*.

Railroad car 520 may also include an array 570 of cross-bearers 572 and may include an array 574 of cross-ties 576. Car 520 may include longitudinally extending first and second side beams 578, 580 analogous to side beams 78 and 80 described above. Each cross-bearer 572 extends between center sill 544 and a respective one of side beams 578 or 580. Each cross-bearer has a moment connection at both ends (i.e., at center sill 550, and at the side beam, be it 578 or 580. Each cross-tie 76 extends between center sill 550 and one or other of side beams 578, 580. The junctions of the cross-ties with the center sill and the side beams may, conservatively, be analyzed as pin joints as noted above. Car 520 may also have main bolsters 582 that extend laterally from center sill 550 to side beams 578, 580, at the locations of the truck centers (CL Truck). Each cross-bearer 572 may include a web 585, and a bottom flange member 588. Bottom flange member 588 may include a flared or broadened laterally outboard end portion 587, and a narrower more laterally inboard portion 591 extending to mate with center sill bottom flange cover plate 562 in flange continuity. Web 585 may abut floor panel 544 directly, and be connected directly thereto by such means as welding. Each cross-tie 576 may have a single web 592, or more than one web 592. Each web 592 extends downwardly from floor panel 544. A bottom flange 596 is welded across, and along, the bottom margins of the web, or webs, 592 as may be. As with cross-bearers 572, the web or webs 592 of cross-ties 576 may abut floor panel 544 directly, without the intervention, or addition, of a top flange or cover plate, other than floor panel 544. As such, any shear flow may tend to flow directly from one to the other. Floor panel 544 may tend to define the upper flanges of both cross-bearers 572 and cross-ties 576. As discussed above in the context of the top flange of center sill 544, the effective cross-bearer upper flange region 590 of cross-bearer 572 and upper flange region 594 of cross-tie 576 may have an effective width of the order of 40-60 times the thickness of the floor panel sheet, and may for convenience sometimes be taken as being 44-48 times that thickness where there is a single web, and that much plus the web spacing where there are two webs. As shown in FIG. 10*k*, floor panel 544 may also overlie main bolsters 582. Each main bolster may have an upper flange, webs, and lower flange, side bearing fittings and so on. The main bolster intersects center sill 550 at the truck centers Main bolster 582 may have arms that have the form of hollow rectangular or box-beam sections. Alternatively, main bolster 582 may have a single central web 583. A center plate 55 may be mounted to center sill 550 at this junction.

It may be that, in one embodiment, cross-bearers 572 and cross-ties 576 alternate. Alternatively, it may be that the cross-bearers 572 and cross-ties 576 do not alternate in a one-for-one manner. It may be that a greater volumetric capacity may be obtained by placing the vertical stiffeners 616 inside web 614, rather than outside. It may also be that car 520 may have a greater than usual length to width aspect ratio. For example, the overall inside receptacle may be designated as length L; the width at the mid-span section as width W between the inner faces of webs 614 of beams 578 and 580; and the height from the floor plate to the top of the top chord as height H. The ratio of L:W may be greater than 6:1, and in some instances greater than 8:1. It may be that the ratio of H:W is greater than 0.8:1, and may exceed 1:1.

It may also be that rather than having one or more laterally extending internal bulkheads or partitions within the body of the wall structure defining receptacle 530 more generally, it may be that a clear space is obtained, free of, or substantially free of, internal lateral partitions or other laterally extending obstructions. For a high aspect ratio car, with relatively tall sides, the resistance of the top chord (and of the associated side beam web 414) to lateral deflection at the mid-span station may not be overly great, or may not be as great as might otherwise be desirable. To that end, rather than employ laterally extending bulkhead to tie the top chords laterally, in some embodiments car 520 may employ springs. Those springs may be cantilever springs, such as may be defined by the co-operative effort of cross-bearers 572 and their associated vertical side-posts 618, in which the side-posts are connected to the outboard ends of the cross-bearers at moment connections in the nature of structural knees as described herein. Inasmuch as the location of greatest compliance to lateral deflection may tend to be the mid-span location, it may be that the additional spring stiffness may be more concentrated near the central section of the side beam than at the end sections. That is, either in terms of number of springs, or in terms of average spring rate per unit of length of side beam, the auxiliary resistance to lateral resistance of the top chord may be more densely concentrated at the mid-span location than toward the ends of the car. In one embodiment that may mean that two cross-bearers (and their associated moment connected side posts) are placed adjacent to each other without an intermediate cross-tie (with or without an associated side-post). It may mean that more than two cross-bearers (and their associated side-posts) are located side-by-side without intermediate cross-ties. In one embodiment there may be four such cross-bearer and side post sets arranged one beside the other without intervening cross-ties. Those multiple side-by-side cross-bearer and post sets may be located near to the mid-span cross-section of the car, and may be located symmetrically with respect to that cross-section.

Side Beam Construction

Side beams 578 and 580 are substantially identical in structure. Hence a description of side beam 580 may also be taken as a description of side beam 578. Side beam 580 may include a top chord member 610, and may have a generally upstanding web 614. An array of vertical stiffeners 616 may be mounted to web 614 at longitudinally spaced locations along side beam 580. Vertical stiffeners 616 may include a first array, or sub array, of stiffeners 618 mounted at locations for structural co-operation with (and typically abreast of) the cross-bearers, and another array, or sub-array, of stiffeners 620 for structural co-operation with (and typically abreast of) the cross-ties 576. There may also be vertical stiffeners 622 abreast of, and for co-operation with, the main bolsters 582.

Top chord member 610 may tend to function as the top flange of the side beam 580 (or 578, as may be), and may have a formed cross-section. The cross-section may be that of a structural angle, or it may be that of an I-beam or wide flange beam, or it may be a specialty formed section, such as a bulb angle, or it may be a channel, or it may be a closed hollow section, such as a rectangular or square steel tube 624. Top chord member 610 may include one or more doublers along part or all of the upper portions thereof, such as a central, or mid-span portion corresponding to the location of greatest bending moment due to vertical lading loads in the gondola.

In some embodiments, car 520 may be employed to carry materials that may tend to foul or grapple the inside of the car. For example, steel scrap may have sharp edges or protrusions. When the scrap is extracted from the car using an electromagnet, the protrusions may tend to wish to ride up the inside walls of the car body, and may have a tendency to grapple, impact, or tear at, the underside of the top chord. This may not be desirable.

In some embodiments the underside of the top chord may have, or may include, a shedding device which may serve to encourage the deflection of objects around the top chord, or may serve as a protective shield for the top chord. For example, in one embodiment, as illustrated in the detail of FIG. 10*j*, top chord member 610 may be connected to the upper margin 612 of web 614 at a lap joint. The lap joint may be against the outboard side face of top chord member 610. In addition, the top chord assembly may include a protective shield member, or deflector member, such as may be in the nature of a skirt or fender 598. Fender 598 may be located generally underneath top chord member 610, and may provide a progressively lead-in for objects moving in the vertically upward direction. The lead-in may be sloped or tapered. An example of such a skirt is shed plate 600. Shed plate 600 may be a roll formed member with a long dimension running generally parallel to top chord member 610. Shed plate 600 may run along web 614 between vertical stiffeners 616. Alternatively, shed plate 600 may run continuously, or substantially continuously across the tops of the stiffeners. Those stiffeners 616 may be trimmed or chamfered at their upper ends 626 to conform to the profile of shed plate 600. The end of the post may then be welded circumferentially to shed plate 600.

In this arrangement shed plate 600 may have an upper flange portion that may be formed to conform to the inside face of top chord member 610, such that the upper margin of shed plate 600 may lap on the inside face of top chord member 610, and may be welded thereto. The lower, or major, portion 604 of shed plate 600 may extend downwardly and in the outboard direction to meet web 414. The lower margin of shed plate 600 may be welded along its length to web 414. Major portion 604 may be substantially planar, and may extend along an angled, or inclined plane.

In the second, alternate, embodiment of FIG. 10*j*, rather than employ a top chord and a separate shed plate which are subsequently joined together, the top chord member 611 may be an integrally formed member in which the lower wall 613 may be angled and the outboard wall member 615 may extend further down the face of web 614. The integrally formed member may have a closed section.

In one embodiment, web 614 may be a monolithic steel sheet cut from a single piece of stock and which may run substantially the entire length of car 520 from truck center to truck center or from end bulkhead to end bulkhead. That monolithic steel sheet may have an upper margin 612 mated with top chord number 610, typically at a welded lap joint; and a lower margin 628 mated directly with the decking of the car, namely floor panel 544 in the manner described above. Alternatively, the side beam web 614 may be an assembly of an upper portion, 602 and a lower portion 604. Upper portion 602 may be thinner than lower portion 604. Upper portion 602 and lower portion 604 may be joined along a longitudinally running lap joint. Lower portion 604 may lie outboard or inboard of upper portion 602, and the legs of the vertical stiffeners 616 may be trimmed accordingly. The outboard lower margin of lower portion 604 may be beveled to permit a full penetration weld to be made from the outside. As may be noted, floor panel 544 extends under the posts (i.e., stiffeners 616) and outboard of the welded connection with the lower margin of lower portion 604. The junction at floor panel 544 may be such that floor panel 544 extends somewhat beyond web 614 in the laterally outboard direction by some marginal distance. That is to say, the lower margin of lower portion 604 of web 614 may abut the floor panel 544. This abutment may occur at a T-joint in which floor panel 544 has a laterally outboard margin 545 that may extend laterally proud of web 614, or of the junction of web 614 (and hence of lower portion 604) with floor panel 544. This laterally outboard margin 545 may run substantially continuously along the length of car 520. In one embodiment, that marginal overlap may exist all along the junction. Expressed differently, web 614, or a major portion of web 614, may lie in a plane, or on a two dimensional surface (such as a continuous cylindrical surface). That plane or surface may intersect the plane of floor panel 544 along a line of intersection. The laterally outboard edge of floor panel 544 may lie at least as far outboard as the line of intersection, and may extend further outboard to define margin 545.

Web 614 may not necessarily be a monolithic member, but could be made of two or more pieces joined together side-by-side, as by welding. Alternatively, web 614 might be connected to supporting members or to longitudinal stiffeners by mechanical fasteners such as Huck™ bolts. In any case, web 614 may be substantially planar, or may have a major portion thereof lying in a plane. That plane may be a vertical-longitudinal plane (i.e., an x-z plane) or may be an inclined plane, or an arcuate curve ascending from the decking toward the top chord. Whether web 614 is monolithic or not, it may be that lower portion 604 of web 614 immediately next to, and adjoining floor panel 544 may be monolithic (i.e., formed from a single sheet of stock without intermediate joints). A monolithic piece may run substantially the full length of floor panel 544. Portion 604 may be of substantial width, such as to extend from floor panel 544 a substantial distance up stiffeners 616 toward top chord member 610. That width may be greater than 3 inches, and may be as great or greater than ⅕ of the total width of web 614 from floor panel 544 to top chord member 610.

In this embodiment, the shear flow associated with the vertical lading in the receptacle may pass directly from the lower margin of web 614 to the adjoining floor panel 544. As discussed elsewhere, floor panel 544 may be of abnormally great thickness. A region of floor panel 544 running alongside the lower margin of lower portion 604 may tend to be influenced thereby and may tend to act as a bottom flange on side beam 580 (or 578 as may be). The effective width of that bottom flange region may be in the range of 20 to 30 times the thickness of the floor panel plate inboard of lower portion 604, and the width of margin 545 outboard. In one embodiment, the inboard region of influence may be about 24 times the plate thickness. The lower flange function of side sill may be performed by the co-operative interaction of web 614 and floor panel 544.

Each of the predominantly vertically upstanding stiffeners 618 may be located at the same longitudinal stations as the various cross-bearers. There may be a moment connection formed between each such stiffener 618 and the associated cross-bearer 572, and that moment couple connection may have the form of a structural knee, as explained below.

Stiffeners

Vertical stiffener 618 may include a back 632 and a pair of legs 634, 636 mounted to cooperate with an adjacent opposed region 638 of web 614. Back 632 and legs 634, 636 may be an integrally formed pressing, or a pre-fabricated sub-assembly which is then joined to web 614. Back 632 may stand spaced inboard from web 614, and may be in a parallel plane, to that of web 614, which plane may be an x-z plane, with the width of stiffener 618 being in the longitudinal, or x-direction, and the length being in the vertical or z-direction, or generally upward direction toward top chord 512. Legs 634, 636 may connect back 632 to web 618, the distal ends of legs 634 and 636 being connected thereto by suitable means, such as welding. A closed hollow section may be developed, such as may define an upwardly running beam for resisting lateral deflection of web 618 and top chord member 610 of beam 580 generally. Stiffener 618 may be of constant section from bottom to top, or may have a tapering section. A tapering section may be broad at its base or foot where it is underlain by floor panel 544, and narrower at its tip, where it may be connected to top chord member 610. The tapering section may taper in both width along web 614 and depth away from web 614. Put somewhat differently, stiffener 618 may be such that, in the context of resisting lateral deflection of top chord member 610 and web 614, the effective second moment of area at the base (including the co-operative effect of the adjoining region 638 of side sheet web 614) of stiffener 618 may be greater than at the tip, and may diminish progressively along the length thereof. The effective width of cooperative adjoining region 638 may be the distance between legs 634, 636 plus an effective distance to either side thereof that is, in total, in the range of 40-60 times the thickness of web 614. In one embodiment, this effective distance may be about 44-48 times that thickness plus the distance once between the webs.

A side beam web extension 646 may be mounted under floor panel 544, and a stiffener extension assembly 644 may be mounted outboard of side beam web extension member 646. Side beam web extension member 646 may be substantially planar, and may be of substantially the same thickness as lower portion 604 of side beam web 614. Side beam web extension member 646 may be mounted to the underside of floor panel 544, and may be mounted such that the mating of the upper margin of extension member 646 lies directly opposite the mating of side web member 614 with floor panel 544. Extension member 646 may include a first or central portion 648 corresponding in width to the width between the legs of stiffeners 616. In one embodiment, central portion 648 may extend more than 3 inches below floor panel 544. In another embodiment, central portion 648 may extend more than half the depth of web 585, from floor panel 544. In a further embodiment, central portion 648 may extend to substantially the full depth of webs 585, such that the upward- and downward length or depth corresponds to the distance between floor panel 544 and cross-bearer bottom flange member 588.

Extension member 646 may also include adjacent wing portions 650, 652 which may be co-planar with central portion 648, all of which may be co-planar with web member 618. Wing portions 650, 652 may each have a substantially triangular or somewhat trapezoidal form, and may function as gussets having one vertex mated to an outside face of cross-bearer web 585, most typically as by welding, and a second vertex mated to the underside of floor panel 544 directly opposite web 614. Wing portions 650, 652 may be smoothly and generously radiused at the lowest corner, and smoothly and generously radiused at the distant feathered termination along the vertex adjoining floor panel 544. To the extent that there may be a tensile (or compressive) stress field in the up-and-down direction in web 614 in the neighborhood of the post (namely stiffener 618), gussets 650, and 652 and central portion 648 may tend to collect or distribute that stress, as it passes through floor panel 544, along a line, and may tend to transmit or receive that stress as distributed shear flow along a line of shear in a distributed manner, such as may tend (a) to reduce local bending moments in the junction with floor panel 544, and (b) to reduce peak stresses, and to even out the distribution of stress, at least to some extent, along the line of shear force transfer described below.

A stiffener extension assembly 644 may be mounted beneath each of stiffeners 618 generally in line with each of cross-bearers 572. Stiffener extension assembly 644 may include a first wall or member 654, a second wall or member 656, and a third wall or member 658. The first, second, and third members may be substantially planar, and may be formed as a single, integrally formed part, such as a section of channel 660, which may be a pressed or roll formed or other structural section cut to length as a stub section. That length may be 6 inches or more. In one embodiment that length may be as great as, or greater than half the depth of webs 585 of cross-bearer 572. In another embodiment, that length may correspond, more or less, to the depth of webs 585 in full. First wall member 654 may be the back of the stub channel 660, and second and third wall members 656, 658 may be the legs of the stub channel 660. Stiffener extension assembly 644 may nest between floor panel 544 and the end portion of bottom flange member 588, such as may be identified as a cross-bearer bottom flange extension portion 662. Web 585 may be trimmed back to accommodate this nesting, and may be welded along a vertical fillet to the inboard face of first wall member 654. Cross-bearer bottom flange extension portion 662 may be welded to the lower end of the stub section of channel 660, to provide a shear flow transfer connection along a line between the lower margins of second and third wall members 656 and 658. The most laterally outboard distal end of bottom flange extension member 562 may adjoin, and be connected to, the lowermost margin of side beam web extension member 646. In one embodiment, first wall member 654 may stand in a substantially vertical plane. Web extension member 646 is welded across the toes of the channel, namely the outboard margins of second wall member 656 and third wall member 658, and those toes may be trimmed to permit the opposed member, web extension 646, to lie within the underframe clearance diagram of AAR Plate B, C or F.

In this embodiment, extension 646 and first wall member 654 do not lie in parallel planes, but rather are in skewed planes. Nonetheless, they provide a pair of spaced apart plates whose upper ends align with the lower ends of web 614 and stiffener back 632. Being aligned in this way, those spaced plates provide a means by which a moment couple can be carried to and from the spaced flanges defined in this context by the web 614 and back 632. Similarly, extension 646 and first wall member 654 are joined along a line of attachment to vertices of second and third wall members 656 and 658, at which interface shear flow may be transferred into the shear panels defined by wall members 656 and 658. In the other direction, bottom flange member 588 and floor panel 544 co-operate to provide another pair of spaced apart flanges for carrying the corresponding reaction moment couple, those members being connected in line attachment along the other vertices of members 656 and 658. In this case, the shear web panels are neither rectangles, nor parallelograms, but merely quadrilaterals, in this case trapezoids.

To the extent that it may be desired that the moment connection at the junction of the foot of stiffener 618 with floor panel 544 be maintained, and to the extent that the inside of car 520 may be subject to duty in which it may be subject to sharp or hard impact either vertically or laterally, it may be that the junction between stiffener 618 and floor panel 544 may be protected by a guard, shield, or reinforcement. That reinforcement may include one or more angle irons welded about the base of stiffener 618, or may include a footing plate 639, or plates, such as may either alone, or in combination tend to surround that junction and make it less prone to impact or other damage. For example, in one embodiment, footing plate 639 may have the plan form of a horseshoe, or U-shaped plate 640 whose internal face or accommodation 642 conforms, generally speaking, to the outside shape of the base of stiffener 618, and may provide protection to the back and sides of the welded joint. Plate 640 may be welded to floor panel 544. The internal accommodation may have a bevel, permitting the bottom end of stiffener 618 to be welded not only to floor panel 544, but also to have a deep weld to plate 640.

Stiffeners 620 may also be mounted along web 614. They may be mounted at longitudinal stations corresponding to the longitudinal stations of cross-ties 576. Alternatively stiffeners 620 may be mounted on different pitches from the cross-ties, as explained in the context of the description of car 320, above. Each stiffener 620 may include a web member 664 running predominantly up-and-down on, and extending inwardly away from web 614, and a flange member 666 running with, and having a shear flow connection with, web member 664, the flange member 666 being spaced from web 614, and typically standing laterally inboard thereof. In one embodiment, stiffener 620 may have a formed section such as a an angle; a hollow tube which may be rectangular or square; a roll formed section; an I-beam; a U-pressing; or a channel, 668 in which flange member 664 may be the back 670 of the channel, and web member 664 may be either of two legs 672 of channel 668 whose toes are welded to web 614.

As with stiffener 618 described above, the co-operation of channel 668 with web 614 may tend to yield a hollow structural section that stiffens web 614 in the up-and-down direction, perpendicular to top chord member 610, and that may tend to deter buckling of the web. That structural section may tend to have an effective inner flange width equal to the width of the channel between the legs, plus an effective flange width to either side of 20 to 30 times the thickness of web 614, as noted above.

The upper end of stiffener 620 may be welded to top chord member 610, or to a fender, such as shed plate 600, the upper end being appropriately chamfered, as may be. Floor panel 544 may underlie the foot of stiffeners 620 and may be connected thereto, as by welding. While a joint protector, such as a horseshoe shaped plate or guard as described above in the context of stiffener 618. However, to the extent that this junction may not be relied upon to pass a moment couple, but may be analyzed as approximating a pin joint, such a guard may, alternatively, not be employed.

Web member 614 may also have web extensions 680. Web extensions 680 may be in the form of gussets welded to the underside of floor panel 544 in a position opposite to the locus of mating of side sheet web 614 and floor panel 544 centered on the center line of cross-tie 576 and stiffener 620. Web extensions 680 may have a generally trapezoidal form that may include a rectangular central portion 682 that extends across the distal end of one of cross-ties 576, and is welded to web 592 and bottom flange 596 thereof, as well as to the underside of floor panel 544. Web extensions 680 may also include generally triangular wing portions 684, analogous to wing portions 650 of web extensions 646, that spread the effect of the junction into the adjoining web regions. In contrast to the junction between stiffener 616 and cross-bearer 572, the junction between side stiffener 618 and cross-tie 576 may not include a post extension assembly such as assembly 644, and may not include a structural knee connection, such as described above, and discussed below. (Although such a post-extension structural knee assembly could be used in an alternate embodiment).

A structural knee 686 is also formed at the distal ends of main bolsters 582. Stiffeners 622 may be of substantially the same construction as stiffeners 618, and floor panel 544 may underlie the bottom ends of the main posts (namely, stiffeners 622), and with which they are mated in substantially the same manner as stiffeners 618. Side sheet extensions 690 may be positioned with their upper margins welded to floor panel 544 opposite the locus of mating of web 614 with floor panel 544, yet extend at an inwardly and downwardly sloping angle, rather than being co-planar with web 614. Post extension assembly 692 may have a back plate 688 lying between two side webs 687, and abutting the truncated outboard end of web 583. These may be welded between bottom floor panel 544 and bottom flange 694 of main bolster 582. Plate 688 may align with the back, or flange, of stiffener 622, and side sheet extension 690 may be welded across the end of main bolster 582, yielding, once again, a structural knee into which two pairs of moment couple carrying flanges are connected about a pair of spaced apart shear transfer webs. Side sheet extension 690 may include an eye 695, which may also be termed a lifting lug, to permit the car body to be lifted. In addition, post extension assemblies 692 may include a thick bottom flange end region 696 mounted to the underside of assemblies 692, plate 696 having an eye 697 such as may accommodate a lifting lug. Plate 696 may also provide a reinforced jacking point by which the end of the car body may be lifted. The all welded connection may include backing bar members 491 such as may lie behind butt weld joints.

The Structural Knees

The railroad freight car 520 may have structural knees, as noted above. For the purpose of the following discussion, those knees may be identified as 686 at the junction of the cross-bearers and their associated side posts, as well as at the junction of the main bolsters and their associated vertical side posts. The foregoing description of the connection of side posts (i.e., stiffener 618) to cross-bearer 572 is a description of a structural knee 686.

In the non-limiting examples of railroad cars 20, 220 and 520 described above, in each case the structural knee has a first moment connection to the side post, a second moment connection to the cross-bearer (or main bolster, as may be), and a shear member mounted between the two moment connections. To the extent that the moment couple is defined as a moment about an axis of rotation, the shear web tends to be radially extensive relative to that axis, and may most generally extend in a plane to which that axis of rotation is normal.

Although in each example discussed the pairs of spaced apart members defining the flanges of the moment couple connections have been planar, and have formed a quadrilateral boundary about the shear web member, that need not necessarily have been so. For example, the cross-bearer bottom flange extension and the side post outboard flange extension (or, in the case of car 520, the side beam web extension) could be formed a single member connected at a radiused corner, or the member could be formed on a continuous curve such as might conform to a round cylindrical surface or to an elliptical surface, as may be. Similarly, while the shear member may be a quadrilateral in which opposite pairs of vertices accept one or other of the moment connecting flanges, this need not be. The shear member could be a polygon of a number of sides other than four. For example, the shear member might be a pentagon if chamfered at the outside bottom corner to keep within the AAR underframe clearance envelope. As noted, some of the corners, such as the outside bottom corner, may be radiused, and may have a flange member that corresponds either to a chamfer or a radius as may be. In each case, although not strictly speaking a quadrilateral, the mere radiusing or chamfering of corners should not be understood to remove such shear members, which may retain a substantially or predominantly four-sided shape and moment couple transmitting function, from being considered as, or from falling within the meaning of, quadrilaterals herein.

Various embodiments have been described in detail. Since changes in and or additions to the above-described examples may be made without departing from the nature, spirit or scope of the invention, the invention is not to be limited to those details.

We claim:

1. A rail road gondola car, said rail road gondola car having:

a lading containment receptacle mounted on a pair of spaced apart rail road car trucks for rolling motion along rail road tracks in a longitudinal direction;

first and second side beams defining first and second side walls of said receptacle;

a deck defining a floor of said lading containment receptacle;

an array of cross-members extending cross-wise underneath said deck between said first and second side walls;

said array of cross-members including at least a first cross-member;

said first cross-member having a first end and a second end;

said first end being adjacent to said first side beam, said first cross-member of said array of cross-members extending laterally inboard of said first end;

said first side beam including a predominantly upstanding web running lengthwise along said car;

an array of longitudinally spaced upstanding stiffeners mounted to reinforce said first side wall;

said array of longitudinally spaced upstanding stiffeners including a first stiffener;

said upstanding web of said first side beam extending upwardly of said deck;

said first side beam having a first web extension, said first web extension extending predominantly downwardly of said deck, and said first web extension being mounted to said first end of said first cross-member;

there being web continuity between said first web extension and said upstanding web;

said first web extension having a lower margin downwardly distant from said deck;

said first web extension being narrower at said lower margin than nearer to said deck, said first web extension having broadening wings to either side of said first end of said first cross-member.

2. The rail road gondola car of claim 1 wherein said broadening wings are substantially triangular and are smoothly radiused adjacent said deck, and smoothly radiused to merge with said lower margin.

3. The rail road gondola car of claim 1 wherein:

said first stiffener has a first end adjacent said deck, and a second end upwardly distant from said deck, said first stiffener being mounted to reinforce said upstanding web of said first side beam;

a first deck extension is located laterally outboard of said deck, said first deck extension being mounted to said first end of said first stiffener;

there is web continuity between said deck and said first deck extension; and said first deck extension has a laterally outboard margin most distant from said web of said first side beam;

said first deck extension is narrower in the longitudinal direction at said laterally outboard margin thereof than is said first deck extension at a location closer to said first side wall;

said first deck extension includes wings to either side of said first stiffener, and said wings are smoothly radiused adjacent said web of said first side beam, and smoothly radiused adjacent said laterally outboard margin.

4. The rail road gondola car of claim 1 wherein:

said first stiffener has a first end adjacent said deck, and a second end upwardly distant from said deck, said first stiffener being mounted to reinforce said upstanding web of said first side beam;

a first deck extension is located laterally outboard of said deck, said first deck extension being mounted to said first end of said first stiffener;

there is web continuity between said deck and said first deck extension; and said first deck extension has a laterally outboard margin most distant from said web of said first side beam;

said first deck extension is narrower in the longitudinal direction at said laterally outboard margin thereof than is said first deck extension at a location closer to said first side beam;

said first deck extension includes broadening wings to either side of said first stiffener, and said first stiffener and said first cross-member are co-aligned at the same longitudinal station of said rail road gondola car.

5. The rail road gondola car of claim 4 wherein:

said first cross-member has a laterally running web, said laterally running web extending predominantly downwardly of said deck, said laterally running web having an upper margin adjacent said deck and a lower margin distant from said deck;

said first cross-member has a laterally running flange mounted to said lower margin of said laterally running web, said flange being distant from said deck;

said first stiffener has a predominantly upwardly running web, said predominantly upwardly running web being connected to said web of said first side beam, said predominantly upwardly running web extending away from said first side beam, and having a margin distant therefrom;

said first stiffener has a predominantly upwardly running flange, said predominantly upwardly running flange being mounted to said web of said first stiffener, and being distant from said web of said first side beam;

there is a stiffener extension extending downwardly of said first stiffener;

said stiffener extension having a first member providing flange continuity with said upwardly running flange of said first stiffener, and a second member providing flange continuity with said flange of said first cross-member;

said stiffener extension has a shear plate member, said shear plate member having a quadrilateral form, said quadrilateral form being connected along edges thereof to (a) said first deck extension; (b) said first side beam first web extension; (c) said first member of said stiffener extension; and (d) said second member of said stiffener extension, whereby a structural knee is defined capable of passing bending moments between said first cross-member and said first stiffener.

6. The rail road gondola car of claim 5 wherein said shear plate member of said stiffener extension is co-planar with either of (a) said upwardly running web of said first stiffener; and (b) said web of said first cross-member.

7. The rail road gondola car of claim 6 wherein said wings of said deck extension and said wings of said first web extension are all smoothly radiused.

8. The rail road gondola car of claim 1 wherein said first stiffener is mounted laterally inboard of said web of said first side beam.

9. The rail road gondola car of claim 8 wherein said first stiffener of said first side beam is aligned with said first cross-member at the same longitudinal station of said rail road gondola car.

10. The rail road gondola car of claim 5 wherein said laterally running flange of said first cross-member has a wide portion and a narrow portion, said wide portion being laterally outboard of said narrow portion, and said wide portion defining said second member of said stiffener extension.

11. The rail road gondola car of claim 1 wherein said web of said first side beam is welded directly to said deck, and said car is free of a side sill.

12. The rail road gondola car of claim 11 wherein said gondola car has a protective shroud within said receptacle, said protective shroud being positioned to protect the weldment of said web of said first side beam to said deck.

13. The rail road gondola car of claim 1 wherein:

said first stiffener has a back and two legs, the legs being mounted toes-in to said web of said first side beam, and said back standing distantly therefrom, whereby said first stiffener and said web form a hollow tube;

said first web extension has a central portion of width corresponding to said hollow tube between said legs, and said wings of said first web extension being substantially triangular shaped portions located to either side of said central portion.

14. The rail road gondola car of claim 13 wherein said deck has a corresponding deck extension that extends under said first stiffener and to which said first stiffener is mounted, said deck extension having a central portion under said first stiffener, said central portion having a most laterally outboard margin;

and first and second wing portions to either side thereof, said wing portions being smoothly radiused to merge with said most laterally outboard margin of said central portion and being smoothly radiused to merge with said deck adjacent said web of said first side beam.

15. The rail road gondola car of claim 1 wherein:

said car has first and second end walls, said lading containment receptacle having a length defined between said end walls;

said lading containment receptacle has a width defined between said first and second side beams;

said deck extends from said first end wall to said second end wall, and from said first side wall to said second side wall;

said web of said first side wall is welded directly to said deck;

said first cross-member has a laterally running web, said laterally running web having an upper margin welded directly to said deck;

said laterally running web extends predominantly downwardly of, said deck;

said laterally running web has a lower margin distant from said deck;

said first cross-member has a laterally running flange mounted to said lower margin of said laterally running web, said flange being distant from said deck; and at least half of said deck is formed from a single monolithic piece of steel sheet;

whereby said steel sheet defines both a bottom flange of said first side beam and a top flange of said first cross-member.

16. The rail road gondola car of claim 15 wherein:

said rail road gondola car has a center sill;

said center sill has first and second webs extending downwardly of said deck, said first and second webs of said center sill being laterally spaced apart from each other and running longitudinally; and said first and second webs of said center sill each having an upper margin welded directly to said monolithic piece of steel sheet, whereby said steel sheet defines a top cover plate of said center sill.

17. The rail road gondola car of claim 1 wherein:

said deck has a laterally outboard margin that extends laterally outboard of said web of said first side beam;

said web of said first side beam is welded directly to said deck at an inboard fillet weld and an outboard fillet weld; and said first web extension is welded to an underside of said deck in web continuity with said web of said first side beam.

18. A rail road gondola car, said rail road gondola car comprising:

a car body carried by rail road car trucks for rolling motion in a longitudinal direction along rail road car tracks;

a first side wall and a second side wall spaced apart crosswise;

a first end wall and a second end wall spaced apart in the longitudinal direction;

a substantially flat deck;

an array of cross-members, said array including a first cross-member;

said deck having a first end at which said first end wall is mounted, and a second end at which said second end wall is mounted;

said deck having a first laterally outboard margin and a second laterally outboard margin;

said first side wall has a first side wall web running along said first laterally outboard margin, said first side wall web being directly connected to said deck;

said second side wall has a second side wall web running along said second laterally outboard margin, said second side wall web being directly connected to said deck whereby said deck defines a bottom flange of said first and second side walls;

said first cross-member having a laterally running web, said laterally running web being directly connected to said deck, said laterally running web extending downwardly of said deck, whereby said deck defines an upper flange of said first cross-member; and at least half of said deck is formed from a single monolithic piece of steel sheet.

19. The rail road gondola car of claim 18 wherein said car body includes a center sill, said center sill having first and second laterally spaced apart longitudinally running center sill webs, said first and second center sill webs each having an upper margin welded directly to said deck, whereby said deck defines a top cover plate of said center sill.

20. The rail road car of claim 18 wherein said steel sheet has a laterally outboard margin that extends laterally beyond said first side wall web, and said first side wall web is welded both inside and outside to said steel sheet.

* * * * *